US010589927B2

(12) United States Patent
Schofield et al.

(10) Patent No.: US 10,589,927 B2
(45) Date of Patent: Mar. 17, 2020

(54) WASTE DISPOSAL SYSTEM

(71) Applicant: Sangenic International Ltd., Cramlington (GB)

(72) Inventors: Paul Schofield, Cramlington (GB); Douglas Begg, Cramlington (GB); Andrew Mattocks, Cramlington (GB); Matthew James Brady, Cramlington (GB); Benjamin John Strutt, Cramlington (GB); Andrew Julian Stockdale, Cramlington (GB); Nicholas Martin Broadbent, Cramlington (GB); Kenneth Waeber, Cramlington (GB); Benjamin Krupp, Mason, OH (US); Kenneth Hogue, Mason, OH (US); James Yoder, Mason, OH (US); David Tekamp, Mason, OH (US)

(73) Assignee: SANGENIC INTERNATIONAL LTD., New Castle Upon Tyne (GB)

( * ) Notice: Subject to any disclaimer, the term of this patent is extended or adjusted under 35 U.S.C. 154(b) by 756 days.

(21) Appl. No.: 14/402,923

(22) PCT Filed: May 28, 2013

(86) PCT No.: PCT/GB2013/051409
§ 371 (c)(1),
(2) Date: Nov. 21, 2014

(87) PCT Pub. No.: WO2013/175244
PCT Pub. Date: Nov. 28, 2013

(65) Prior Publication Data

US 2015/0151908 A1 Jun. 4, 2015

(30) Foreign Application Priority Data

May 25, 2012 (GB) ..... 1209254.0

(51) Int. Cl.
*B65F 1/00* (2006.01)
*B65F 1/06* (2006.01)
(Continued)

(52) U.S. Cl.
CPC ..... *B65F 1/062* (2013.01); *B65B 35/10* (2013.01); *B65B 39/007* (2013.01); *B65B 41/16* (2013.01);
(Continued)

(58) Field of Classification Search
CPC ..... B65F 1/062; B65F 2210/167; B65F 2240/132; B65B 9/02; B65B 9/026; B65B 9/023; B65B 9/04; B65B 51/16
(Continued)

(56) References Cited

U.S. PATENT DOCUMENTS 2,828,590 A 4/1958 Swartz et al.
6,052,842 A * 4/2000 He ..... A47K 11/026 4/484
(Continued)

FOREIGN PATENT DOCUMENTS

DE 102005055227 5/2007
EP 0906743 A1 4/1999
(Continued)

OTHER PUBLICATIONS

European Patent Office, International Search Report for Sangenic International Limited PCT/GB2013/051409, dated Jan. 27, 2014.
(Continued)

*Primary Examiner* — Chelsea E Stinson
(74) *Attorney, Agent, or Firm* — Olson & Cepuritis, Ltd.

(57) ABSTRACT

A waste disposal device for sealing waste and a cassette for dispensing film are disclosed. The waste disposal device comprises first and second rollers, each comprising first and second end portions and a joining portion therebetween. The
(Continued)

end portions of the first and second rollers are arranged to receive and seal first and second film portions therebetween as the first and second rollers rotate. The joining portions of the first and second rollers are arranged to define an aperture for receiving waste in a first rotary configuration of the rollers and to seal the first and second film portions therebetween in a second rotary configuration of the first and second rollers. The cassette comprises first and second portions comprising respective first and second film dispensers. The first portion is mechanically connected to the second portion. The cassette is moveable between a first, compact configuration and a second, extended configuration.

19 Claims, 59 Drawing Sheets

(51) Int. Cl.
*B65B 35/10* (2006.01)
*B65B 39/00* (2006.01)
*B65B 41/16* (2006.01)
*B65B 51/16* (2006.01)

(52) U.S. Cl.
CPC ..... *B65B 51/16* (2013.01); *B65F 2210/167* (2013.01); *B65F 2240/132* (2013.01)

(58) Field of Classification Search
USPC ..... 53/545, 239, 450, 550
See application file for complete search history.

(56) References Cited

U.S. PATENT DOCUMENTS 7,708,188 B2 * 5/2010 Stravitz ..... B65B 67/1277 220/908.1
8,783,499 B2 * 7/2014 Lacy ..... B65F 1/062 220/495.06
9,149,163 B2 * 10/2015 Natt ..... A47K 11/026
2005/0194402 A1 9/2005 Morrison
2006/0179795 A1 8/2006 Barker
2006/0218886 A1 10/2006 Lopoukhine et al.
2006/0283153 A1 * 12/2006 Nakano ..... B65B 9/02 53/553
2012/0090282 A1 4/2012 Tsumura
2013/0298506 A1 11/2013 Lucas et al.

FOREIGN PATENT DOCUMENTS

EP 223643 A2 9/2010
GB 2468204 9/2010
GB 2480499 A 11/2011
JP 11254527 9/1999
JP 2005145562 A 6/2005
JP 2006-124029 5/2006
JP 2006124029 A 5/2006
JP 2008-030862 2/2008
WO 03068635 A1 8/2003
WO 2005037684 4/2005
WO WO 2011144950 A1 * 11/2011 ..... A47K 11/026
WO 2012081985 A2 6/2012

OTHER PUBLICATIONS

European Patent Office, Written Opinion for Sangenic International Limited PCT/GB2013/051409, dated Jan. 27, 2014.
United Kingdom Patent Office, Search Report under Section 17(5) for Sangenic International Limited GB1209254.0, dated Oct. 23, 2013.
Search Report dated Sep. 16, 2013 for application No. GB1309502.1; 1 page.
Search Report dated May 22, 2014 for application No. GB1406388.7; 2 pages.
UKIPO Search Report dated Feb. 13, 2014; 9 pages.

* cited by examiner

WASTE DISPOSAL SYSTEM

CROSS-REFERENCE TO RELATED APPLICATIONS

This Application is a U.S. National Stage filing under § 371 of International Application No. PCT/GB2013/051409, with an international filing date of 28 May 2013, now pending, claiming priority from Great Britain Application No. GB 1209254.0 with a filing date of 25 May 2013, now pending, and herein incorporated by reference.

TECHNICAL FIELD

The invention relates to a waste disposal system and, in particular, a waste disposal system for sealing and storing items of waste.

BACKGROUND

Waste storage devices are known in which an item of waste, such as a baby's nappy (diaper) or other personal waste, is individually wrapped. For example, the item of waste may be received in a tube of film, and a twist in the film is provided at either side of the item of waste to form a package containing the item of waste. However, such twists in the film may unravel over time and thus may not provide a seal sufficient to prevent odour and waste leaking from the package.

Additionally, known waste storage devices make use of replaceable cassettes which dispense the film in which an item of waste is packaged. Such cassettes are insertable into the waste storage device, usually at the top. Conventional waste storage cassettes generally comprise a solid body with an aperture therein, the aperture being large enough to receive an item of waste therethrough. As a result, known cassettes can be bulky and difficult to transport and store.

An invention is set out in the claims.

A waste disposal device for sealing waste is provided. The waste disposal device comprises first and second rollers. Each of the first and second rollers comprises first and second end portions and a joining portion therebetween. An end portion of the first roller and an end portion of the second roller are arranged to receive and seal first and second film portions therebetween as the first and second rollers rotate. The joining portion of the first roller and the joining portion of the second roller are arranged to define an aperture for receiving waste in a first rotary configuration of the first and second rollers and to seal the first and second film portions therebetween in a second rotary configuration of the first and second rollers.

A cassette for dispensing film is also provided. The cassette comprises a first portion comprising a first film dispenser and a second portion comprising a second film dispenser. The first portion is mechanically connected to the second portion. The cassette is moveable between a first, compact configuration and a second, extended configuration.

BRIEF DESCRIPTION OF THE DRAWINGS

Specific embodiments and examples are shown in the accompanying drawings, in which.

DETAILED DESCRIPTION OF THE INVENTION

A waste disposal device for sealing waste is provided. The waste disposal device is arranged to receive waste items, usually in an upper part of the device. The waste disposal device can further receive a cassette, wherein the cassette includes film for wrapping waste. Below its waste-receiving portion, the device comprises first and second rollers, each comprising first and second substantially cylindrical end portions and a joining portion therebetween. Each end portion of the first roller interacts with the corresponding end portion of the second roller to receive and seal together the ends of first and second film portions therebetween as the rollers rotate. The joining portions of the rollers define an aperture for receiving waste when the rollers are in a first rotary configuration. The rollers rotate, with the aperture allowing the waste item to pass therethrough, between the sealed ends of the film portions. After the waste item has passed through the aperture, the joining portions of the rollers come together in a second rotary configuration. The rollers thereby seal together the first and second film portions along their length, between the already-sealed ends. The rollers can seal the film portions both above and below an encapsulated waste item. Thus the waste disposal device provides an effective seal around an item of waste that passes through the rollers.

Additionally, a cassette for dispensing film is provided. The cassette comprises a first portion hinged to a second portion. The first and second portions each house a film dispenser, for example a roll of film. The cassette is moveable between a first, compact configuration and a second, extended configuration by folding or unfolding the first and second portions via the hinge. In the first, compact (or folded) configuration, the rolls of film are adjacent to one another. In the second, extended (or unfolded) configuration, the rolls of film are separated to define an aperture therebetween for receiving an item of waste. Thus the cassette can be easily transported and stored when in its first, compact configuration, whilst still providing a sufficiently large aperture for receiving an item of waste between the first and second film dispensers when in its second, extended configuration.

DETAILED DESCRIPTION

Figure 1:
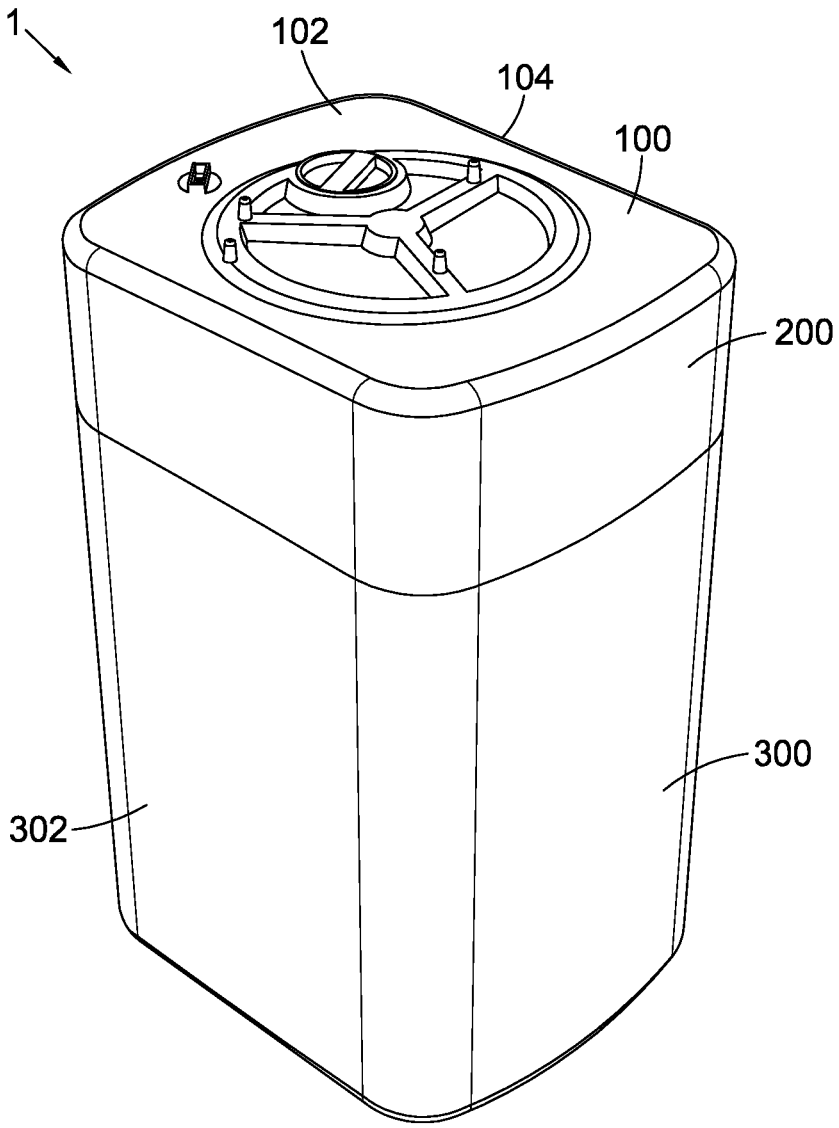
FIG. 1 is a perspective view of a waste disposal device.
Figure 2:
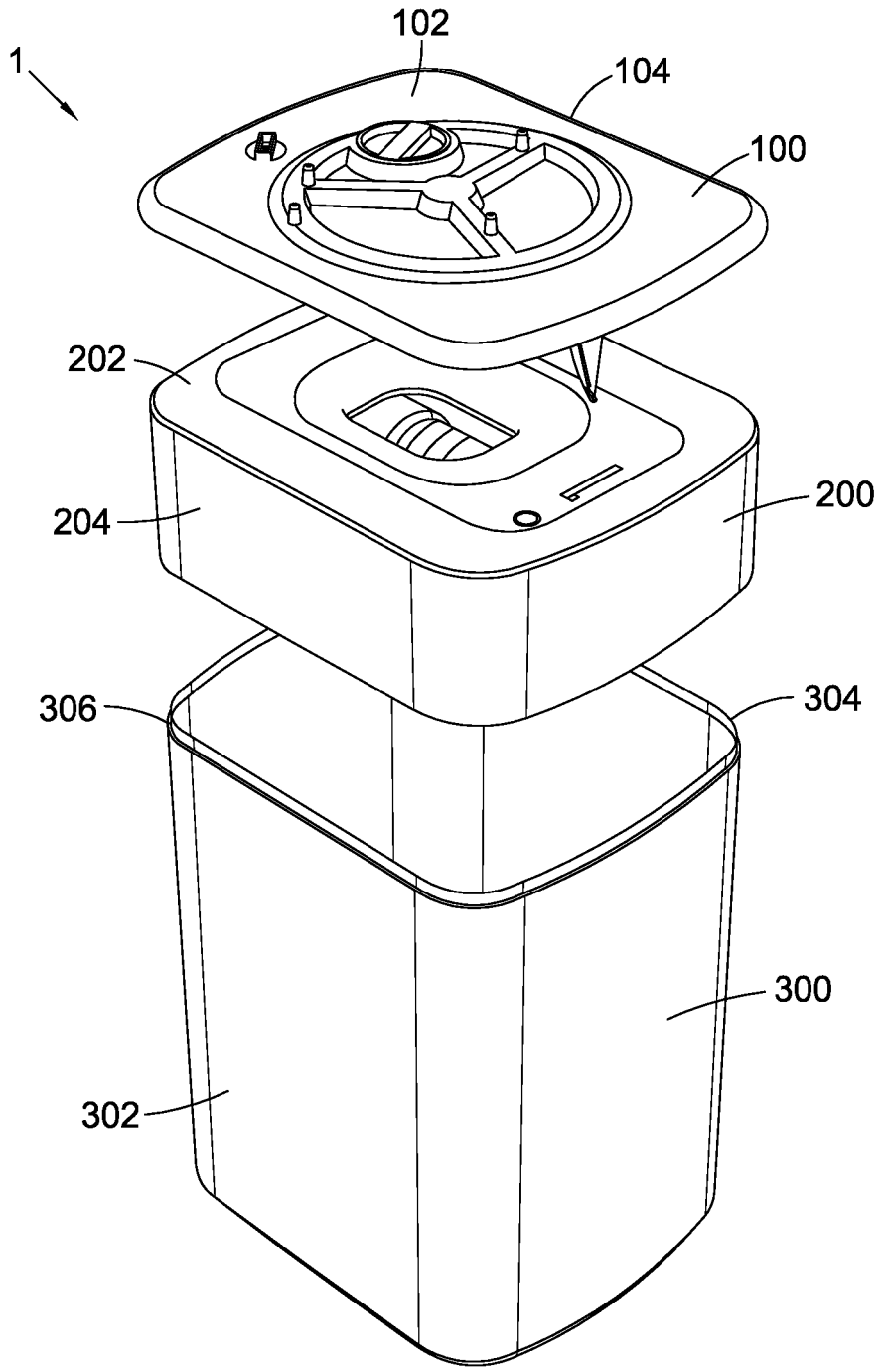
FIG. 2 is an exploded view of the waste disposal device.

FIGS. 1 and 2 show an improved waste disposal device 1. The waste disposal device 1 comprises a lid 100, a top section 200 and a bottom section 300. The bottom section 300 comprises a base and a surrounding wall 302, forming a receptacle for receiving waste inserted into the waste disposal device 1. An upper part 304 of the surrounding wall 302 is recessed defining a shoulder 306.

The bottom section 300 may further comprise a drawer provided in the surrounding wall 302, into which waste is received. The drawer can be removed from the bottom section 300 for ease of access to the waste when a user empties the waste disposal device 1.

The top section 200 comprises a top face 202 and a surrounding wall 204. The surrounding wall 204 of the top section 200 fits over the recessed upper portion 304 of the bottom section 300 and rests on the shoulder 306 to define an enclosure.

Lid

The lid 100 comprises a cover 102 that is pivotally attached to the top section 200 via a hinge along an edge 104 of the lid 100. The lid 100 will now be described in more detail with reference to FIGS. 3 to 6A.

Figure 3:
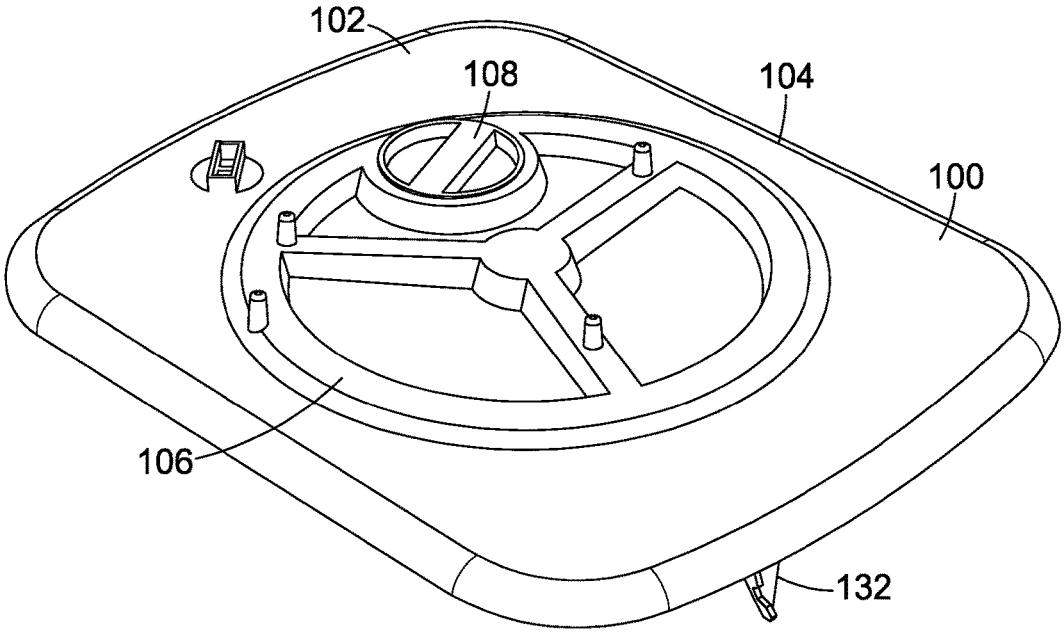
FIG. 3 is a first perspective view of a lid of the waste disposal device.
Figure 4:
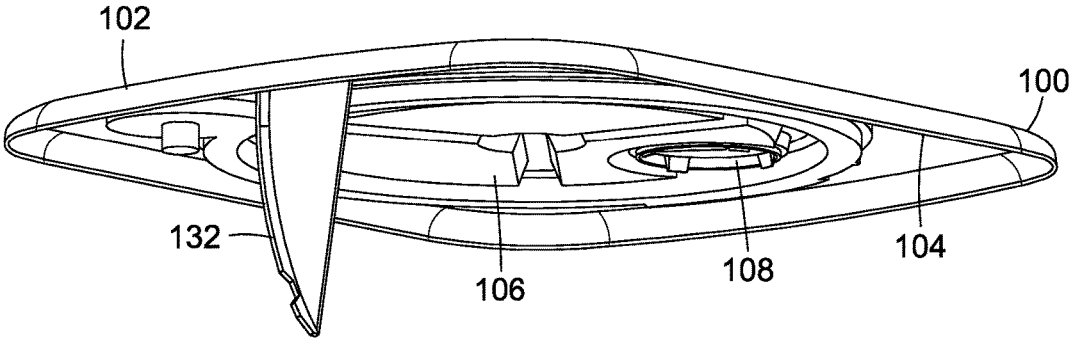
FIG. 4 is a second perspective view showing an underside of the lid of the waste disposal device.

Turning to FIG. 3, the cover 102 has a substantially circular cut-out portion in which a ring 106 is located. The ring 106 is comprised of a substantially circular disc and is rotatable within the cut out portion of the cover 102. A handle 108 is provided on the ring 106 to facilitate rotation of the ring 106. The handle 108 is rotatable with respect to the ring 106.

Figure 5:
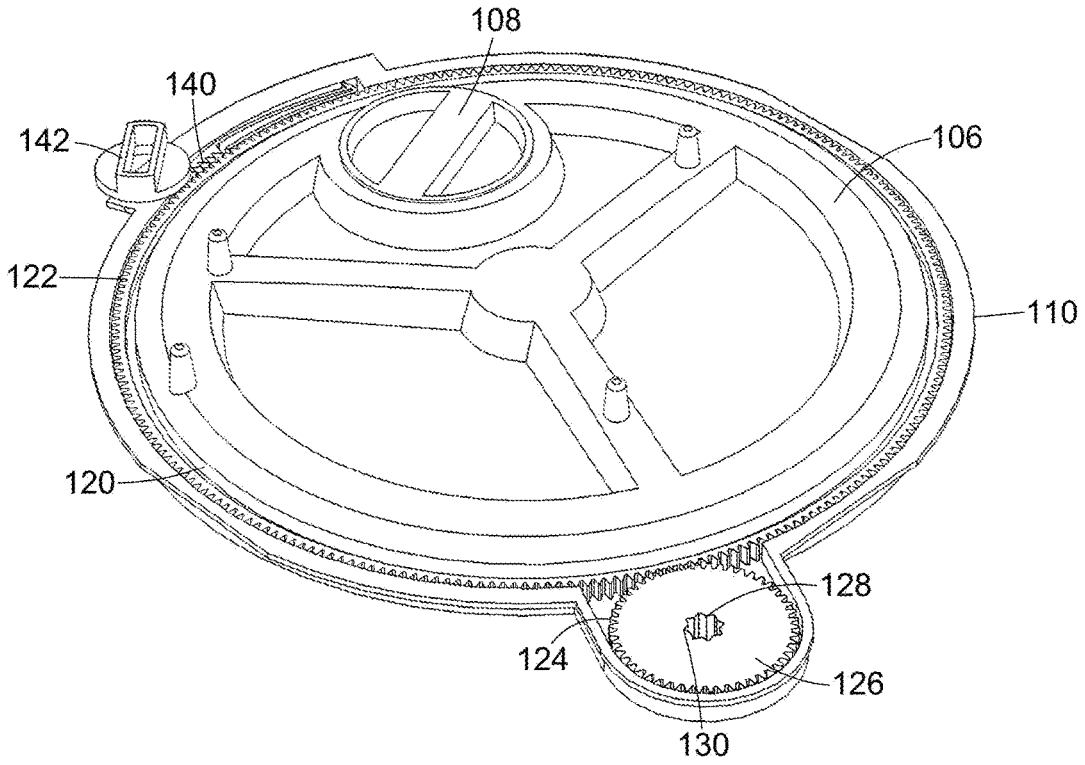
FIG. 5 is a perspective view of the lid of the waste disposal device with the lid cover not shown.
Figure 6:
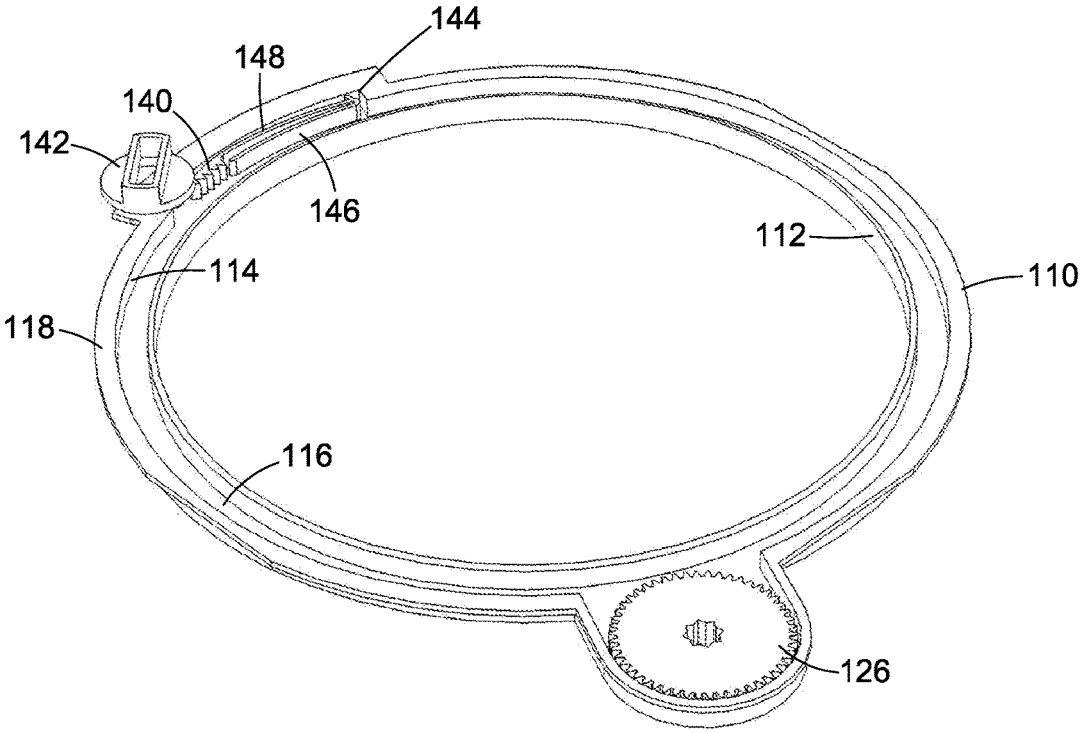
FIG. 6 is a perspective view of the lid of the waste disposal device with the ring and handle not shown.

FIG. 5 shows the lid 100 with the cover 102 not shown. FIG. 6 shows the same view as FIG. 5 but with the ring 106 and handle 108 also not shown.

The ring 106 rotates on a ring support 110 provided on an underside of the cover 102. The ring support 110 is generally circular and substantially U-shaped in cross-section, said U-shape being defined by an inner wall 112 and an outer wall 114 joined by a base portion 116 therebetween. The outer wall 114 comprises a flange 118 that extends radially outwards for securing the ring support 110 to the cover 102.

The ring 106 has a downwardly projecting lip 120 at its periphery. The lip 120 of the ring 106 rests on the base 116 of the ring support 110 and is contained by the inner 112 and outer 114 walls of the ring support 110 to keep the ring 106 centred within the ring support 110.

A plurality of teeth 122 are provided around the lip 120 of the ring 106. In one embodiment a ratchet 140 provided in an arc-shaped channel 144 in the flange 118 of the outer wall 114 of the ring support 110 cooperates with the teeth 122 of the ring 106 to ensure rotation of the ring 106 in a single direction. The ring teeth 122 mesh with outer teeth 124 around the circumference of a spur gear 126 also provided in the ring support 110 on the underside of the cover 102. The spur gear 126 has a hole 128 therethrough which receives and engages a drive shaft 538 via inner teeth 130.

A switch 142 allows a user to disengage the ratchet 140 from the ring 106 in the event that the waste disposal device 1 becomes jammed.

The ratchet 140 comprises first 146 and second 148 arms joined to one another at a first end of the ratchet 140. The first 146 and second 148 arms are provided adjacent to one another and are deflectable towards or away from one another. The first arm 146 is shorter than the second arm 148. A portion of the second arm 148 that extends beyond the end of the first arm 146 towards the second end of the ratchet 140 is provided with ratchet teeth.

The ratchet 140 is movable within the arc-shaped channel 144. As a user rotates the ring 106 in a first direction (clockwise in FIG. 6), the ratchet 140 is dragged along the arc-shaped channel 144 away from the switch 142 by the frictional force between the first arm 146 and the teeth 122 of the ring 106. The friction between the teeth 122 of the ring 106 and the first arm 146 of the ratchet 140 is not significant enough for the user to feel any noticeable resistance when rotating the ring 106.

As the user rotates the ring 106 in a second direction (anti-clockwise in FIG. 6), the ratchet 140 is dragged along the arc-shaped channel 144 towards the switch 142. The switch 142 has a ramped portion on an underside thereof. When the switch 142 is engaged, as the ratchet 140 is dragged towards the switch the second arm 148 of the ratchet abuts the ramped portion of the switch 142. As the ratchet 140 is dragged further towards the switch 142, the ramped portion causes the second arm 148 to be deflected towards the first arm 146, such that the ratchet teeth engage with the teeth 122 of the ring 106, preventing further rotation of the ring 106 in the second direction.

Thus, when the switch 142 is engaged, only a small amount of reverse rotation can be applied to the ring 106, allowing the user to overcome small obstructions in the mechanism.

If the user encounters a larger obstruction, the user can disengage the switch 142. When the switch 142 is disengaged, the ramped portion is directed away from the path of the ratchet 140, such that the second arm 148 of the ratchet 140 does not abut the ramped portion of the switch 142 when the ring 106 is rotated in the second direction, allowing free rotation of the ring 106.

Alternatively, a ratchet mechanism can be provided in the waste sealing mechanism 500, as will be described in more detail below.

Figure 6A:
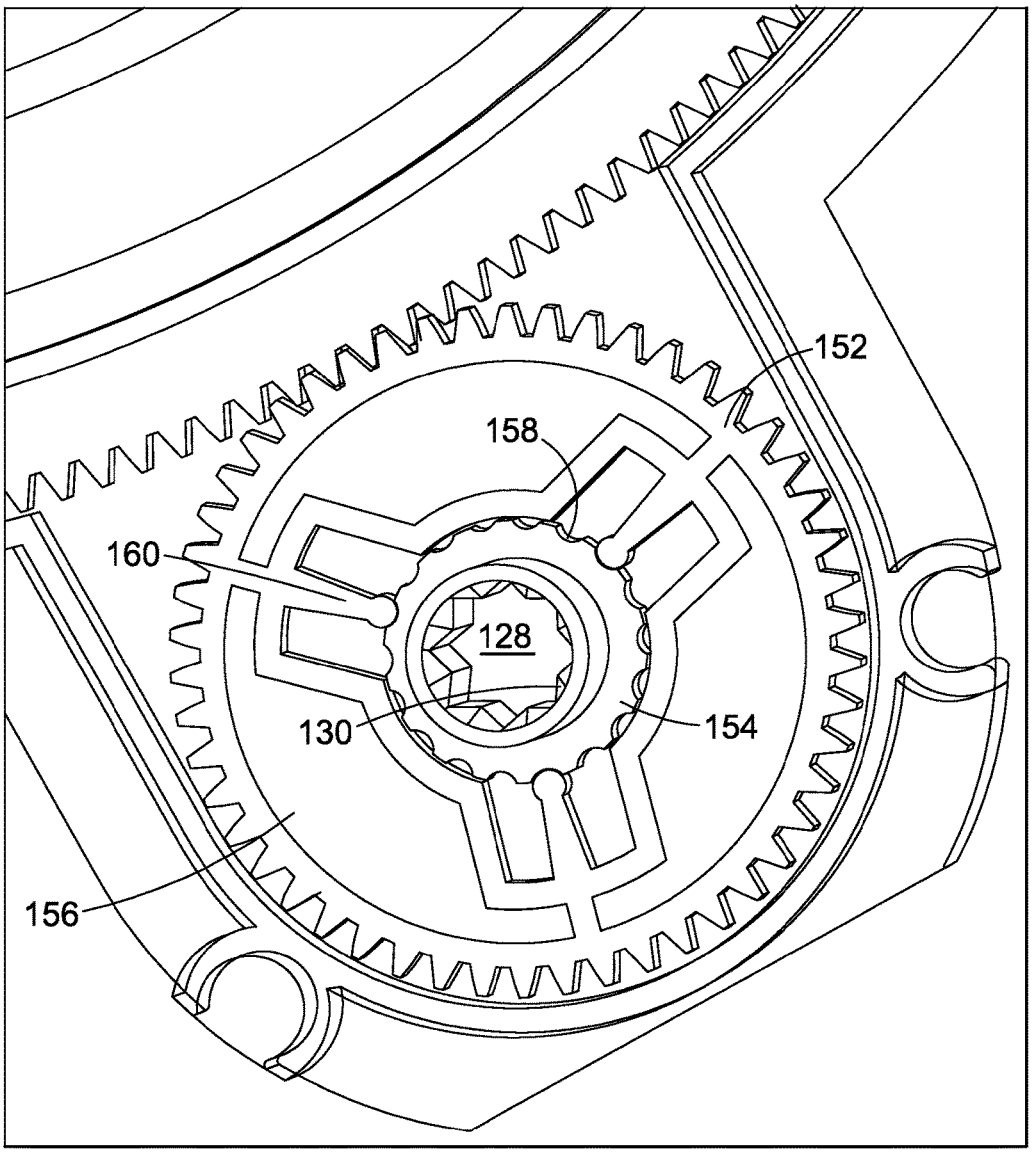
FIG. 6A is a perspective view of a slip device.

The spur gear 126 may alternatively comprise a slip device 152 as shown in FIG. 6A. The slip device 152 prevents excessive torque being applied to the waste sealing mechanism 500, for example if the waste sealing mechanism 500 is locked or jammed.

The slip device 152 comprises an inner spur gear 154 and an outer slip gear 156. The outer slip gear 156 comprises an aperture therethrough in which the inner spur gear 154 is provided, so that the inner spur gear 154 and the outer slip gear 156 are concentric with and in the same plane as one another. The inner spur gear 154 comprises the hole 128 which receives and engages a drive shaft 538 via inner teeth 130, as described above in relation to the spur gear 126. The outer teeth 124 described above that cooperate with the ring teeth 122 are provided around the outer circumference of the outer slip gear 156.

A plurality of rounded teeth 158 are provided around the outer circumference of the inner spur gear 154. The outer slip gear 156 comprises one or more flexible arms 160, which depend radially inwardly from the outer slip gear 156. A free end of the flexible arm 160 is received between two of the rounded teeth 158 on the inner spur gear 154, such that rotation of the outer slip gear 156 causes rotation of the inner spur gear 154. However, when an excessive torque is applied to the outer slip gear 156, the flexible arms 160 will flex, and slip over one or more of the rounded teeth 158. Hence excessive torque will not be transferred through the slip device 152 to the drive shaft 538.

The amount of torque that causes the flexible arms 160 to slip over the rounded teeth 158 can be adjusted in a number of ways as desired, including changing the number of flexible arms 160 that engage with the rounded teeth 158; changing the stiffness of the flexible arms, by suitable choice of material or dimensions of the flexible arms 160; or altering the depth or shape of the rounded teeth 158, so that the amount of flexing of the flexible arms 160 required to caused slipping is lessened or increased, as required.

Top Section

Figure 7:
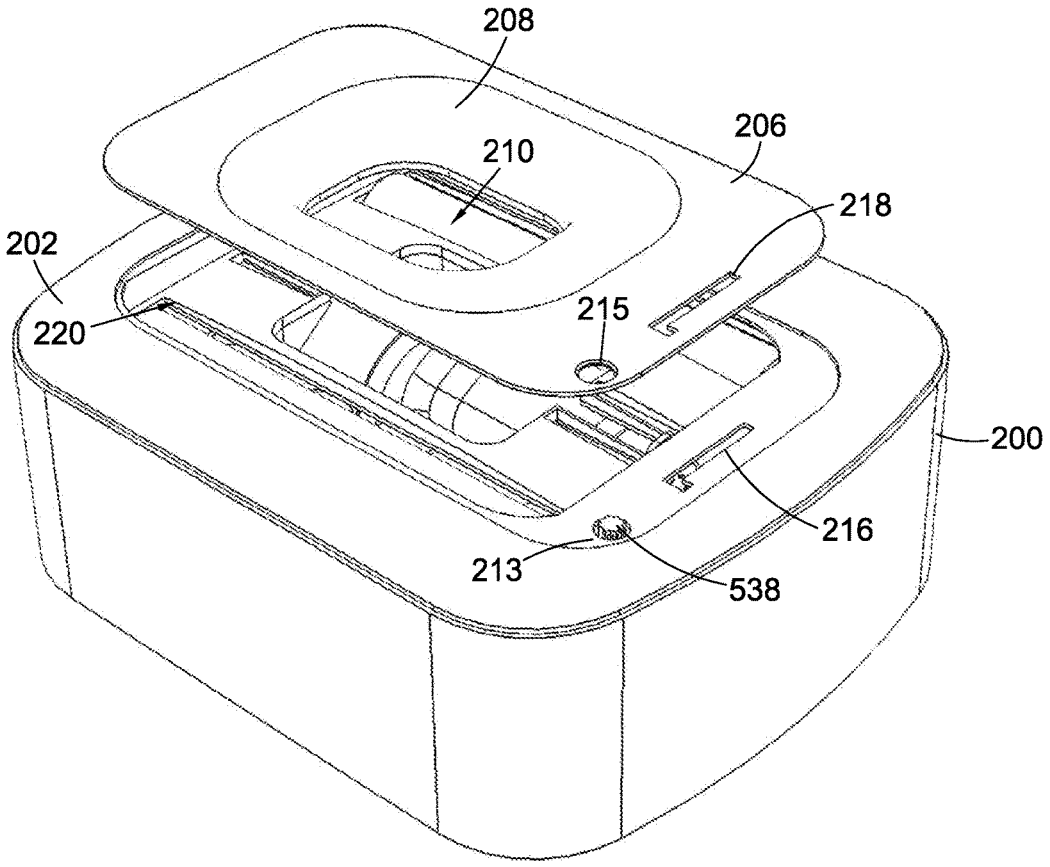
FIG. 7 is a perspective view of a top section of the waste disposal device.

Turning now to FIG. 7, the upper face 202 of the top section 200 of the waste disposal device 1 has an aperture 220 in which a removable insert 206 is provided. The removable insert 206 comprises a funnel portion 208 and an aperture 210 through which waste can be inserted into the device.

The upper face 202 and the removable insert 206 each comprise a respective hole 213, 215 through which the drive shaft 538 extends. The upper face 202 and the removable insert 206 each further comprise a respective slot 216, 218 through which a locking plate 132 of the lid 100 extends. The drive mechanism and locking mechanism will each be explained in more detail below.

Figure 8:
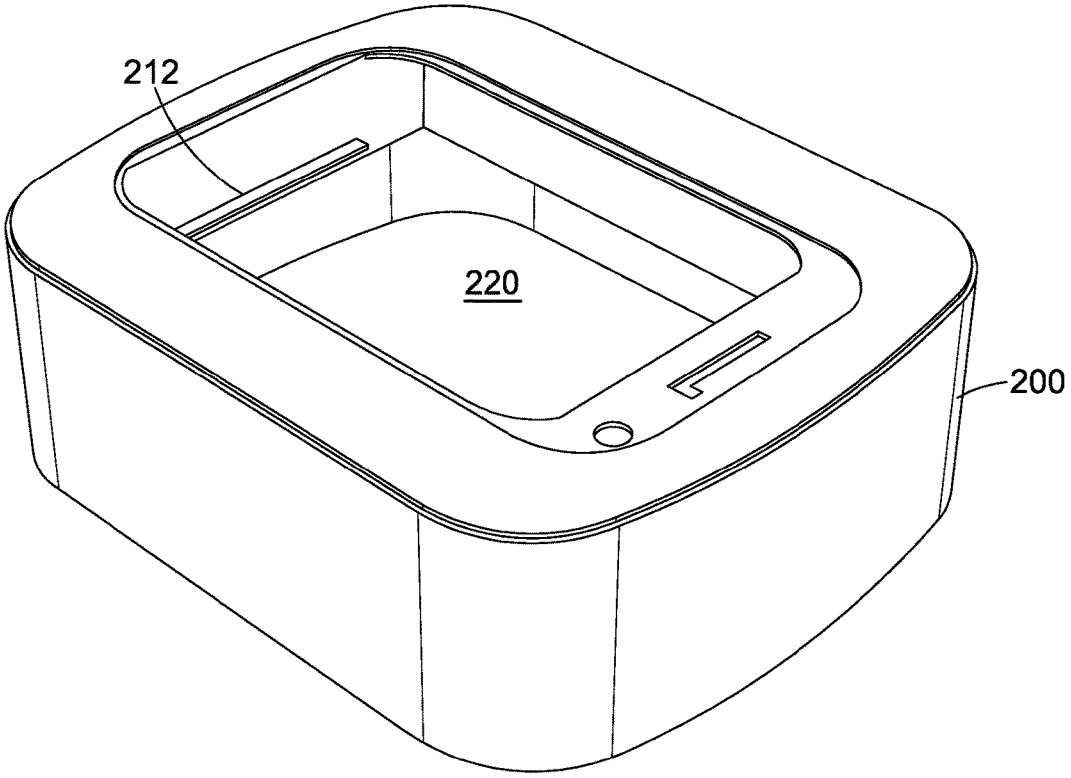
FIG. 8 is a perspective view of a cover of the top section of the waste disposal device.
Figure 9:
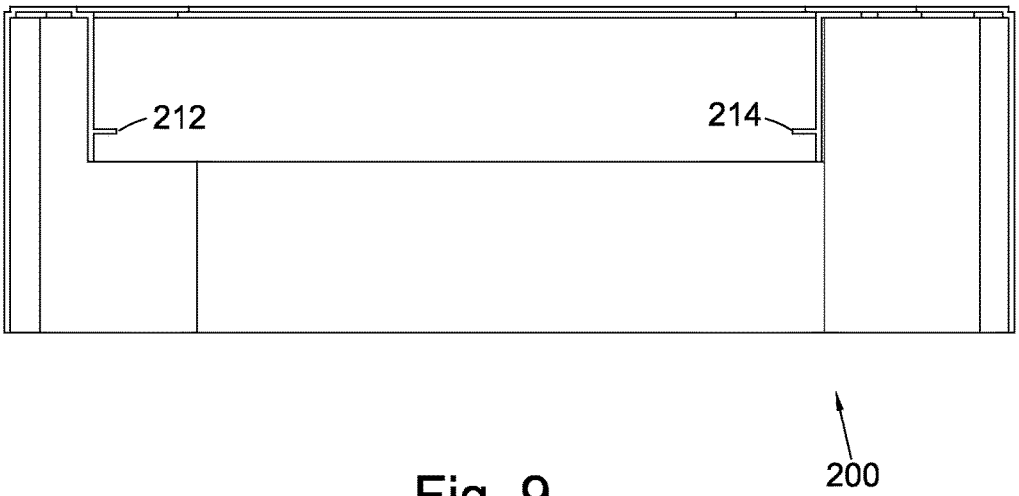
FIG. 9 is a cross-sectional view of the cover of the top section of the waste disposal device.

As best shown in FIG. 8, the top section 200 comprises a first shelf 212 on an inner surface of the wall 204. A second shelf 214 is provided on the inner surface of the wall 204 substantially opposite the first shelf 212, as shown in FIG. 9. The first 212 and second 214 shelves can support a replaceable cassette 400.

Cassette

Figure 10:
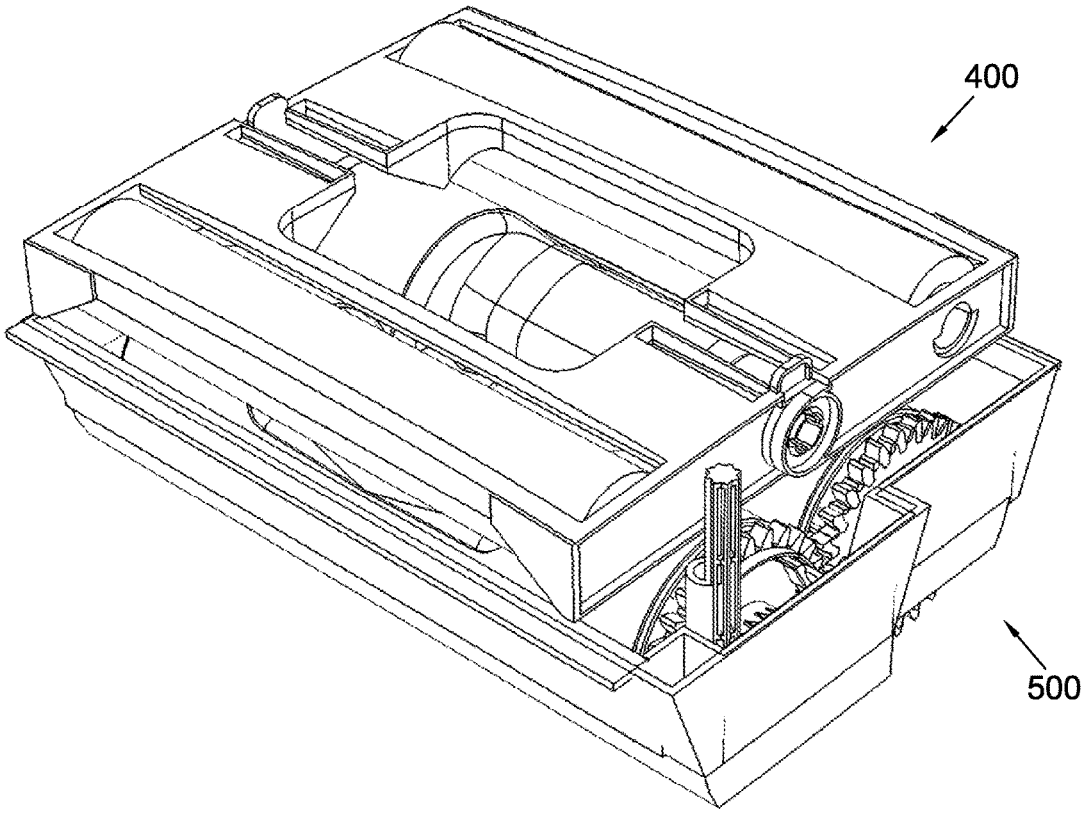
FIG. 10 is a perspective view of a replaceable cassette and a waste sealing system of the top section of the waste disposal device.

FIG. 10 shows a replaceable cassette 400 and a waste sealing system 500, which are provided within the top section 200 (not shown). The replaceable cassette 400 will now be described in detail with reference to FIGS. 11 to 23.

Figure 11:
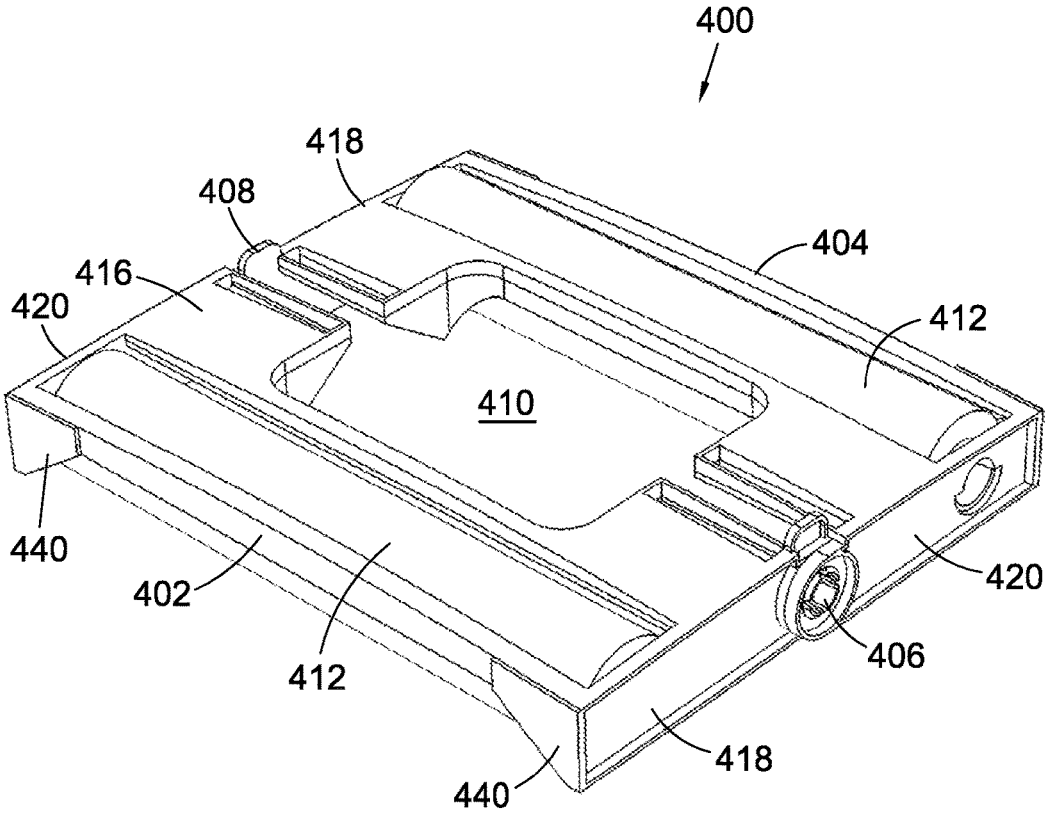
FIG. 11 is a perspective view of the cassette shown in FIG. 10.

As shown in FIG. 11, the replaceable cassette 400 comprises two substantially identical sections 402, 404 pivotally attached to one another via hinges 406, 408. Where the following description refers to one section, it will be understood that the other section comprises substantially identical features, according to an embodiment.

Section 402 comprises a top face 416, a first side wall 418 and a second side wall 420. The first side wall 418 depends from a first edge of the top face 416 and the second side wall 420 depends from a second edge of the top face 416 opposite the first edge.

The first hinge 406 is provided in the first side wall 418 and the second hinge 408 is provided in the second side wall 420. The first hinge 406 comprises a circular clip that projects outwardly from the first side wall 418. The second hinge 408 comprises a corresponding circular aperture in the second side wall 420. During assembly, the clip of the first hinge 406 of the first section 402 is inserted through the aperture of the second hinge 408 of the second section 404, and the clip of the first hinge 406 of the second section 404 is inserted through the aperture of the second hinge 408 of the first section 402 to form the cassette 400.

Figure 12:
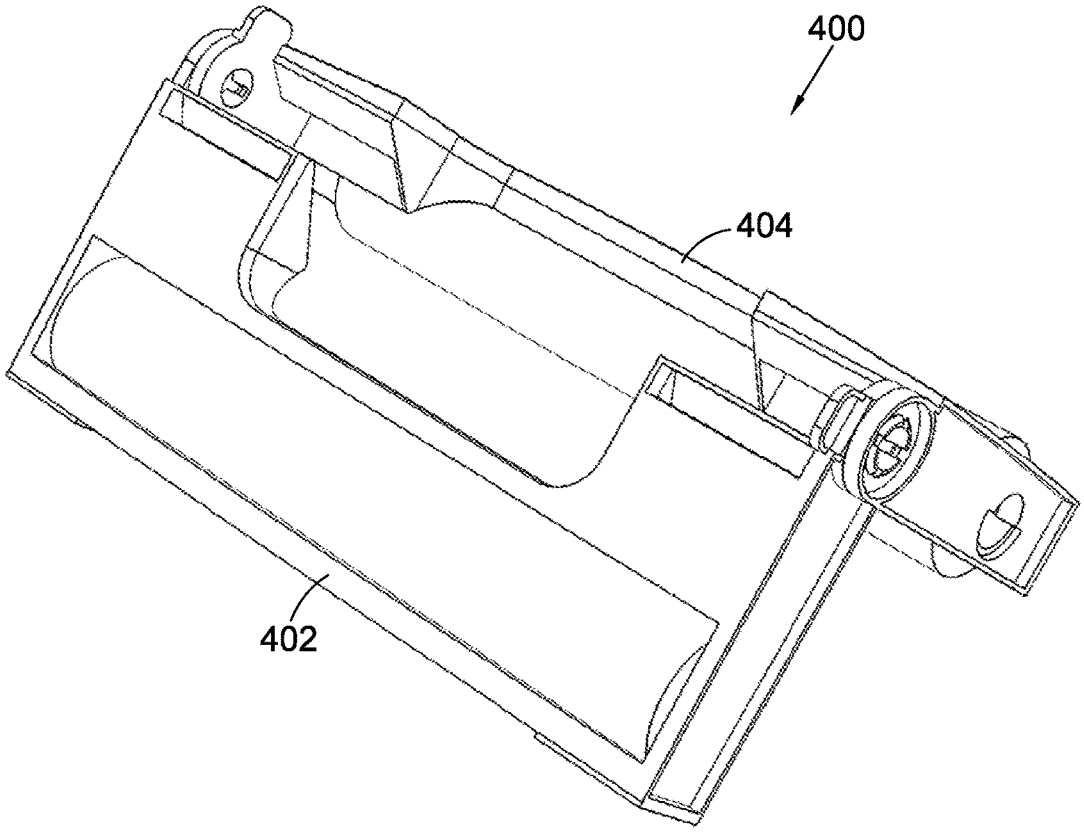
FIG. 12 is a perspective view of the cassette in a folded configuration.
Figure 13:
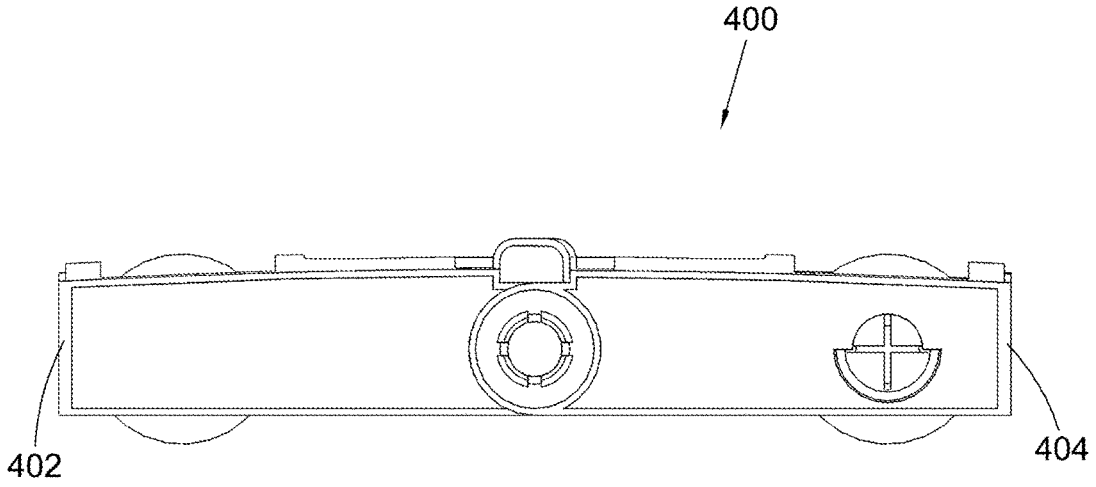
FIG. 13 is a side view of the cassette.
Figure 14:
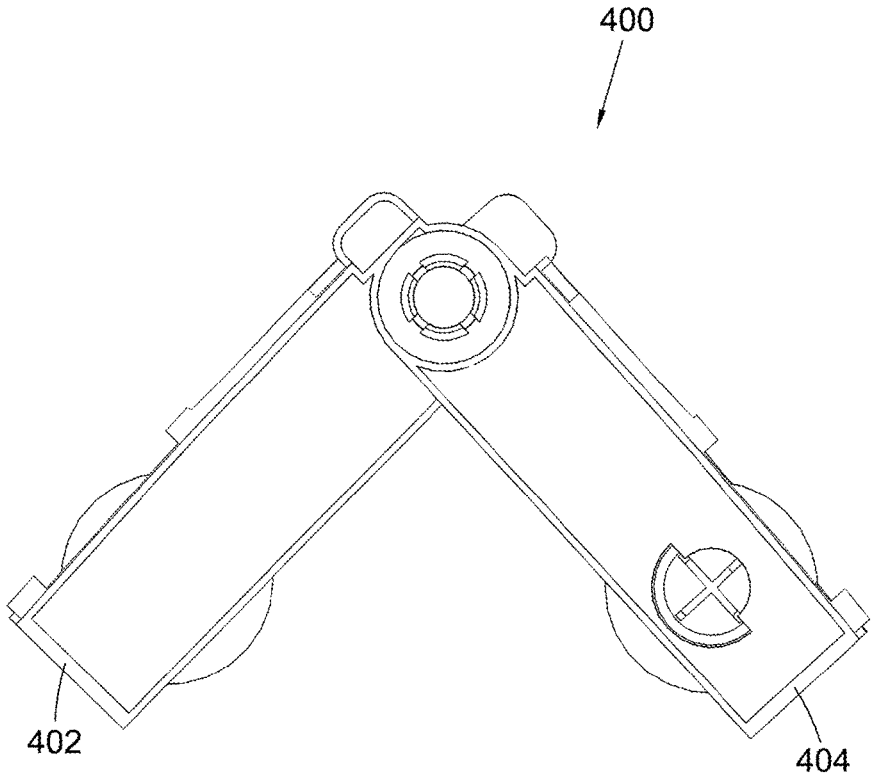
FIG. 14 is a side view of the cassette in a folded configuration.
Figure 17A:
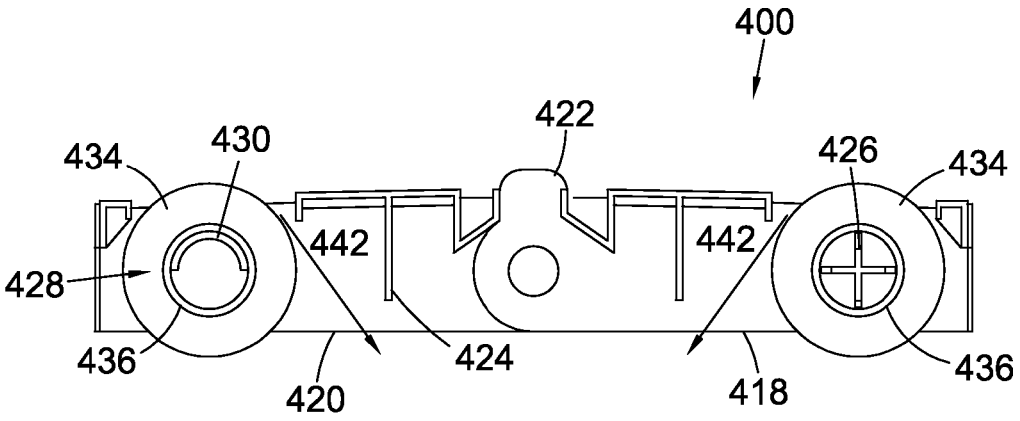
FIG. 17A is a cross-sectional view of the cassette along line A-A shown in FIG. 15.
Figure 17B:
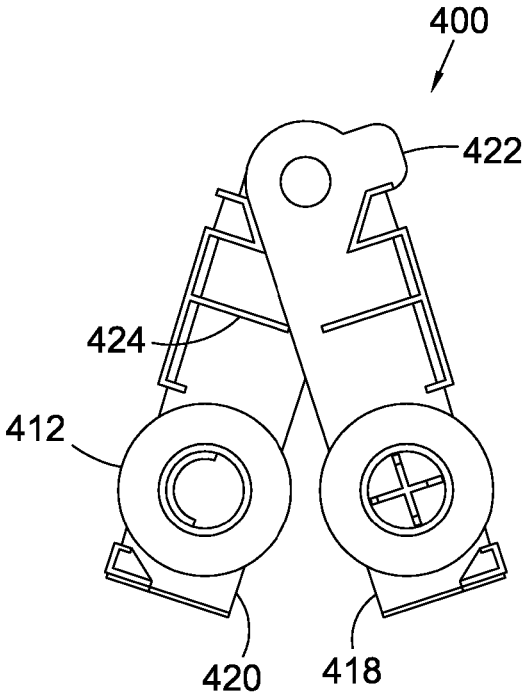
FIG. 17B is a cross-sectional view of the cassette along line A-A shown in FIG. 15 with the cassette in a folded configuration.

The first 406 and second 408 hinges of the first 402 and second 404 sections allow the first section 402 to rotate with respect to the second section 404 into the configuration shown in FIG. 12. FIGS. 17A and 17B are cross-sectional views of the cassette in an unfolded and a folded configuration, respectively, through the line A-A shown in FIG. 15. FIGS. 17A and 17B show the interior face of the side walls 418 and 420 of the first 402 and second 404 sections.

As best seen in FIG. 17B, the first side wall 418 includes a first abutment 422. When the cassette is in the unfolded configuration shown in FIG. 17A, the first abutment 422 abuts a third edge of the top face 416 extending between the hinges 406 and 408 to prevent over-rotation of the first section 402 with respect to the second section 404 past the unfolded configuration.

As best seen in FIG. 17A, a second abutment 424 depends from the top face 416. When the cassette is in the fully folded configuration shown in FIG. 17B, the second abutment 424 abuts the lower edge of the first side wall 418 to prevent over-rotation of the first section 402 with respect to the second section 404 past the fully folded configuration.

As shown in FIG. 11, the top face 416 has a cut-out portion along the third edge such that, when attached to one another, the first 402 and second 404 sections define an aperture 410 through which waste is guided by the funnel portion 208 of the removable insert 206.

Figure 15:
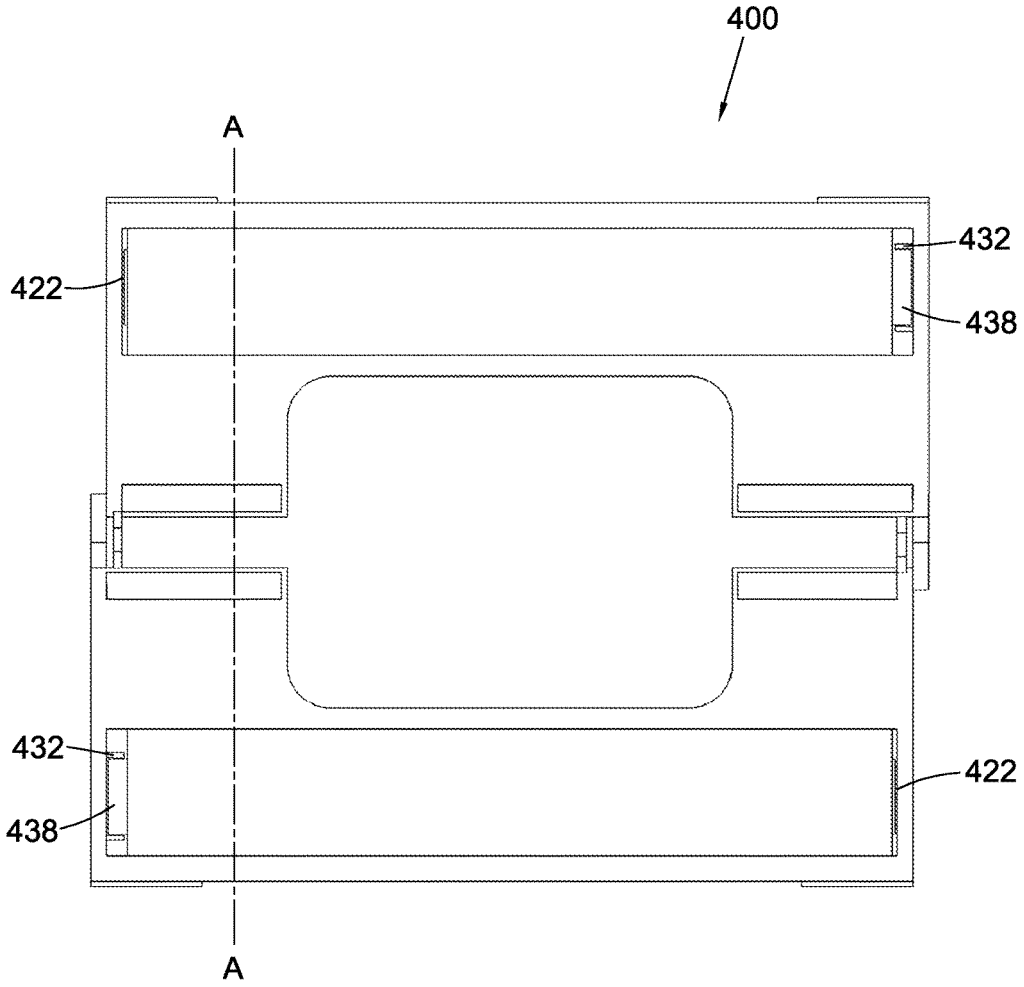
FIG. 15 is a top view of the cassette.
Figure 16:
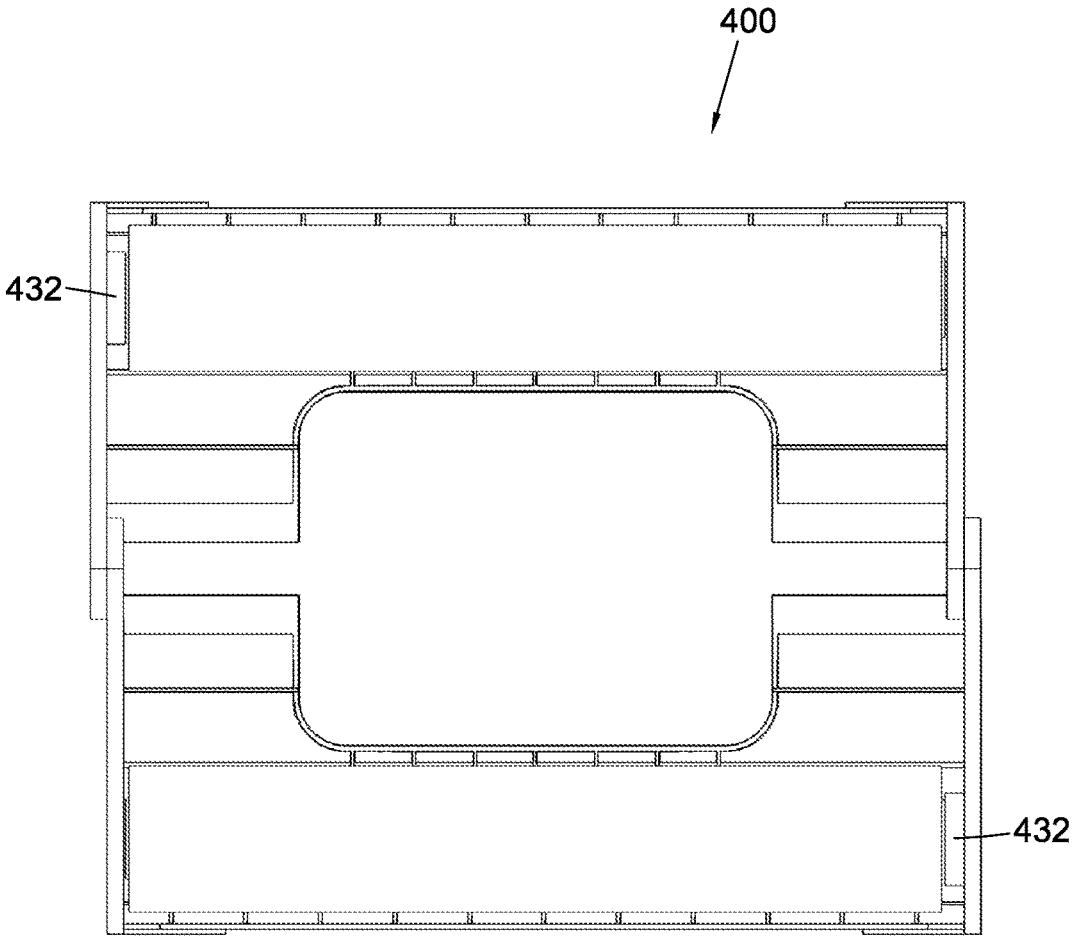
FIG. 16 is a bottom view of the cassette.

Each section 402, 404 holds a roll of film 412. The roll of film 412 is rotatably supported by supports 426 and 428 on the interior surface of the respective first 418 and second 420 side walls. Referring to FIG. 17A, the roll of film 412 comprises a length of film 434 wound around a tube 436. As shown in FIG. 15, the tube 436 comprises a projecting section 438 that projects past the edge of the wound film 434, along the (longitudinal) axial direction of the tube 436.

As shown in FIG. 17A, the first support 426 comprises a cross (+) shape projecting from the interior of the first side wall 418. The width of the cross is less than the interior diameter of the tube 436. The second support 428 comprises an inner portion 430, shown in FIG. 17A, and an outer portion 432, shown in FIGS. 15 and 16. The inner 430 and outer 432 portions project from the interior of the second side wall 420 and are semi-circular in cross section. The outer radius of the inner portion 430 is less than the inner radius of the tube 436 and the inner radius of the outer portion 432 is greater than the outer radius of the tube 436. The inner portion 430 is provided diametrically opposite to the outer portion 432.

The first support 426 and the inner portion 430 of the second support 428 fit inside the ends of the tube 436 to support the roll of film 412. The outer portion 432 of the second support 428 fits over the projection portion 438 of the tube 436, thereby preventing improper assembly of the cassette 400 by inserting the roll of film 412 the wrong way round.

After assembly of the cassette 400, as shown in FIG. 11, tabs 440 depending from the ends of the first 418 and second 420 side walls are fixed to a fourth edge of the top face 416. The tabs 440 each comprise a projecting clip, and the fourth edge of the top face 416 comprises corresponding holes. The tabs 440 are fixed to the top face 416 by inserting the clips through the holes. The tabs 440 enhance the rigidity of the cassette 400. Before assembly of the cassette 400, the tabs 440 are not fixed to the top face 416. This allows the first 418 and second 420 side walls to flex outwardly away from the top face 416 so that a roll of film 412 can be installed on the first 426 and second 428 supports. After the roll of film 412 has been installed, the tabs 440 are fixed to the fourth edge of the top face 416, securing the roll of film 412 in the cassette 400.

The rigidity of the cassette is enhanced further by strengthening some of the structural parts. For example, the top face 416 and/or the wall depending from the fourth edge of the top face 416 may have a slight curvature such that they are slightly domed. The slight curvature adds rigidity to the cassette sections 402 and 404.

The roll of film 412 is oriented in the cassette 400 such that film 434 comes off the roll 412 from the area of the roll proximal to the top face 416 in a direction towards the third edge of the top face 416 as shown by the arrows 442 in FIG. 17A.

The outer surface of the film 434 on each roll comprises an adhesive such that when the outer surface of the film 434 of the first roll 412 is pressed against the outer surface of the film 434 of the second roll 414 the films adhere together.

Alternatively, the roll of film 412 may be oriented in the cassette 400 such that film 434 comes off the roll 412 from the area of the roll distal from the top face 416 in a direction towards the third edge of the top face 416. In this configuration, the inner surface of the film 434 on each roll comprises the adhesive instead of the outer surface. This arrangement allows the rolls to be packaged without the film adhering to the wrong surfaces.

During (or just after) assembly of the cassette 400, the end of the film 434 of the roll 412 of the first section 402 may be adhered to the end of the film 434 of the roll 412 of the second section 404. Thus, when the cassette 400 is in use in a waste disposal device 1, as described further below, when waste is inserted through the aperture 410, the waste contacts the film 434 and draws the film 434 from the rolls 412.

When a roll of film 434 becomes depleted, a user may wish to replace the cassette 400 of the waste disposal device 1. As will now be described with reference to FIGS. 18 to 23, the folding action of the cassette 400 described above allows the cassette 400 of the waste disposal device 1 to be removed and replaced.

The steps for inserting a cassette 400 into the waste disposal device 1 will be described. However, it will be apparent to the reader that substantially the same steps apply in reverse for the removal of a cassette 400 from the waste disposal device 1.

Figure 18:
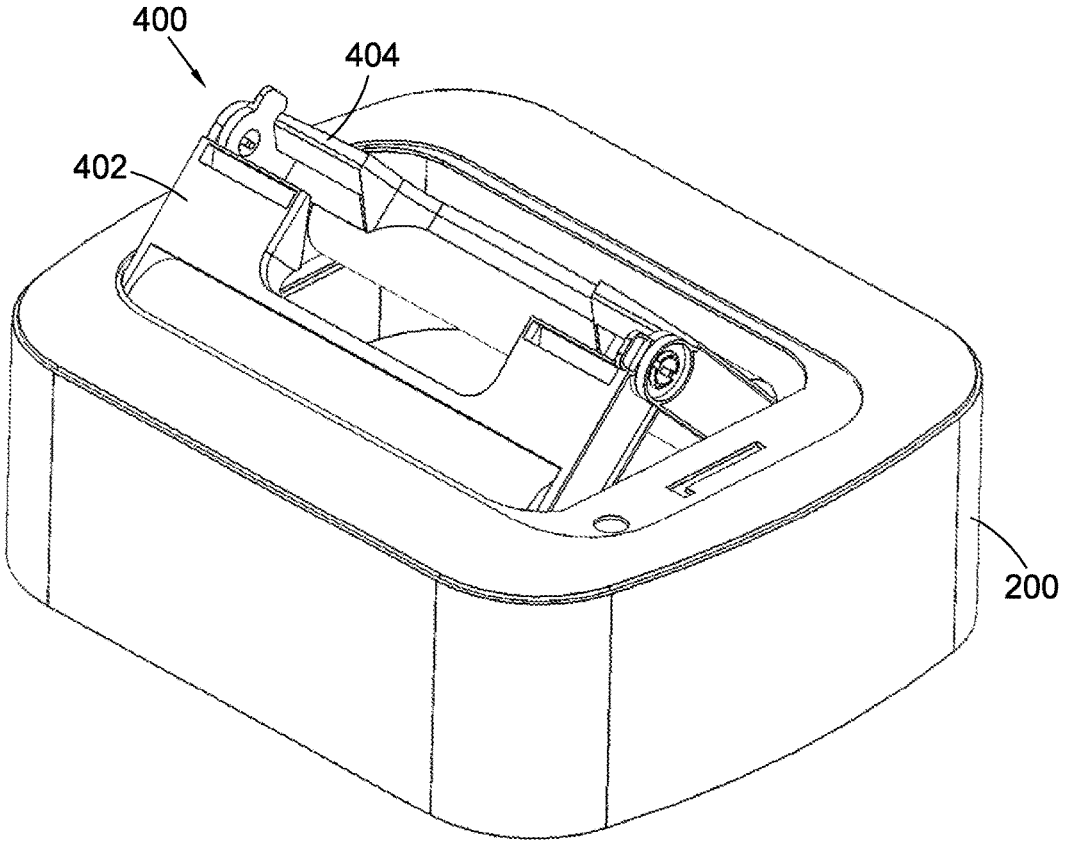
FIG. 18 is a first perspective view of the cassette being inserted into the top section of the waste disposal device.
Figure 19:
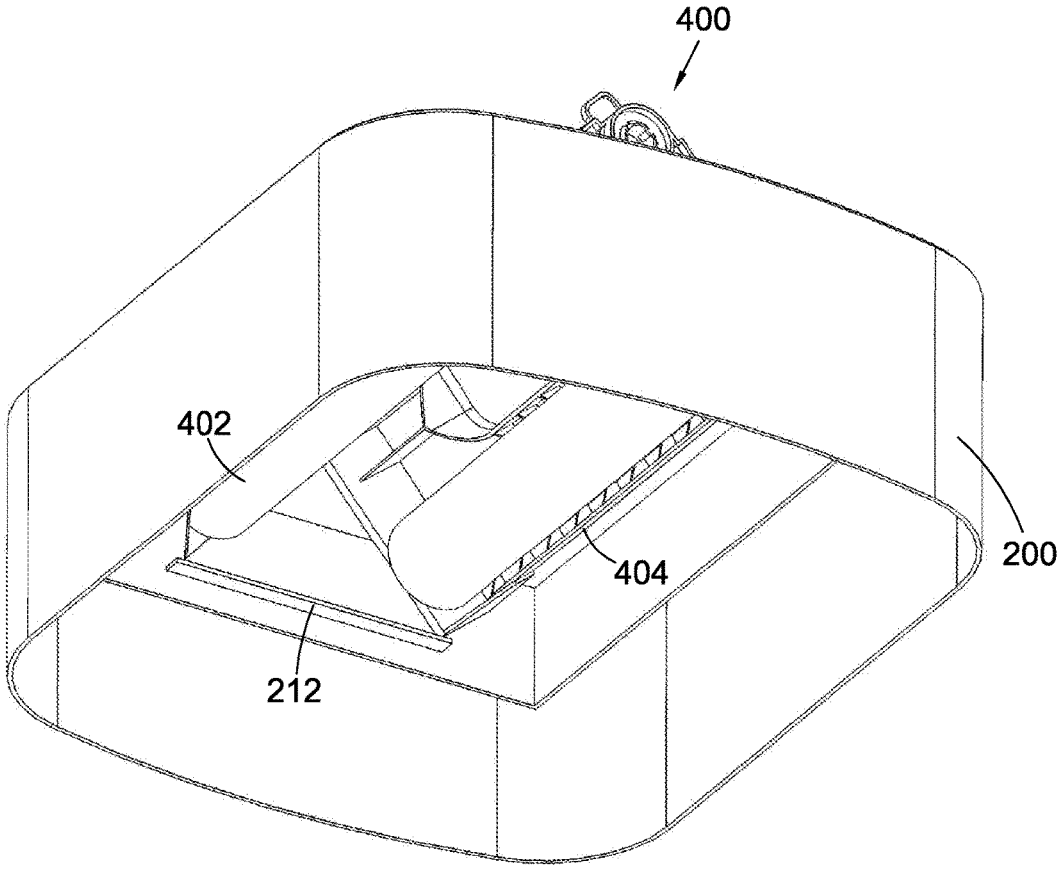
FIG. 19 is a second perspective view of the cassette being inserted into the top section of the waste disposal device.

To insert a cassette 400 into the waste disposal device 1, firstly the lid 100 is opened and the removable insert 206 is removed, exposing the aperture 220 in the face 202 of the top section 200. The relative dimensions of the aperture 220 and the cassette 400 in its folded configuration are such that the cassette 400 can be inserted through the aperture 220 as shown in FIG. 18. As shown in FIG. 19, when the cassette 400 is inserted through the aperture 220, the lower edges of the first 418 and second 420 side walls abut the first 212 and second 214 shelves of the top section 200.

Figure 20:
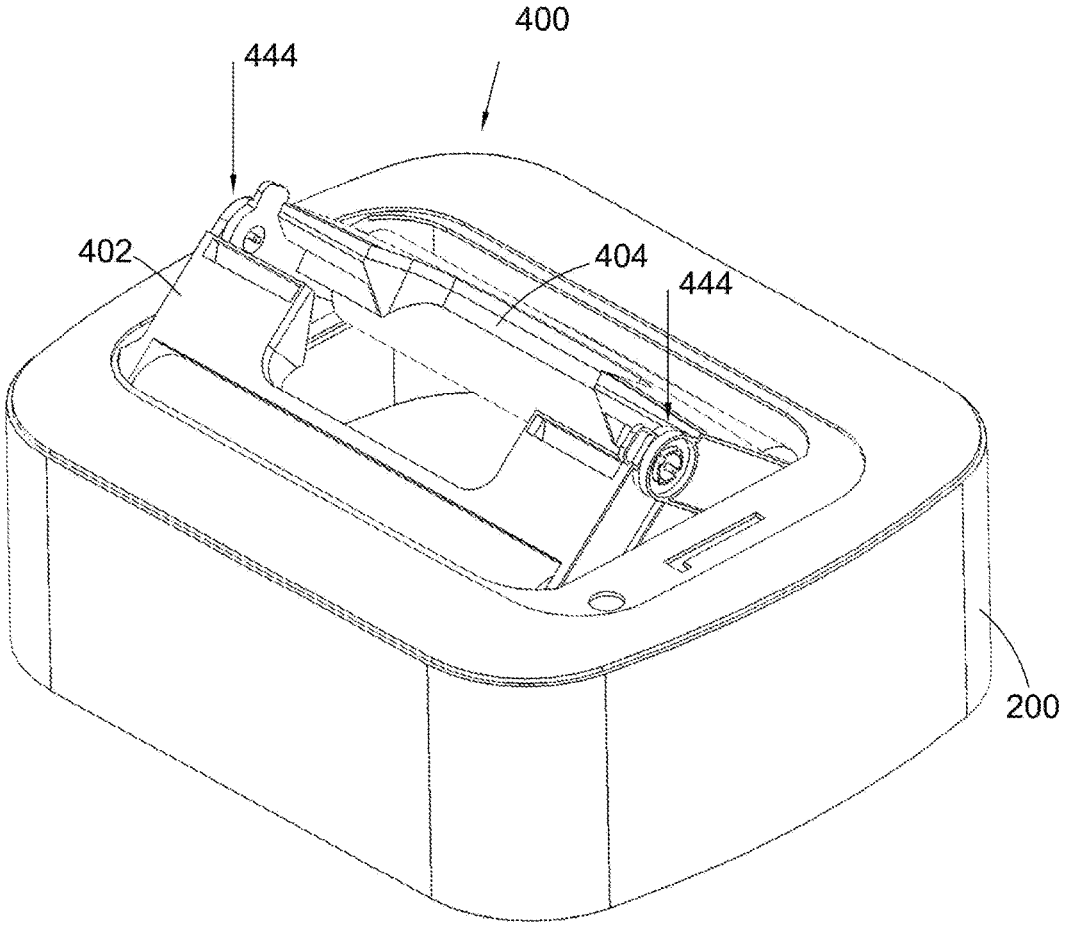
FIG. 20 is a first perspective view of the cassette unfolding in the top section of the waste disposal device.
Figure 21:
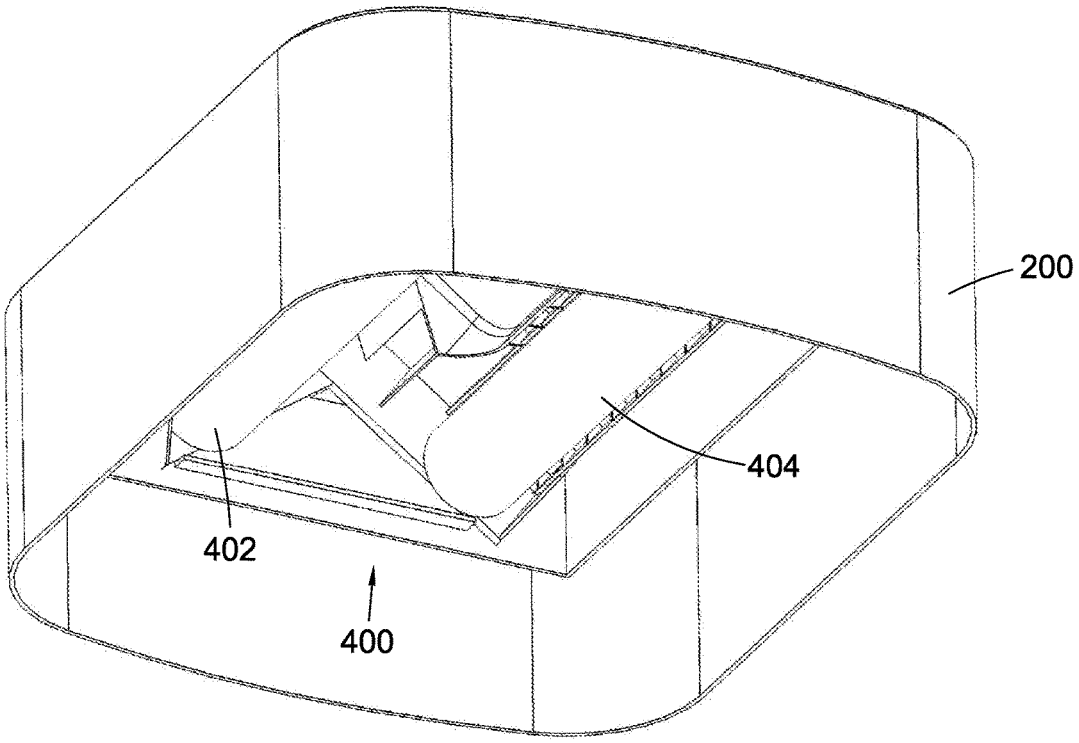
FIG. 21 is a second perspective view of the cassette unfolding in the top section of the waste disposal device.
Figure 22:
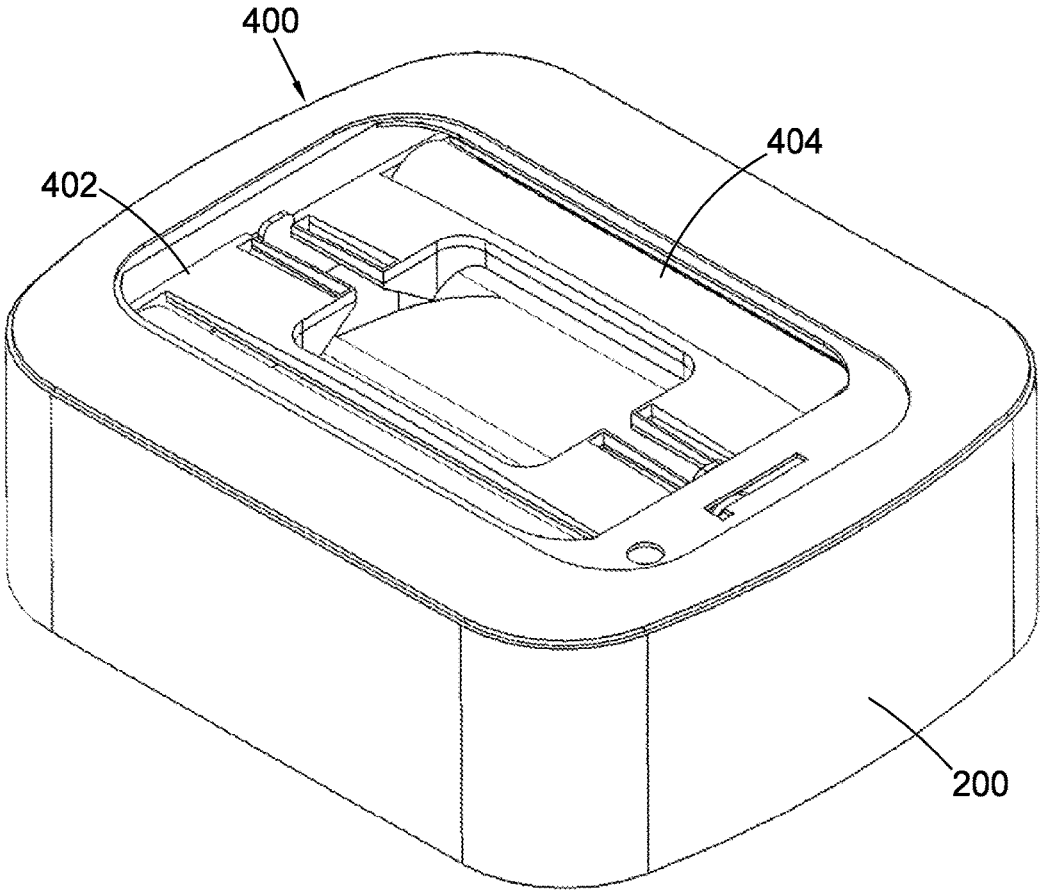
FIG. 22 is a first perspective view of the cassette in situ in the top section of the waste disposal device.

Downward pressure is then applied by the user on the upper part of the first 406 and second 408 hinges of the cassette 400 as shown by arrows 444 to unfold the cassette as shown in FIG. 20. As shown in FIG. 21, this causes the lower edges of the first 418 and second 420 side walls to slide laterally along the first 212 and second 214 shelves, until the cassette 400 reaches the unfolded configuration shown in FIGS. 22 and 23.

Figure 23:
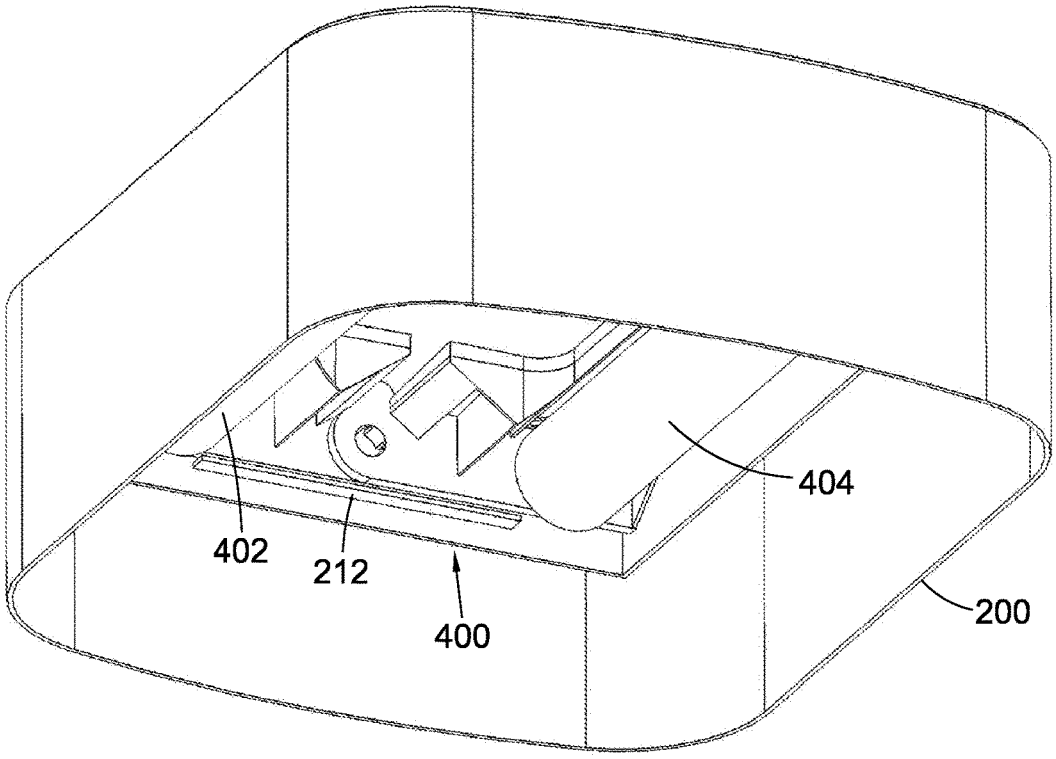
FIG. 23 is a second perspective view of the cassette in situ in the top section of the waste disposal device.

As shown in FIG. 23, when the cassette 400 is inserted into the waste disposal device 1, the cassette 400 is supported by the first 212 and second 214 shelves of the top section 200.

To remove the cassette 400, a user may pull the cassette 400 upwards using the abutments 422, causing the cassette 400 to fold under its own weight into the folded configuration such that it can be removed through the aperture 220.

Figure 42:
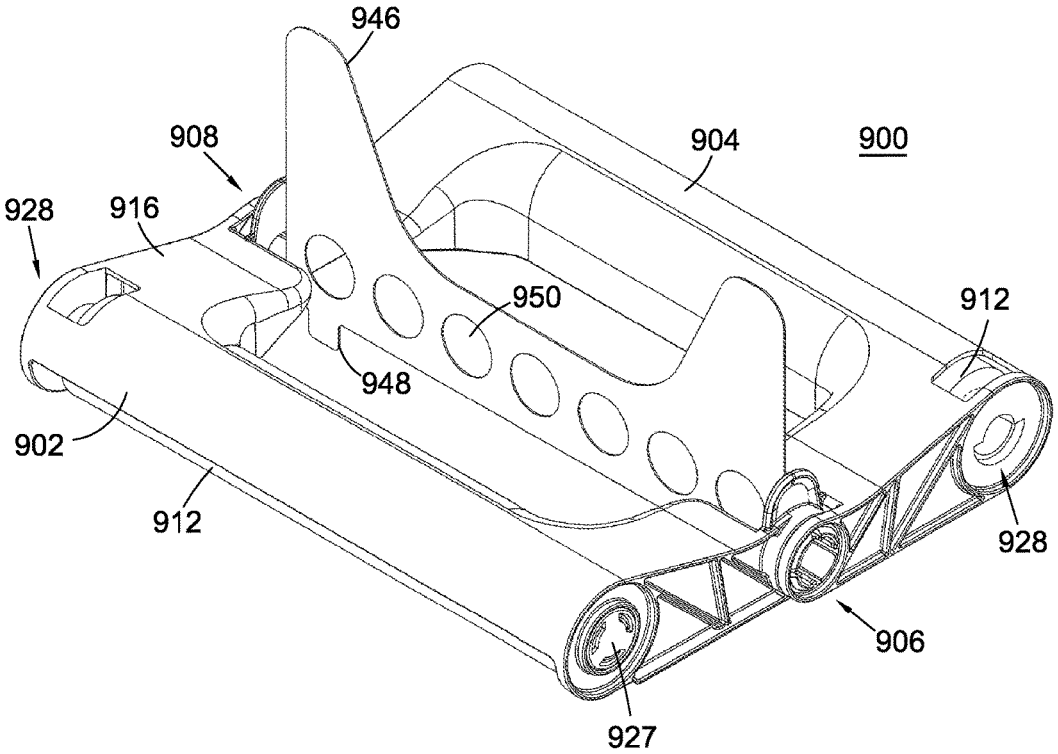
FIG. 42 is an upper perspective view of an alternative cassette.
Figure 43:
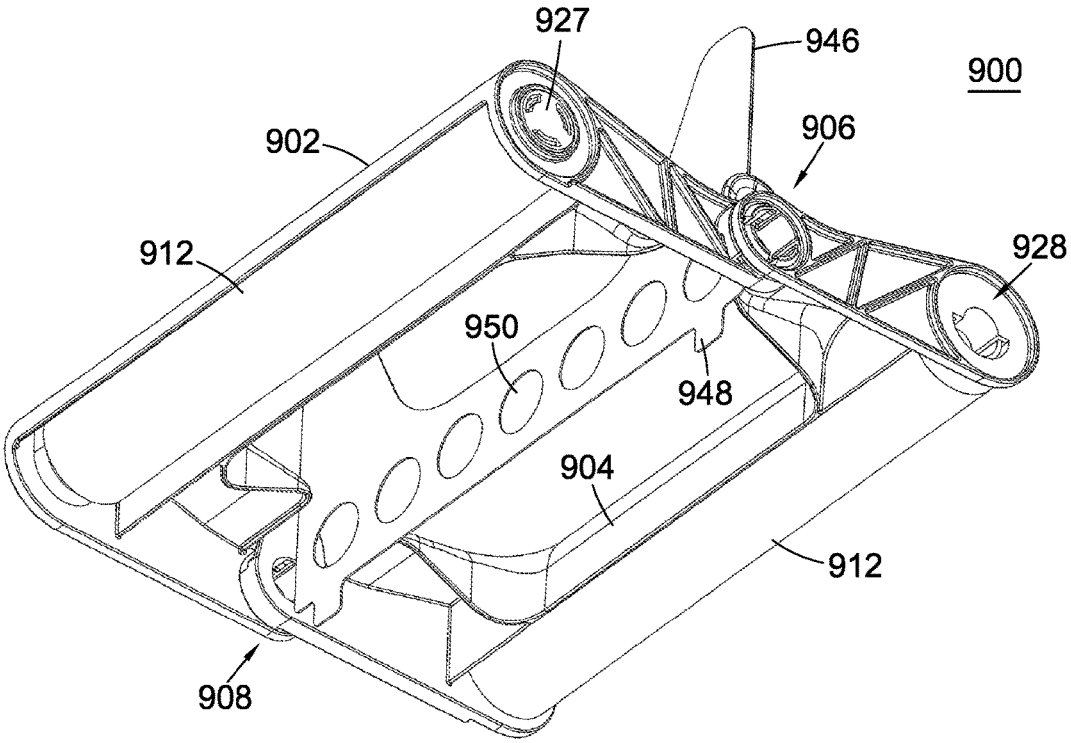
FIG. 43 is a lower perspective view of an alternative cassette.

An alternative cassette 900 is shown in FIGS. 42 and 43. The alternative cassette 900 operates in a similar manner to the cassette 400 described above. The alternative cassette 900 differs from the cassette 400 in that the top face 916 is concavely curved to encompass the rolls of film 912. The curved top face 916 improves the strength and rigidity of the cassette 900, is simple to manufacture and is easier for users to install into a waste disposal device.

The alternative cassette 900 has second supports 928 for supporting an end of a roll of film. Each of the second supports 928 comprises a semi-circular inner portion and a semi-circular outer portion, similar to the second supports 428 of the cassette 400 described above.

In place of the cross-shaped first supports 426 of the cassette 400, the alternative cassette 900 comprises holes 926 which receive core locks 927.

To assemble the alternative cassette 900 with a roll of film 412, a first end of the tube 438 of the roll of film 412 is placed onto the second support 928. As described above, the first end of the tube 436 comprises a projecting section 438, which ensures that the roll of film 412 can only be installed into the cassette 900 in the correct orientation. The roll of film 412 is then aligned within the cassette 900 such that the second end of the tube 436 is approximately concentric with the hole 926 of the cassette 900. Finally, a core lock 927 is received through the hole 926 of the cassette 900 and into the tube 436 of the roll of film 412, thereby securing the roll of film 412 within the cassette 900.

The above-described assembly method allows the use of a rigid and structurally secure frame in the cassette 900, since the cassette frame does not need to be deformed in order to install rolls of film into the cassette 900.

Further alternative cassettes may replace the mechanical hinges 406, 408 or 906, 908 of the above embodiments with alternative movable components. For example, a live hinge, comprising a thin, flexible plastic bridge between and integral with the two substantially identical sections of the cassette (either 402, 404 or 902, 904). Such a hinge has the added advantage that the whole cassette may be moulded as a single plastic component, reducing assembly time, and may have the further advantage that the cassette can be moulded with an innate desire to flex or unflex (for example, biased towards the folded or the unfolded configuration) during the installation of the cassette into the waste storage device.

The alternative cassette 900 optionally comprises a leader card 946 projecting vertically through the centre of the cassette 900 (in the orientation shown in FIG. 42) and between the two substantially identical sections 902, 904. The leader card 946 is substantially planar and extends between the first and second hinges 906, 908 of the cassette 900. An end of each of the rolls of film 912 is affixed to opposing faces of the leader card 946 along the edge which contains tabs 948.

The cassette 900 is installed into a waste disposal device in the same way as cassette 400. After the cassette 900 has been inserted into a waste disposal device, the leader card 946 may be pushed into the waste sealing mechanism by a user, and then drawn through the waste sealing mechanism by the rollers 600, 602 by operating the waste sealing mechanism for one cycle. Holes 950 in the leader card 946 ensure that a secure adhesive join is made between the two rolls of film 912 as the leader card 946 passes through the rollers 600, the mechanism of which is described in more detail below. Thus the need for the user to join the ends of the rolls of film 912 together manually before first using the cassette 900 is avoided. Further, the leader card 946 ensures that the initial feeding operation seals the ends of the film 912 across their full width with minimal distortion so that the film 912 is in the optimal arrangement relative to the sealing mechanism and therefore ready to receive waste.

Further, it may be helpful to use the tabs 948 on the leading edge of the leader card 946 to locate into receiving features on the rollers thereby assisting the user to line up the film correctly relatively to the rollers 600, 602. Such receiving features may be depressions moulded into the surface of rollers 600, 602, similar to those described below for capturing liquid, albeit that the shape may be adapted to be more precisely compatible with the shape of the tabs 948.

It should be noted that, regardless of the cassette design 400 or 900, the rolls of film should be positioned along their respective cores such that as the strips of film are dispensed from each roll they will meet squarely, thereby ensuring maximum overlap and sealing with a minimum of lateral distortion.

For some material combinations of the film and the rollers, static build up might cause the leading edge of the film cling to one of the rollers and become wrapped around it instead of hanging down into the bottom section of the waste storage device. If this is a problem, the bottom section or the removable drawer may contain a suitable device, for example a hook or similar, for securing the leading edge of the film away from the rollers.

Waste Sealing Mechanism

The waste sealing mechanism 500 will now be described with reference to FIGS. 24 to 32.

The waste sealing mechanism 500 is housed in a frame 502. The frame 502 comprises first 504 and third 506 relatively short opposing side walls joined by second 508 and fourth 510 relatively long opposing side walls. FIG. 25 shows a cross-sectional view of the frame 502 and the top section 200 along the line B-B shown in FIG. 24.

Figure 24:
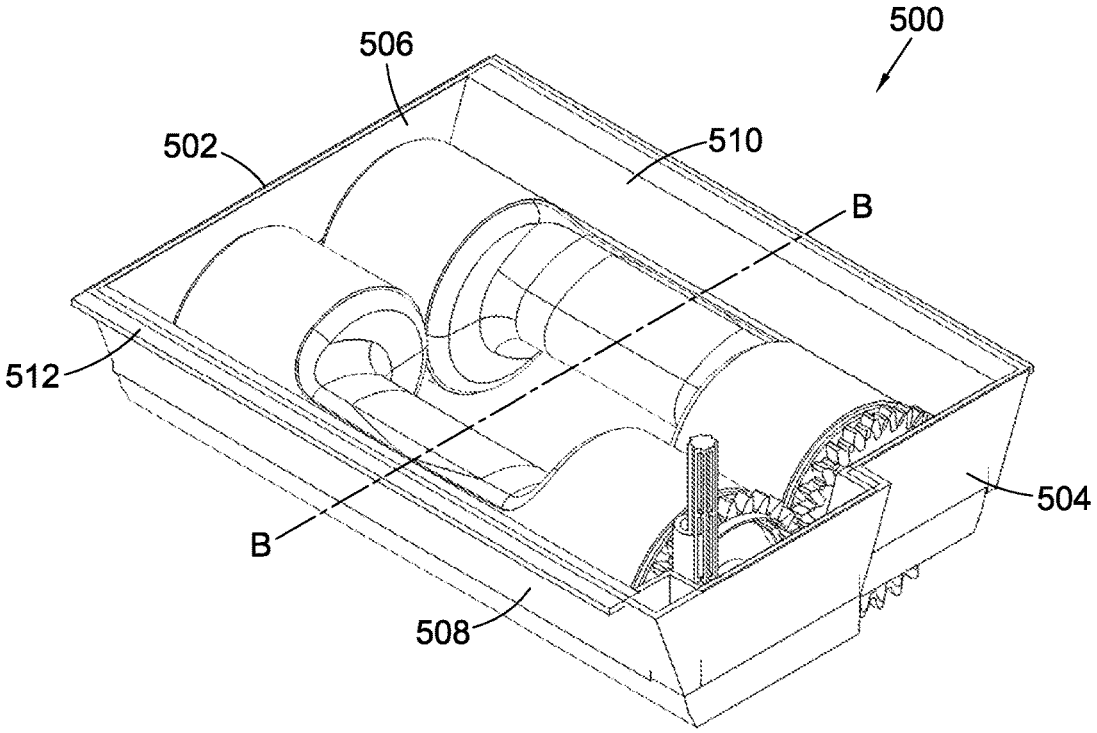
FIG. 24 is a perspective view of the waste sealing mechanism of the top section of the waste disposal device.
Figure 25:
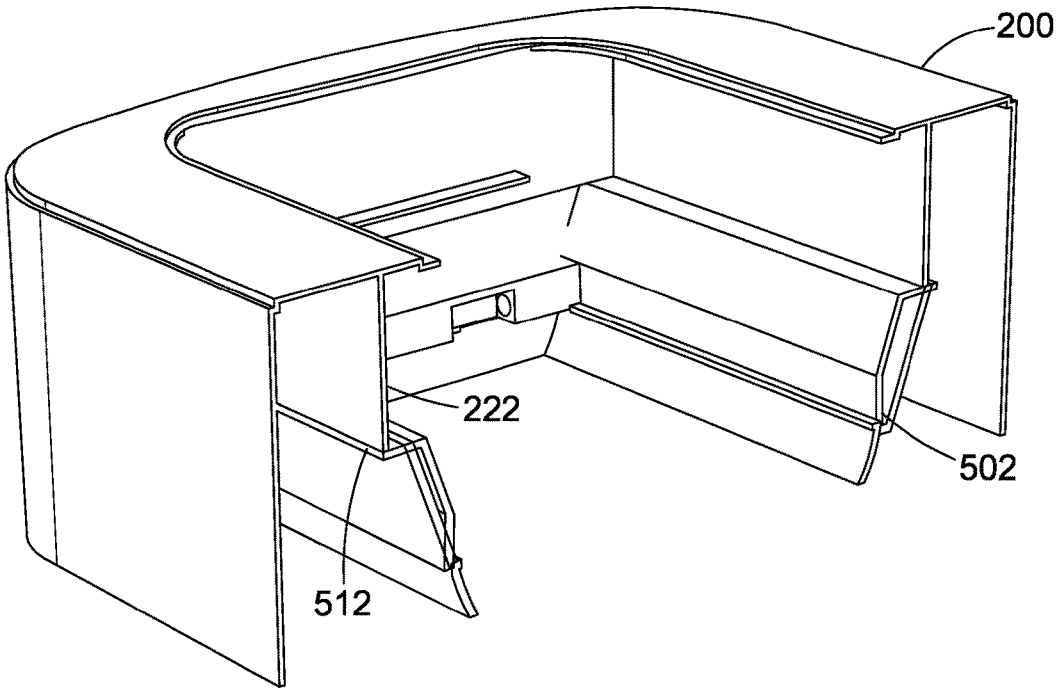
FIG. 25 is a perspective cross-sectional view of the cover of the top section of the waste disposal device.

As shown in FIG. 24, a flange 512 extends from the upper edges of the second 508 and fourth 510 side walls for securing the frame 502 to a wall 222 depending from the underside of the face 202 of the top section 200, as shown in FIG. 25.

Figure 25A:
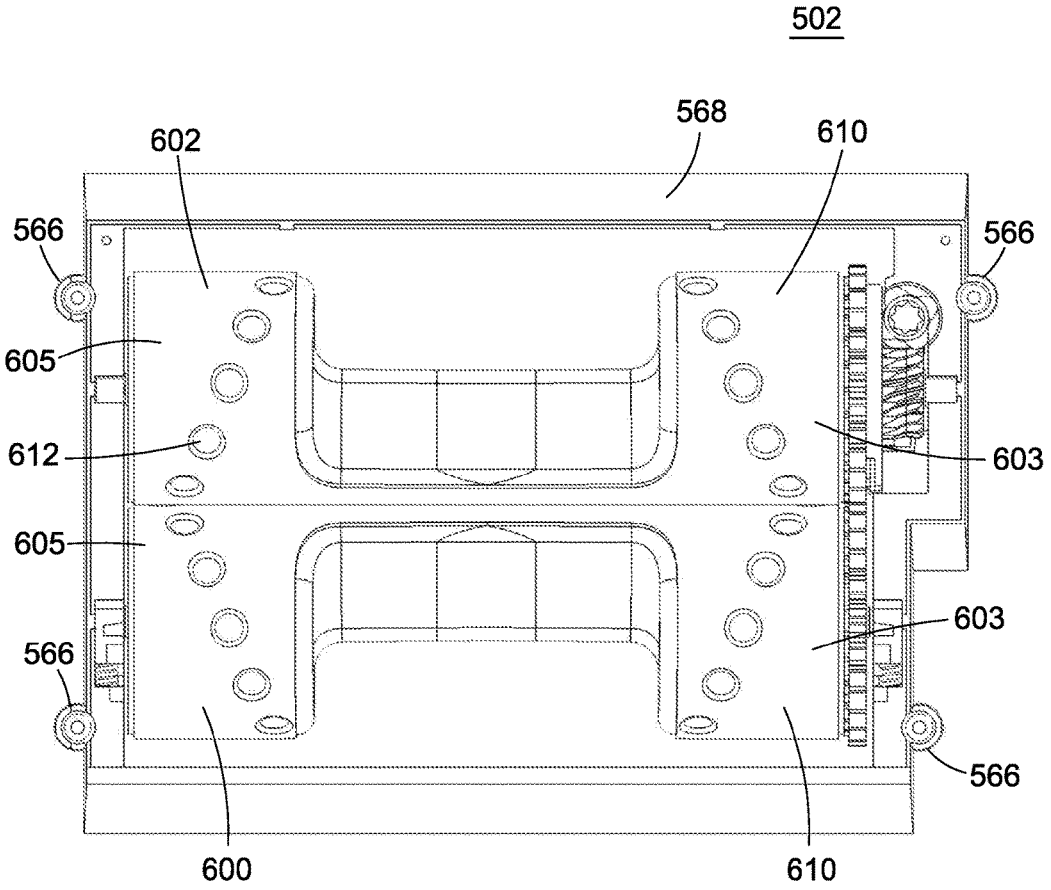
FIG. 25A is a bottom view of a first section of a frame.
Figure 25B:
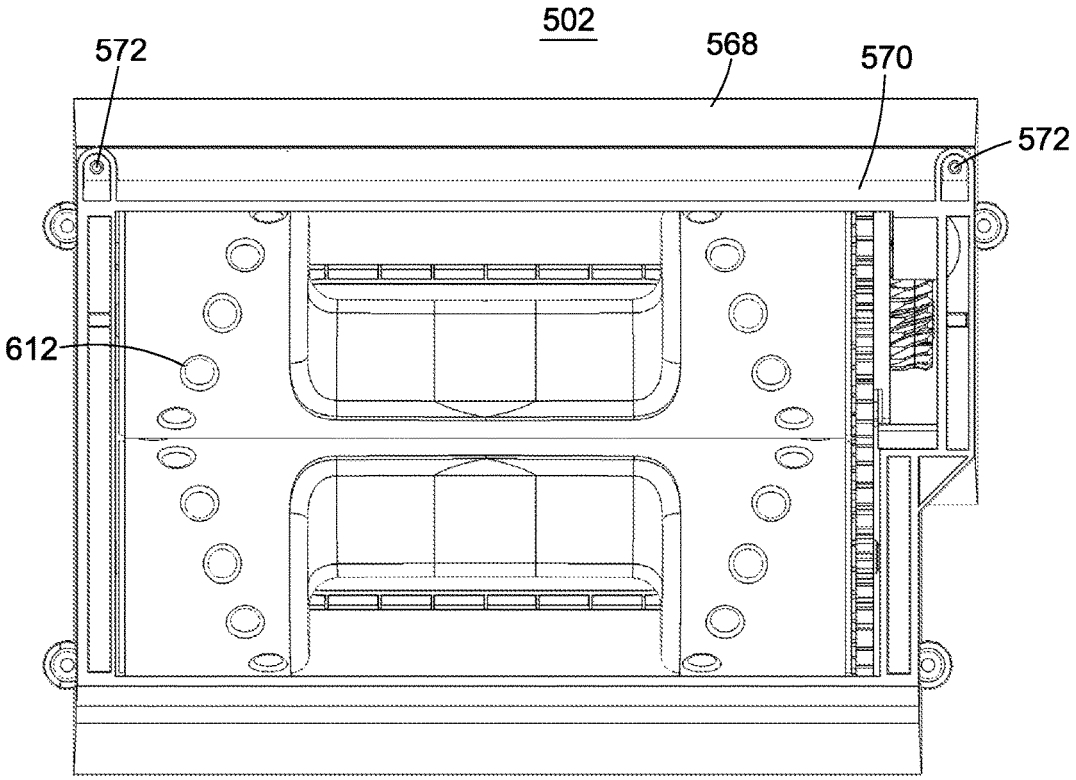
FIG. 25B is a bottom view of the first and a second section of the frame.

Alternatively, with reference to FIGS. 25A and 25B, the frame 502 comprises a first section 568 and a second section 570. Instead of the flange 512 described above, the first section 568 comprises posts 566 for fixing the frame to the underside of the upper face 202 of the top section 200 via screws, for example. The second section 570 attaches to the first section 568 via screws 572, as shown in FIG. 25B.

During assembly of this embodiment, the first section 568 of the frame 502 is laid upside-down and various components of the waste sealing mechanism described in detail below are installed into the first section 568, as shown in FIG. 25A. After the components of the waste sealing mechanism have been installed into the first section 568, the second section 570 is attached to the first section to secure the components of the waste sealing mechanism in place, as shown in FIG. 25B.

Finally the assembled frame 502 is attached to the upper face 202 of the top section 200 via the posts 566. Thus, in this embodiment, the frame 502 is not secured to the wall 222.

Figure 26A:
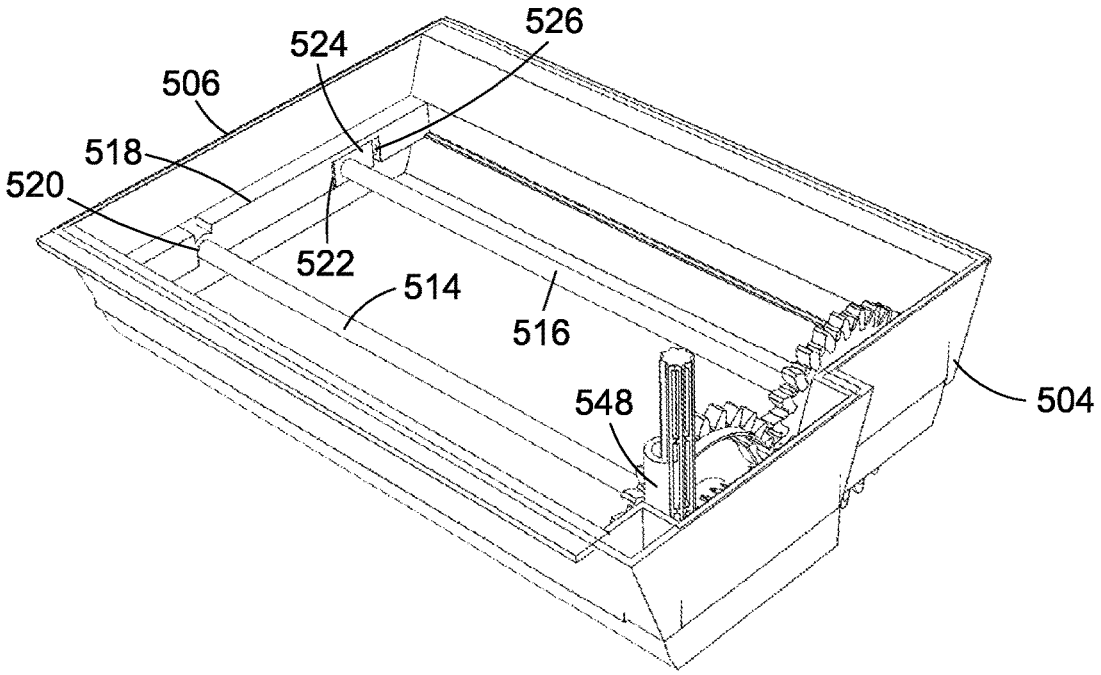
FIG. 26A is a first perspective view of the waste sealing mechanism with rollers not shown.

As shown in FIG. 26A, a driving axle 514 and a driven axle 516 are rotatably mounted between the first 504 and third 506 walls of the frame 502. The axles 514, 516 extend in a longitudinal direction, substantially parallel to the second 508 and fourth 510 side walls of the frame 502. An interior face of the third wall 506 has a mounting bar 518 projecting inwardly therefrom. The mounting bar 518 has a first cut-out portion 520 into which a second end of the driving axle 514 is received. The mounting bar 518 has a second cut-out portion 522 in which a block 524 is slideably mounted. A second end of the driven axle 516 is received into an aperture of the block 524. A spring 526 is provided under compression between an inner face of the cut-out portion 522 and an outer face of the block 524 to bias the block 524 and hence the driven axle 516 towards the driving axle 514.

Figure 26B:
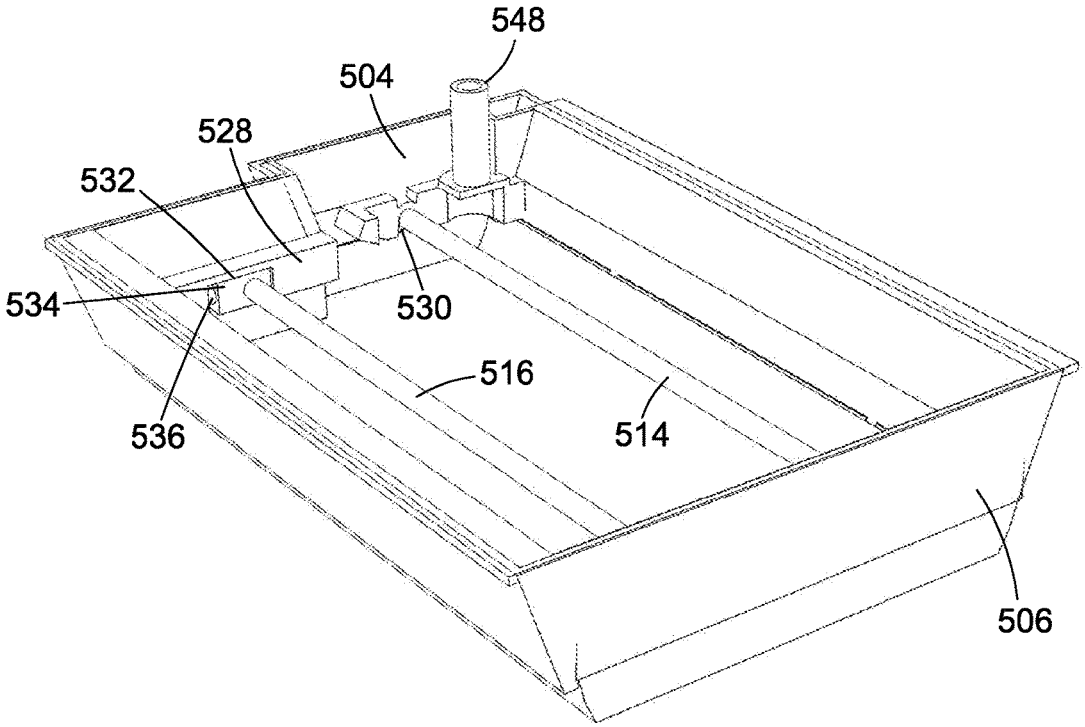
FIG. 26B is a second perspective view of the waste sealing mechanism with rollers and gears not shown.

As shown in FIG. 26B, first ends of the driving axle 514 and the driven axle 516 are mounted to the first wall 504 of the frame 502 in a similar fashion. The interior face of the first wall 504 has a mounting bar 528 having first 530 and second 532 cut-out portions similar to the first 520 and second 522 cut-out portions of the mounting bar 518 described above. The first end of the driving axle 514 is received into the first cut-out portion 530 and the second cut-out portion 532 has a block 534 slideably mounted therein into which the first end of the driven axle 516 is received. A spring 536 under compression located in the second cut-out portion 532 biases the block 536 and driven axle 516 towards the driving axle 514.

As shown in FIGS. 26A and 26B, a portion of the first wall 504 and mounting bar 528 that receives the driven axle 514 is outwardly offset from the portion of the first wall 504 and mounting bar 528 that receives the driving axle 516. Thus the driving axle 514 is longer than the driven axle 516.

Figure 28:
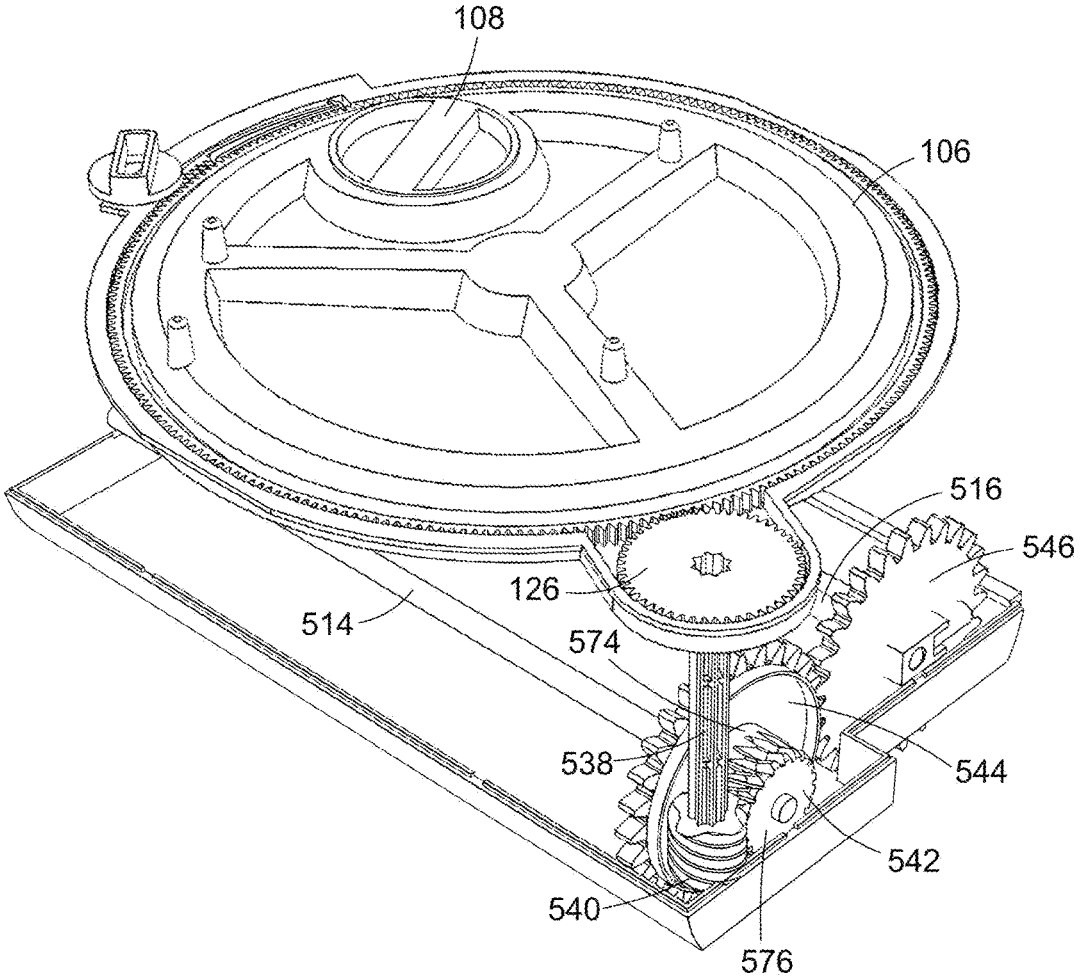
FIG. 28 is a perspective view of a lid mechanism of the waste disposal device and the waste sealing mechanism of the waste disposal device.

With reference to FIG. 28, the waste sealing mechanism 500 further comprises the drive shaft 538, a worm gear 540, a wheel gear 542, a driving gear 544 and a driven gear 546.

As shown in FIG. 7, the drive shaft 538 projects upwardly from the waste sealing mechanism 500 through the aperture 213 in the face 202 of the top section 200 and the aperture 215 in the removable insert 206, as previously described. The drive shaft 538 is rotatably mounted in a tubular casing 548 of the frame 502, as shown in FIG. 26B.

Figure 27:
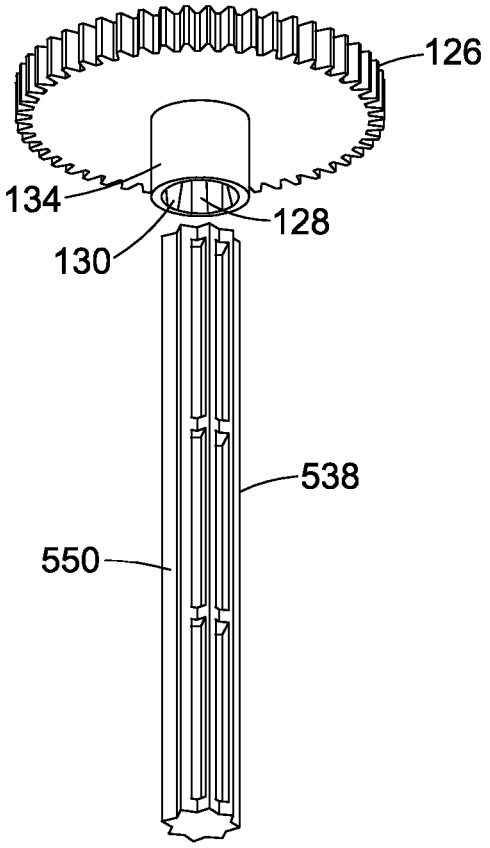
FIG. 27 is a perspective view of a spur gear and a drive shaft.

As shown in FIG. 27, the underside of the spur gear 126 (or of the inner spur gear 154 of the slip device 152) has a tubular projection 134. The hole 128 in the spur gear 126 (or in the inner spur gear 154 of the slip device 152) extends through the tubular projection 134. When the lid 100 of the waste disposal device 1 is closed, the upper end of the drive shaft 538 is received into the tubular projection 134 through the hole 128. Drive shaft teeth 550 on the exterior of the drive shaft 538 cooperate with the inner teeth 130 on the interior of the spur gear 126 (or of the inner spur gear 154 of the slip device 152) such that the drive shaft 538 rotates with the spur gear 126 (or with the inner spur gear 154 of the slip device 152).

Returning to FIG. 28, the lower end of the drive shaft 538 is coupled to a worm gear 540.

The wheel gear 542 is mounted on the first end of the driving axle 514, and rotates with the driving axle 514. Wheel gear teeth of the wheel gear 542 cooperate with worm gear teeth of the worm gear 540 such that rotation of the worm gear 540 causes rotation of the wheel gear 542. As the wheel gear is mounted on the driving axle 514, rotation of the wheel gear 542 causes rotation of the driving axle 514.

The driving gear 544 is also mounted on the driving axle 514, coaxially with the wheel gear 542. Thus, rotation of the wheel gear 542 or the axle 514 causes rotation of the driving gear 544.

As can be seen in FIG. 28, the wheel gear 542 comprises a main body 574 and a wheel gear cap 576. The main body 574 is integral with the driving gear 544, and the wheel gear cap 576 is fitted to the main body 574. The wheel gear cap teeth are aligned with the main body teeth at the end of the wheel gear cap 576 that is fitted to the main body 574, and are contoured to match the curvature of the worm gear 540.

During assembly, the worm gear 540 is installed alongside the driving gear 544 and the main body 574 of the wheel gear 542, and then the wheel gear cap 576 is fitted to the main body 574. Thus the two-part construction of the wheel gear 542 allows the wheel gear 542 to be assembled with the worm gear 540 in the small space available in the frame whilst ensuring the best possible meshing of the worm gear 540 and the wheel gear 542.

The driven gear 546 is mounted on the driven axle 516, such that driven gear teeth of the driven gear 546 cooperate with driving gear teeth of the driving gear 544. Thus, rotation of the driving gear 544 in a first direction causes rotation of the driven gear 546 and the driven axle 516 in a second, opposite direction.

In operation, with the lid 100 of the waste disposal device 1 closed, a user rotates the ring 106 via the handle 108, thereby causing the spur gear 126 to rotate. The rotating spur gear 126 causes the drive shaft 538 and worm gear 540 to rotate. The rotating worm gear 540 drives the wheel gear 542, which in turn causes the driving axle 514 and driving gear 544 to rotate in a first direction. The rotating driving gear 544 causes the driven gear 546 and hence the driven axle 516 to rotate in a second, opposite direction.

Figure 29:
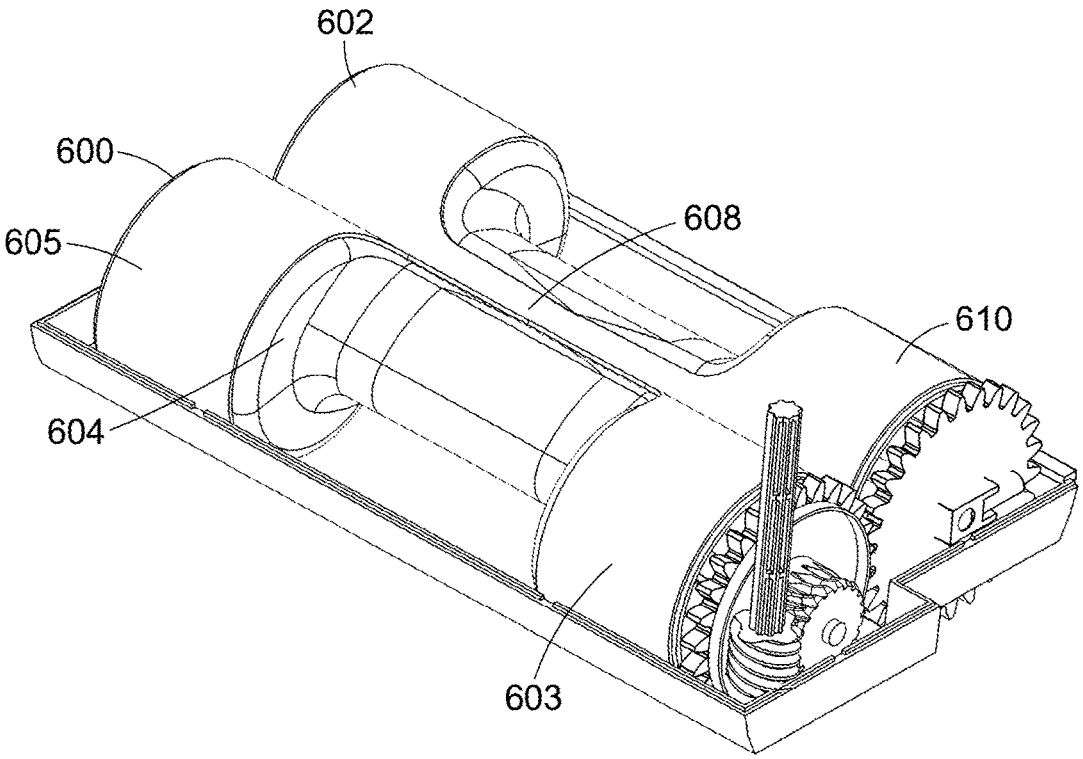
FIG. 29 is a perspective view of the waste sealing mechanism in a first configuration.

A first roller 600 is mounted on the driving axle 514 and a second roller 602 is mounted on the driven axle 516 as shown in FIG. 29. In FIG. 29, a portion of the frame 502 is not shown. The first 600 and second 602 rollers are substantially identical. The first roller 600 will now be described but it will be understood that the following description applies equally to the second roller 602.

The first roller 600 comprises first 603 and second 605 substantially cylindrical ends joined by a joining section 608, wherein the joining section 608 is offset from the central (rotational) axis of the roller 600. In cross section, the joining section 608 forms a substantially circular sector having a central angle less than 90°. A central axle comprising a metal rod is provided through the central (rotational) axis of the roller 600. The central axle provides rigidity to the roller 600 during the waste sealing process described below. Alternatively, the joining section 608 may be radially displaced from the central (rotational) axis of the roller 600 to provide a larger maximum size of an aperture 606 between the first 600 and second 602 rollers, described in more detail below.

The first 603 and second 605 substantially cylindrical ends of the roller 600 and the radially outer portion of the joining section 608 are covered by a flexible, resilient material 610. The first 520 and second 522 cut-out sections of the mounting bar 518 of the third wall 506 of the frame 502 and the first 530 and second 532 cut-out sections of the mounting bar 528 of the first wall 504 of the frame 502 are spaced apart a distance approximately equivalent to the diameter of the roller 600, such that when mounted on the driving 514 and driven 516 axles the material 610 of the first roller 600 is compressed against the material 610 of the second roller 602 by the springs 526 and 536.

Because the material 610 covering the roller 600 is flexible and resilient, the surface of the roller 600 can grip and draw the film 343 as the roller 600 rotates.

The radius of the root circle of the driving 544 and driven 546 gears (i.e. the radius of the gears as measured to the valleys between the teeth) is less than the radius of the roller 600 including the material 610 to allow the material 610 of the first roller 600 to contact the material 610 of the second roller 602. The distance that the teeth project from the root circle of the driving 544 and driven 546 gears is greater than the radius of the roller 600 including the material 610 to allow the teeth of the driving 544 and driven 546 gears to mesh.

In operation, a user opens the lid 100 of the waste disposal device 1 and inserts an item of waste to be disposed of through the aperture 210 into the removable insert 206. The funnel portion 208 of the removable insert 206 guides the item of waste towards the centre of the aperture 410 in the cassette 400.

The item of waste is dropped through the apertures 210, 410 by the user so that it contacts the film 434 drawn from the rolls 412 and rests on the joining sections 608 of the first 600 and second 602 rollers, which form a platform as shown in FIG. 29. The item of waste is separated from each of the first 600 and second 602 rollers by the film 434.

When the item of waste is located on the platform formed by the joining sections 608 of the first 600 and second 602 rollers, the user closes the lid 100. The user then rotates the ring 106 using the handle 108, causing the first 600 and second 602 rollers to rotate through the configurations shown in FIGS. 29 to 32. The gear ratios of the ring 106, spur gear 126, worm gear 540 and wheel gear 542 are such that a 360° rotation of the ring 106 causes a 360° rotation of each of the first 600 and second 602 rollers.

Figure 30:
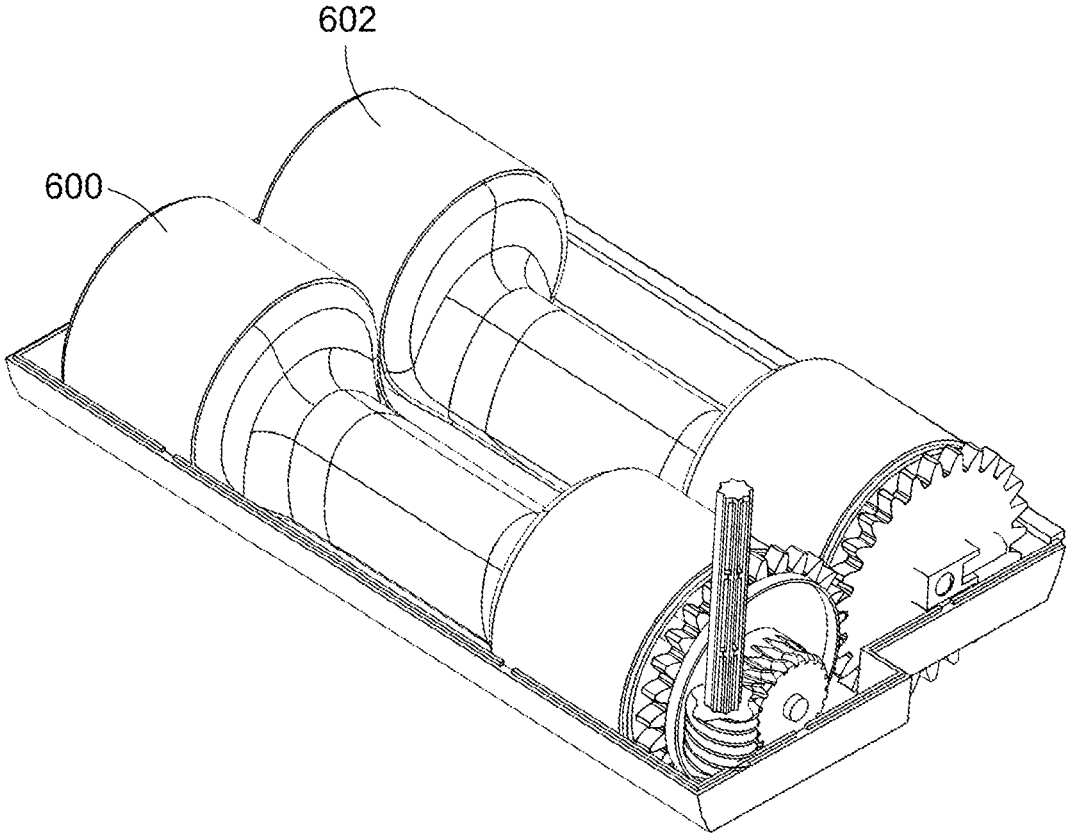
FIG. 30 is a perspective view of the waste sealing mechanism in a second configuration.

As the first 600 and second 602 rollers are rotated through 90° from the configuration shown in FIG. 29 to the configuration shown in FIG. 30, the two layers of film 434 from the respective rolls 412 are compressed together and drawn towards the bottom section 300 of the waste disposal device 1 by the material 610 surrounding the cylindrical end portions of the first 600 and second 602 rollers, which is put under compression by the springs 526 and 536. The springs 526, 536 are chosen such that the force applied by the springs 526, 536 to the layers of film 434 via the material 610 surrounding the first 600 and second 602 rollers is sufficient to activate the adhesive on the surface of the layers of film 434. Thus, when the two layers of film 434 are compressed together they adhere to one another forming a seal below the item of waste, to create the base of new sealed pouch.

Figure 31:
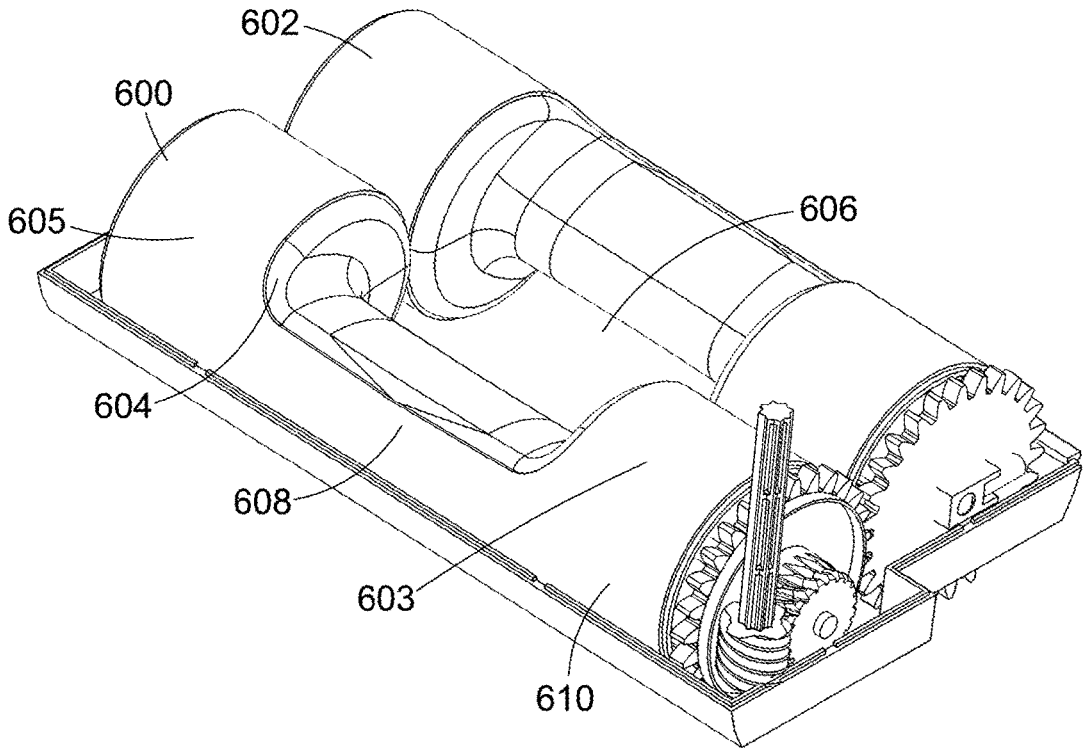
FIG. 31 is a perspective view of the waste sealing mechanism in a third configuration.

As the first 600 and second 602 rollers are rotated through a further 90° from the configuration shown in FIG. 30 to the configuration shown in FIG. 31, the two layers of film 434 and the item of waste are drawn further towards the bottom section 300 and an aperture 606 forms between the first 600 and second 620 rollers, into which the item of waste drops. Thus, the two layers of film are compressed together to form a seal either side of the item of waste to create the sides of the sealed pouch.

Figure 32:
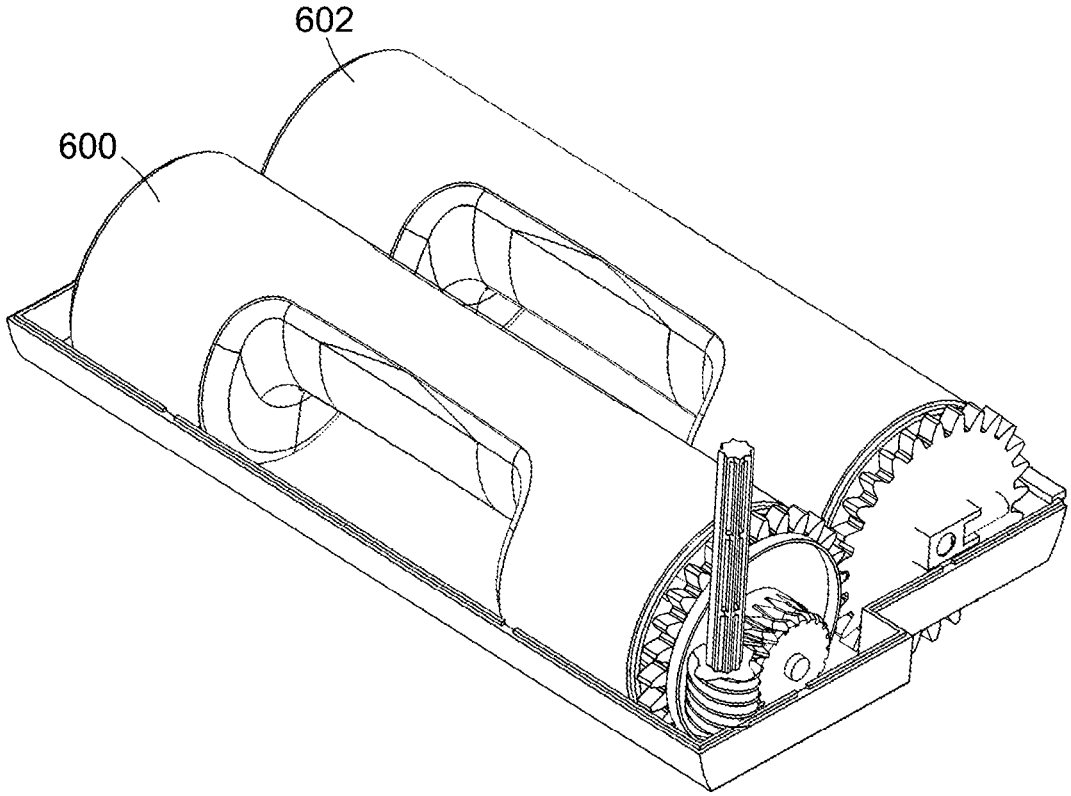
FIG. 32 is a perspective view of the waste sealing mechanism in a fourth configuration.

As the first 600 and second 602 rollers are rotated through a further 90° from the configuration shown in FIG. 31 to the configuration shown in FIG. 32, more film 434 is drawn from the rolls 412 and the item of waste moves further towards the bottom section 300. As the item of waste is drawn towards the bottom section 300 along with the film 434, the joining sections 608 of each of the first 600 and second 602 rollers rotate around the item of waste, but preferably do not compress it.

Finally, the first 600 and second 602 rollers are rotated through a further 90° from the configuration shown in FIG. 32, and the waste disposal device 1 returns to the configuration shown in FIG. 29 ready to receive another item of waste. As the first 600 and second 602 rollers rotate through this final phase, the material 610 on the outer radial surface of the joining section 608 of the first roller 600 contacts the material 610 on the outer radial surface of the joining section 608 of the second roller 602 via the two layers of film 434, compressing the two layers of film 434 together and forming a seal above the item of waste. A complete seal has now been formed around the item of waste. This creates a totally sealed pouch around the waste item and also forms the base of a new sealed pouch, into which a subsequent item of waste can be inserted.

As shown in FIGS. 25A and 25B, the material 610 covering each of the rollers 600, 602 may comprise one or more depressions 612 in the portions of the material 610 covering the first 603 and second 605 substantially cylindrical ends. When the rollers 600, 602 are installed in the waste disposal system, each depression 612 in the material 610 of the first roller 600 is paired with a depression 612 in the material 610 of the second roller 602. The pair of depressions 612 align as the rollers 600, 602 rotate, thereby creating sealed pockets between the two layers of film 434 around the sealed pouch described above. Thus the depressions 612 capture and seal away any liquid that may leak from the item of waste during the waste sealing process. If necessary, pairs of depressions 612 may be arranged as a series in an axial direction along the rollers 600, 602 such that liquid collecting anywhere along the region where the two layers of film 434 meet is captured and sealed away during the waste sealing process.

Alternatively, the rollers 600, 602 may be provided without the covering material 610. In this case, the rollers 600, 602 may be provided with depressions moulded directly into the surface of the rollers 600, 602.

The material 610 covering each of the rollers 600, 602 may comprise projections, which may be paired across the first 600 and second 602 rollers as described in relation to the depressions 612 above. The projections on the material 610 apply an additional sealing force to the layers of film 434 as they are compressed between the rollers 600, 602.

Figure 32A:
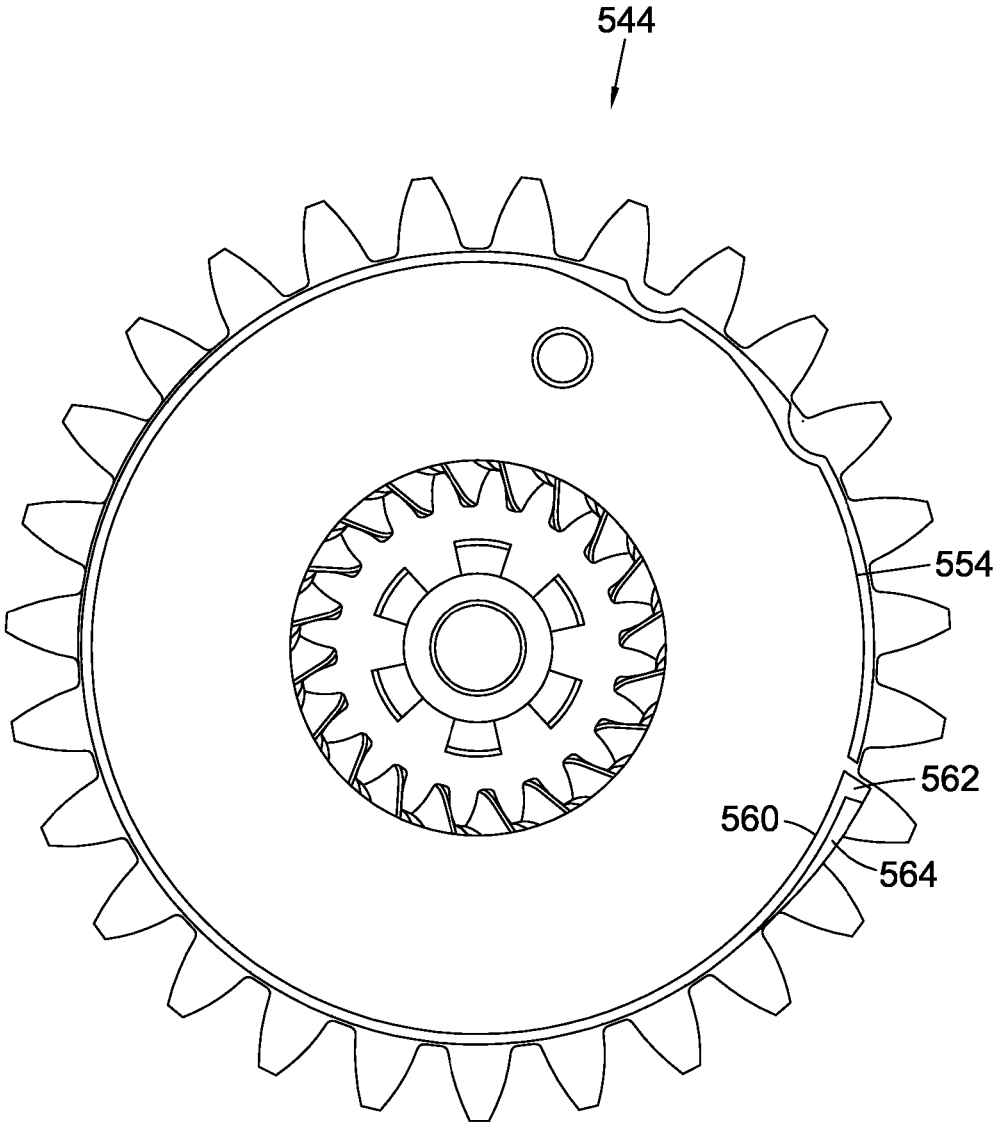
FIG. 32A is a front view of a driving gear including a ratchet mechanism.
Figure 32B:
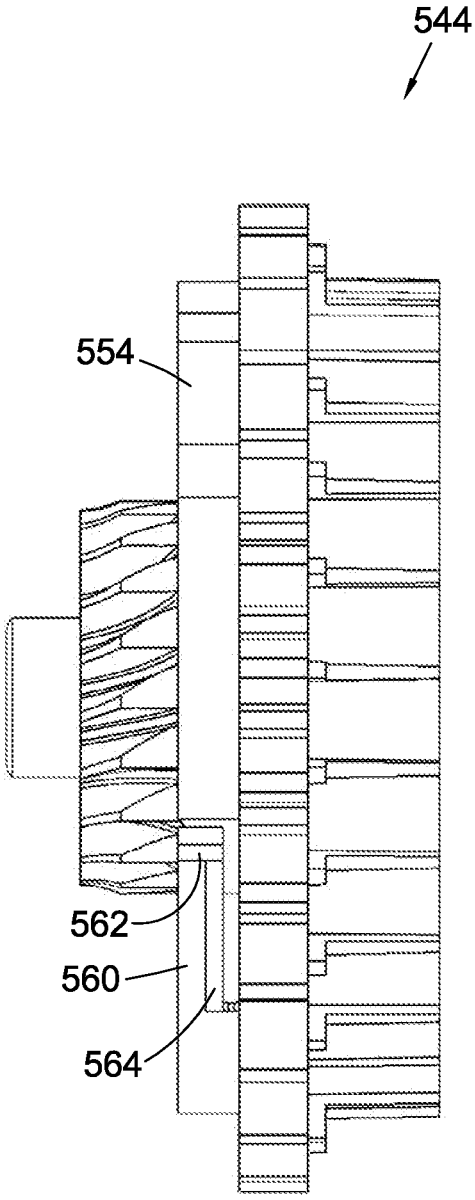
FIG. 32B is a side view of the driving gear including the ratchet mechanism.
Figure 32C:
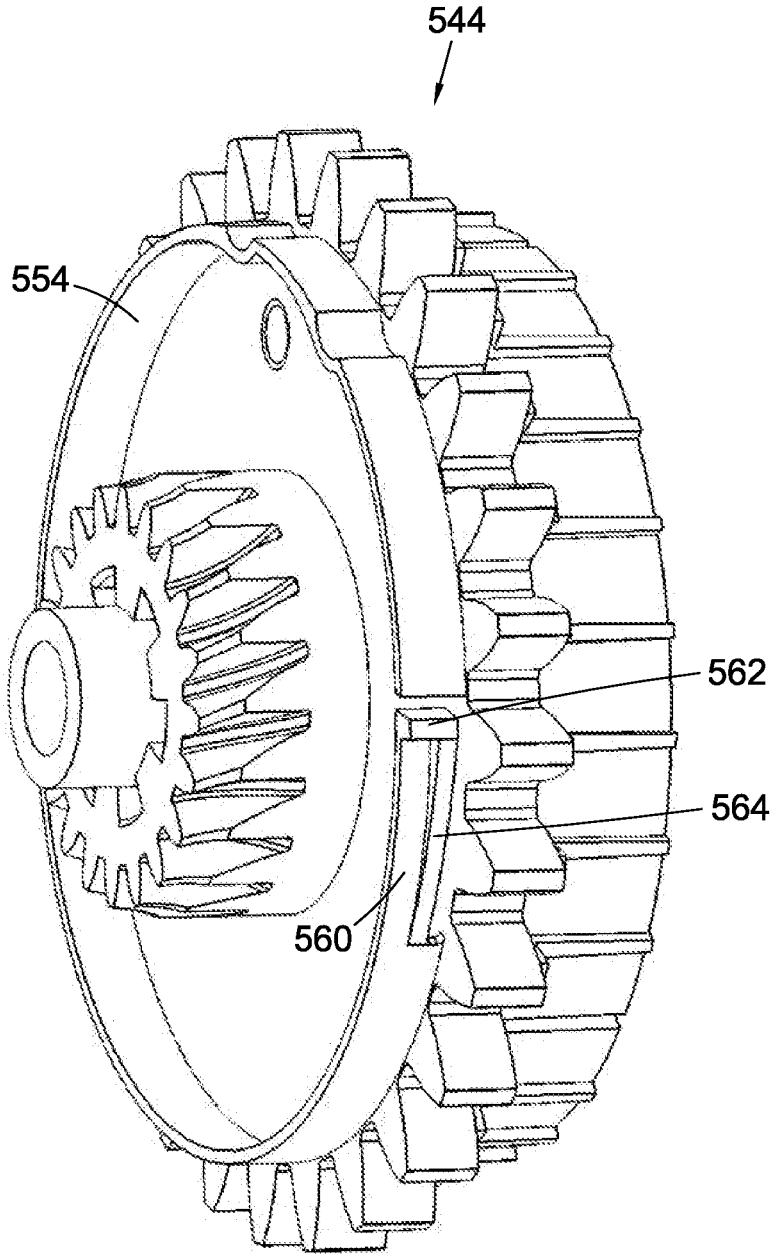
FIG. 32C is a perspective view of the driving gear including the ratchet mechanism.

In an embodiment, a ratchet mechanism may be provided on the driving gear 544 instead of the ratchet 140 provided in the lid 100, as described above. In this embodiment, a ratchet arm 560 is provided on a rim 554 projecting from the circumference of the root circle of the driving gear 544, as shown in FIGS. 32A to 32C. The portion of the rim 554 forming the ratchet arm 560 is not fixed directly to the driving gear 544, as shown in FIG. 32B, and is free to deflect radially inward towards the central axis of the driving gear 544.

A free end of the ratchet arm 560 comprises an abutment 562. A ramped portion 564 of the ratchet arm 560 ramps radially outwardly from a fixed end of the ratchet arm 560, where the ratchet arm 560 is joined to the rim 554, to a tip of the abutment 562.

In operation, as the waste sealing mechanism 500 reaches the end of the cycle described above with respect to FIGS. 29 to 32, the ramped portion 564 abuts an edge of the mounting bar 528. As the driving gear 544 rotates further, the ramped portion 564 slides over the edge of the mounting bar 528, causing the ratchet arm 560 to be deflected radially inwardly. As the driving gear 544 rotates yet further, the abutment 562 passes the edge of the mounting bar 528 and the ratchet arm 560 returns to the neutral position shown in FIGS. 32A to 32C.

Once the ratchet arm 560 has returned to the neutral position (i.e. as per FIG. 29), the abutment 562 abuts the edge of the mounting bar 528 to prevent reverse rotation of the driving gear 544. Thus a user is able to rotate the waste sealing mechanism 500 in either direction during a cycle, but once the cycle has been completed reverse rotation is prevented.

In an embodiment, a second wheel gear is mounted on the driven axle 516, and the worm gear 540 is positioned between the driving axle 514 and the driven axle 516 such that the worm gear drives both the driving 514 and driven 516 axles via the wheel gear 542 and the second wheel gear, respectively. Such a configuration may drive the driven axle 516 more effectively, but may limit the sealing pressure that can be applied to the film 434 via the rollers 600, 602.

A cutting mechanism may be provided in the bottom section 300 to cut the film 434 when the waste disposal device 1 is full. The cutting mechanism comprises a cutter slider body and a cutter slider rail. In operation, the cutter slider body is drawn across the cutter slider rail and the edge of the film 434 is guided towards a blade located at the end of a narrowing channel to cut the film 434.

The cutting mechanism may be located on an inner surface of the drawer in the bottom section 300 described above. The cutting mechanism may be located at the back of the drawer, so that when a user opens the drawer the film 434 is pulled against the cutter slider rail reader to be cut by the cutter slider body.

Figure 44:
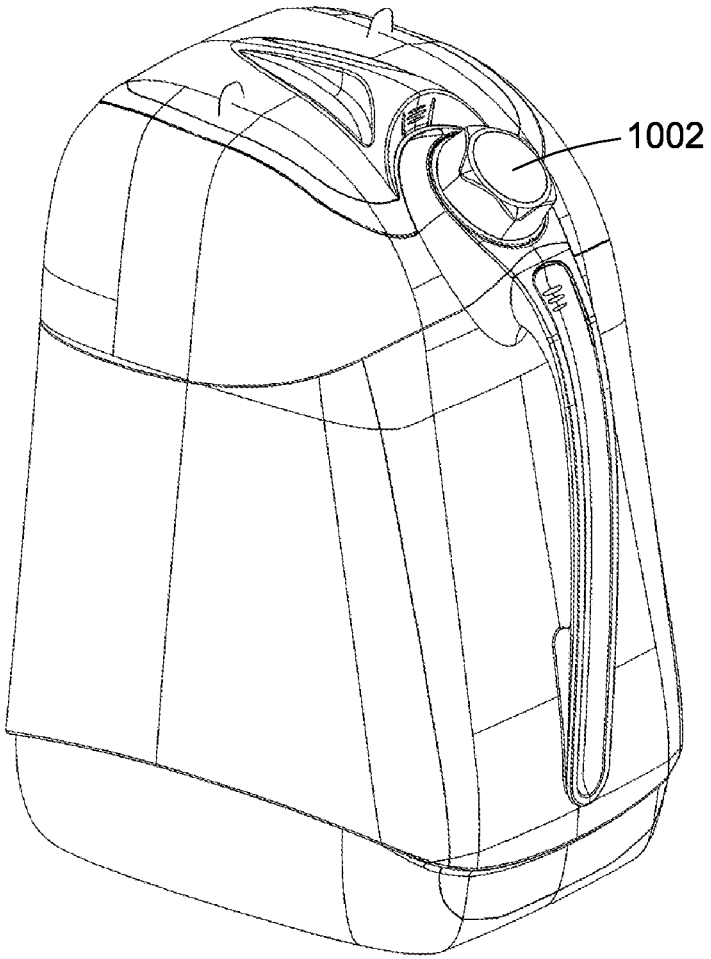
FIG. 44 is a perspective view of an alternative waste disposal device.
Figure 44A:
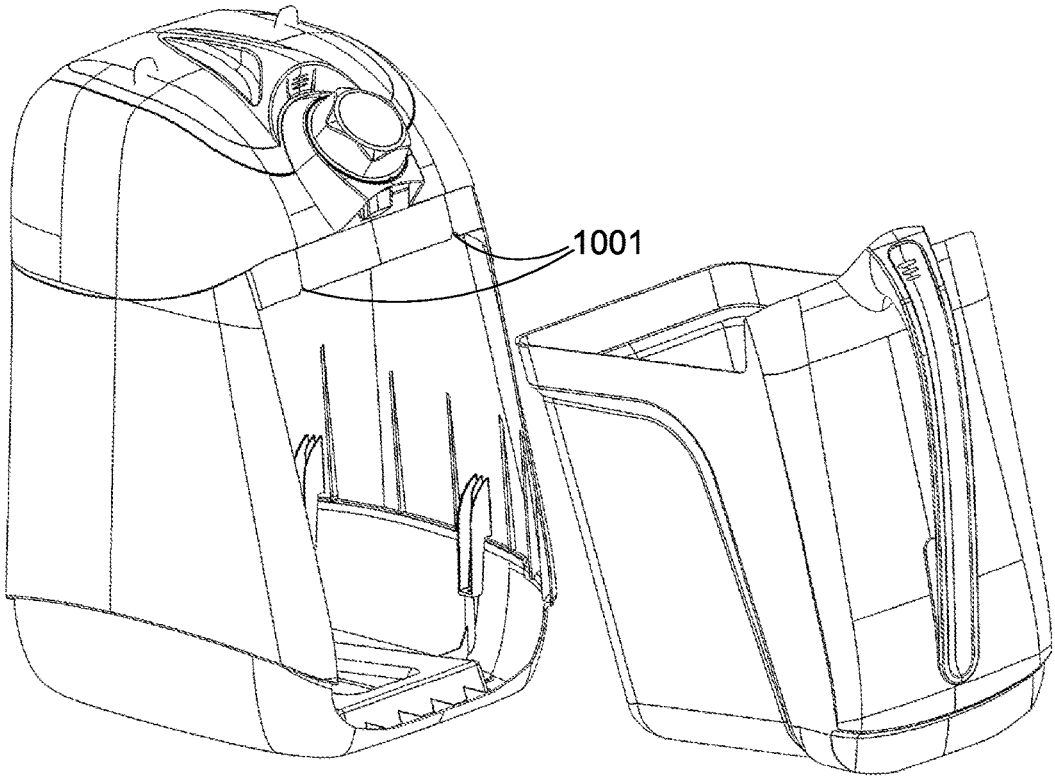
FIG. 44*a* is a perspective view of an alternative waste disposal device with its removable drawer taken out of the device.

Alternatively, as shown in FIG. 44*a*, if the film can easily be torn then the waste storage device may include a moulded feature so that the user can initiate tearing the film by pulling it against a notch 1001 or suitably sharpened edge to nick the film.

Figure 45:
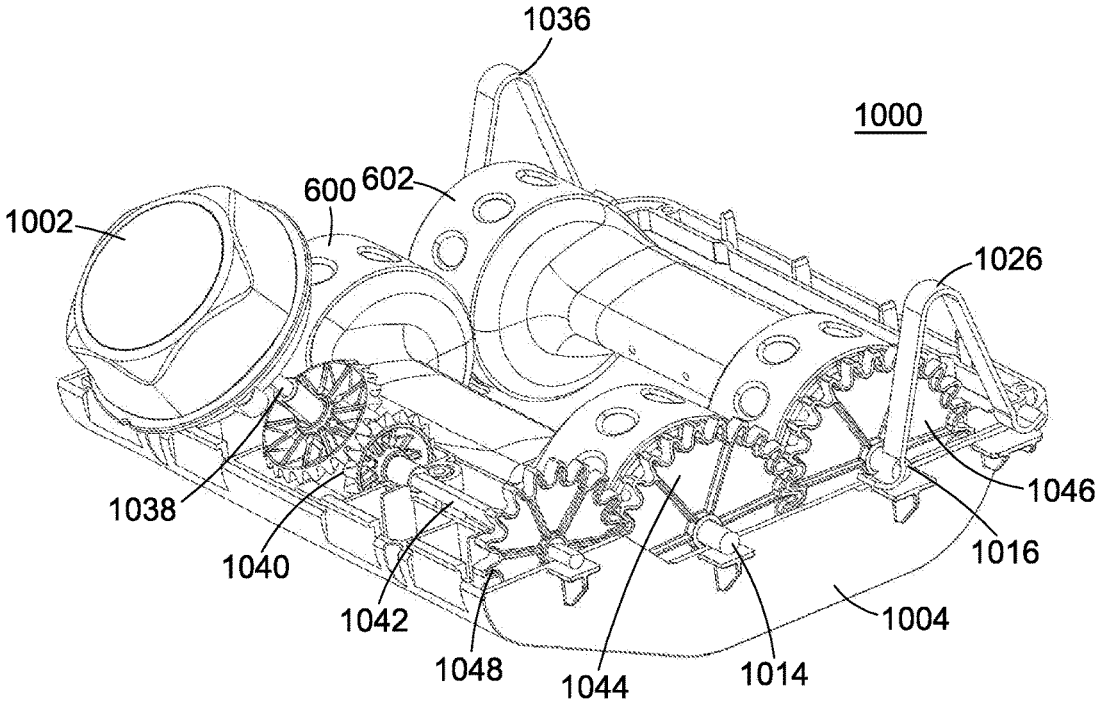
FIG. 45 is a perspective view of an alternative waste sealing mechanism.

An alternative drive mechanism 1000 is shown in FIGS. 44 and 45. In the alternative drive mechanism 1000, a user applies torsional force to a control knob 1002 to rotate the rollers 600, 602. Rotation of the control knob 1002 rotates a drive shaft 1038. Rotation of the drive shaft 1038 is transferred to a secondary drive shaft 1042 via a bevel gear 1040. The secondary drive shaft 1042 drives a gear 1048, which in turn meshes with the driving gear 1044. The driving gear 1044 drives the first roller 600 and meshes with a driven gear 1046, which drives the second roller 1048, in a similar manner to that described above. Ideally, one revolution of the control knob 1002 provides exactly one revolution of the rollers 600, 602.

The alternative drive mechanism 1000 provides an easy to operate drive mechanism, because the control knob 1002 combined with the bevel gear 1040 requires less torque in operation than other drive mechanisms as it is a very efficient transmission and the low ratio gearing is quieter than higher ratio gearing.

FIG. 45 also demonstrates an alternative to the springs 526, 236 and blocks 524, 534 of the drive mechanism 500 illustrated in FIGS. 26A and 26B and described above. Drive mechanism 1000 comprises a pair of V-shaped springs 1026, 1036. One end of each of the V-shaped springs 1026, 1036 is fixed to the frame 1004, and the other end applies a force to the driven axle 1016 in a direction towards the driving axle 1014, thereby ensuring that the driven 1046 and driving 1044 gears are tightly meshed and that the film is compressed between the rollers 600, 602.

Figure 46:
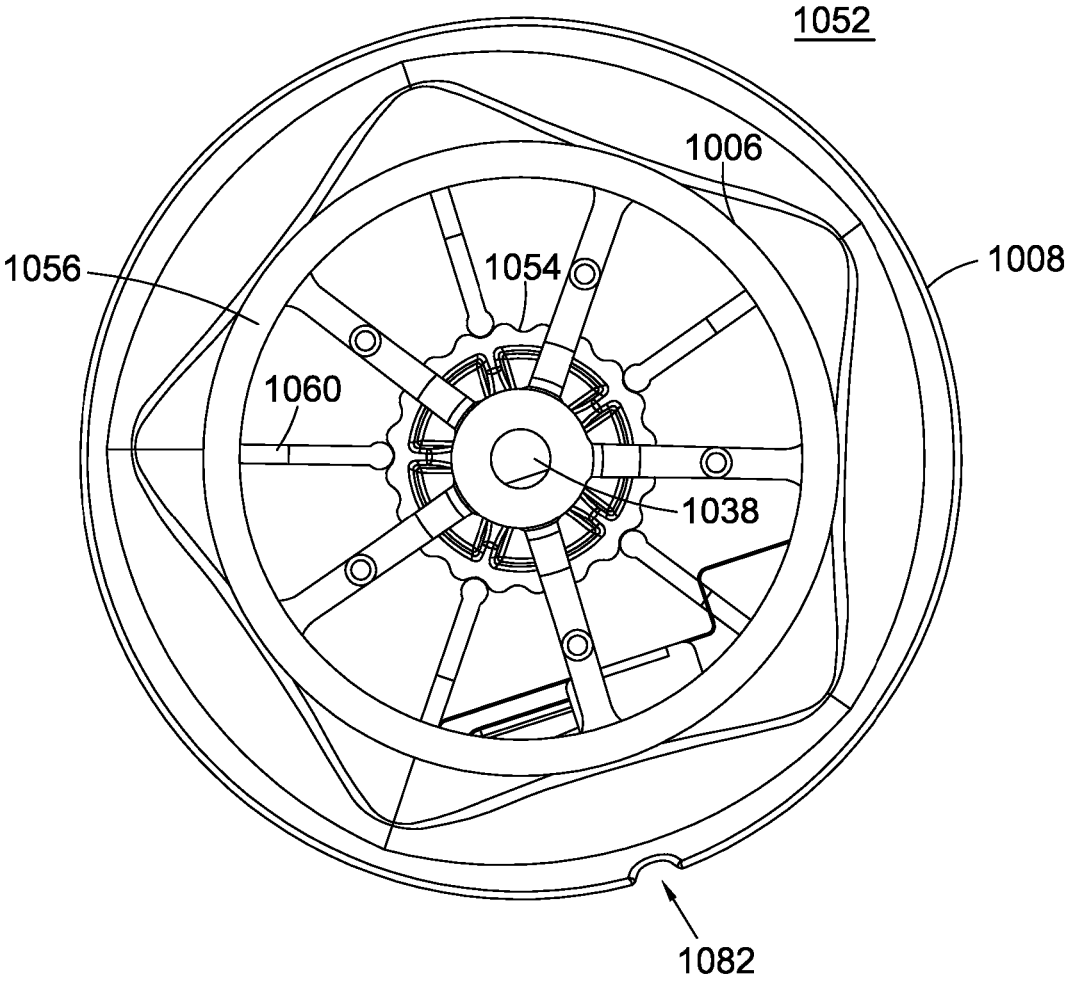
FIG. 46 is a front view of a control knob with a cap removed.

FIG. 46 shows the control knob 1002 with a cap removed. The control knob includes a slip device 1052 similar to the slip device 152 described above with reference to FIG. 6A, which prevents excessive torque being applied to the waste sealing mechanism 1000, for example if the waste sealing mechanism 1000 is locked or jammed.

The control knob 1002 comprises a control portion 1006 and a hub portion 1008. The control portion 1006 and the hub portion 1008 are both coaxial with the drive shaft 1038. The hub portion 1008 is coupled to the drive shaft 1038, such that rotation of the hub portion 1008 causes the drive shaft 1038 to rotate. The coupling may be achieved by any known method although the inventors have found it useful to use a drive shaft 1038 with a 'D'-shaped cross section and a complimentarily-shaped receiving means on the hub portion 1008. The control portion 1006 is not coupled to the drive shaft 1038, such that the control portion 1006 can freely rotate around the drive shaft 1038.

The hub portion 1008 comprises a spur gear 1054 and the control portion 1006 comprises a slip gear 1056. The spur gear 1054 is provided with a plurality of rounded teeth around its outer circumference and the slip gear 1056 comprises one or more flexible arms 1060, which depend radially inwardly from the slip gear 1056. A free end of the flexible arm 1060 is received between two of the rounded teeth on the spur gear 1054, such that rotation of the control portion 1006 and slip gear 1056 causes rotation of the spur gear 1054, hub portion 1008 and drive shaft 1038. However, when an excessive torque is applied to the slip gear 1056, the flexible arms 1060 will flex, and slip over one or more of the rounded teeth of the spur gear 1054. Hence excessive torque will not be transferred through the slip device 1052 to the drive shaft 1038.

The hub portion 1008 also comprises a notch 1082 at its outer circumference which acts as an indicator of the relative position of the rollers 600, 602. Rotation of the hub portion 1008 is fixed to the rotation of the rollers 600, 602 and in order that the user can observe how far through the waste sealing cycle they have progressed a notch 1082 is provided at its outer edge. In normal use the notch 1082 moves with the control knob 1002 as the user turns it to operate the rollers 600, 602, However, if the slip device 1052 is activated, then the rollers 600, 602, the hub portion 1008 and the notch 1082 all stop moving. The user can now address reason for the slipping, for example by reversing the rollers or removing any obstructions, before continuing with the waste sealing cycle and will always be able to refer to the position of the notch 1082 as to the relative position of the rollers 600, 602.

The control knob 1002 also comprises a ratchet system 1060 which will now be described with reference to FIGS. 47 to 49.

The ratchet system 1060 comprises a spring 1062 which acts as a pawl in the ratchet system 1060. The spring 1062 is located in a cut-portion 1064 of the hub portion 1008. The spring 1062 comprises a fixed end 1066 and a free end 1068 separated by a U-shaped portion 1070.

Figure 47:
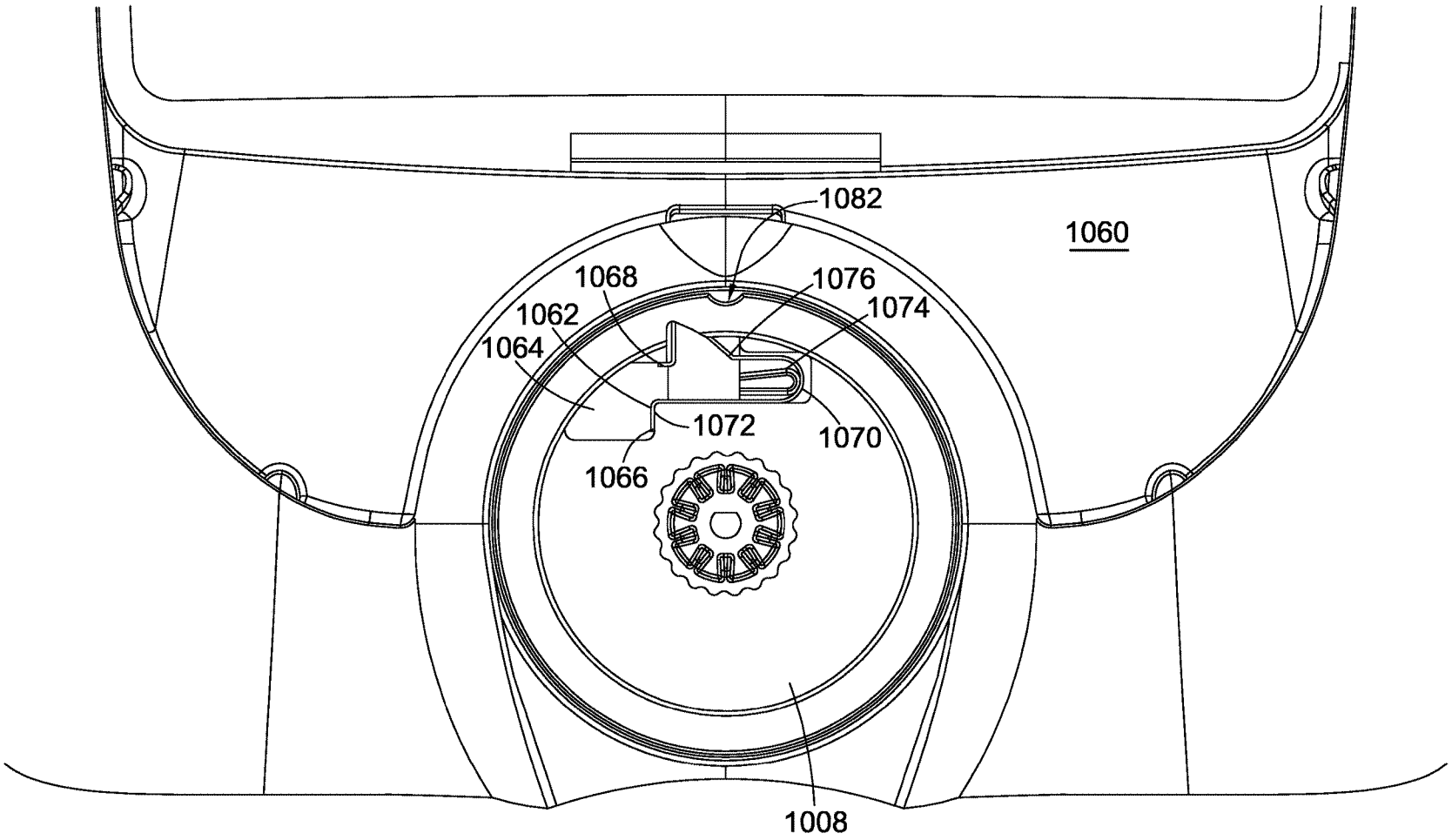
FIG. 47 is a front view of a ratchet system in a neutral position.

The fixed end 1066 of the spring 1062 is substantially L-shaped and abuts a shoulder 1072 of the hub portion 1008 to prevent the spring 1062 from moving relative to the hub portion 1008 when the hub portion 1008 is rotated in an anti-clockwise direction (in the orientation shown in FIG. 47). The U-shaped portion 1070 of the spring 1062 abuts a lug 1074 of the hub portion 1008 to prevent the spring 1062 from moving relative to the hub portion 1008 when the hub portion is rotated in a clockwise direction (in the orientation shown in FIG. 47). Thus the spring 1062 rotates with the hub portion 1008.

Figure 48:
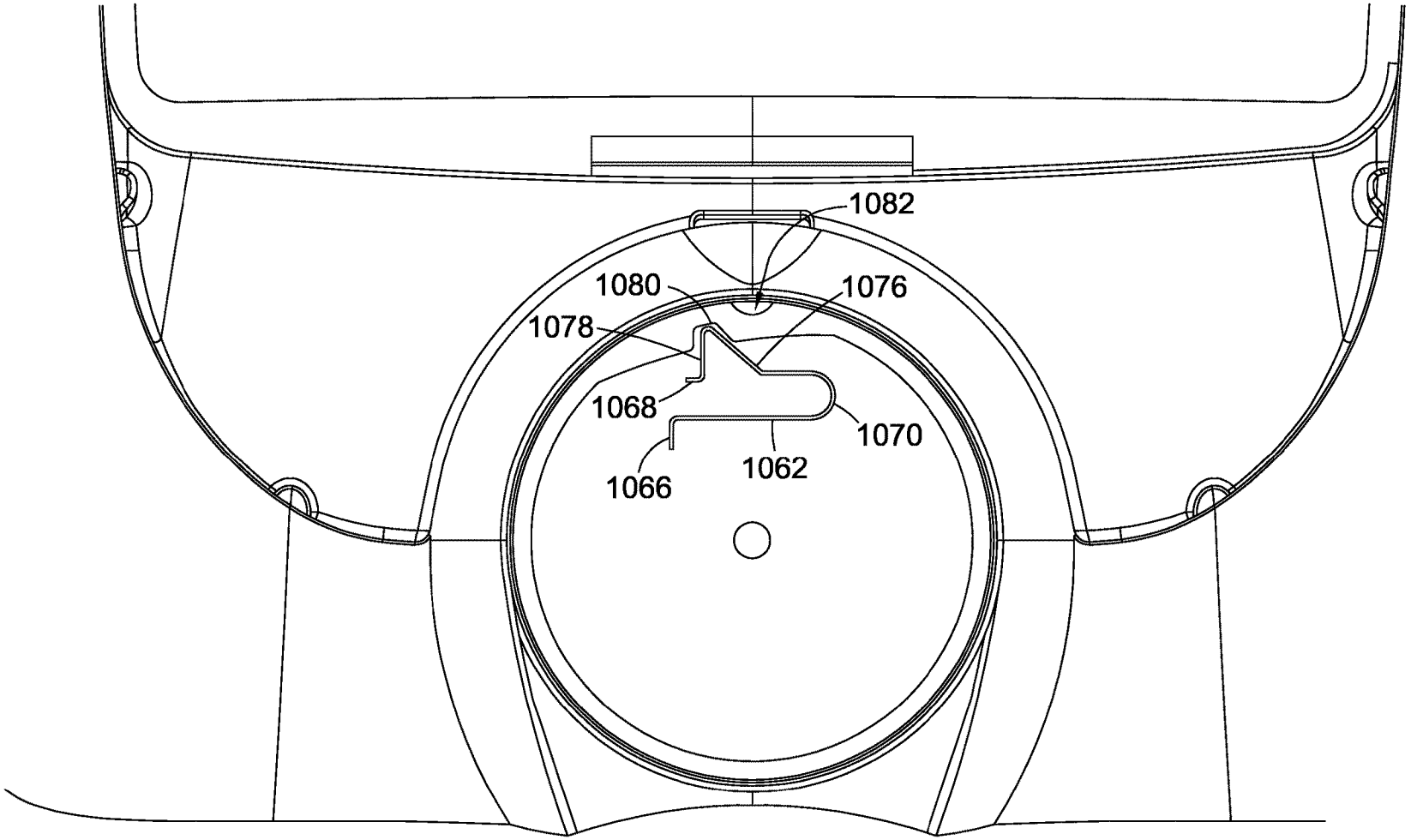
FIG. 48 is a front view of the ratchet system in a neutral position with a hub portion removed.
Figure 49:
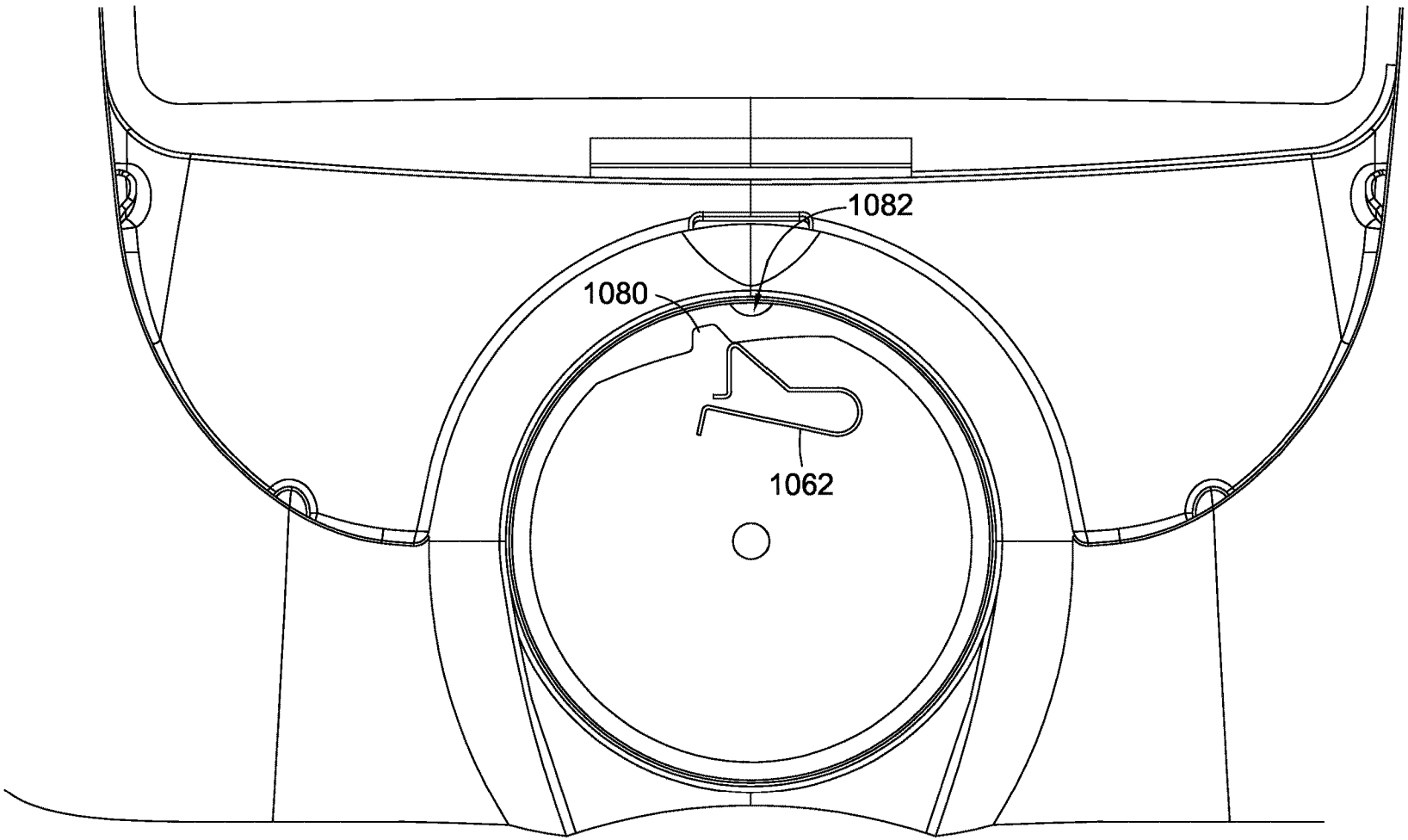
FIG. 49 is a front view of the ratchet system in a second position with a hub portion removed.
Figure 50:
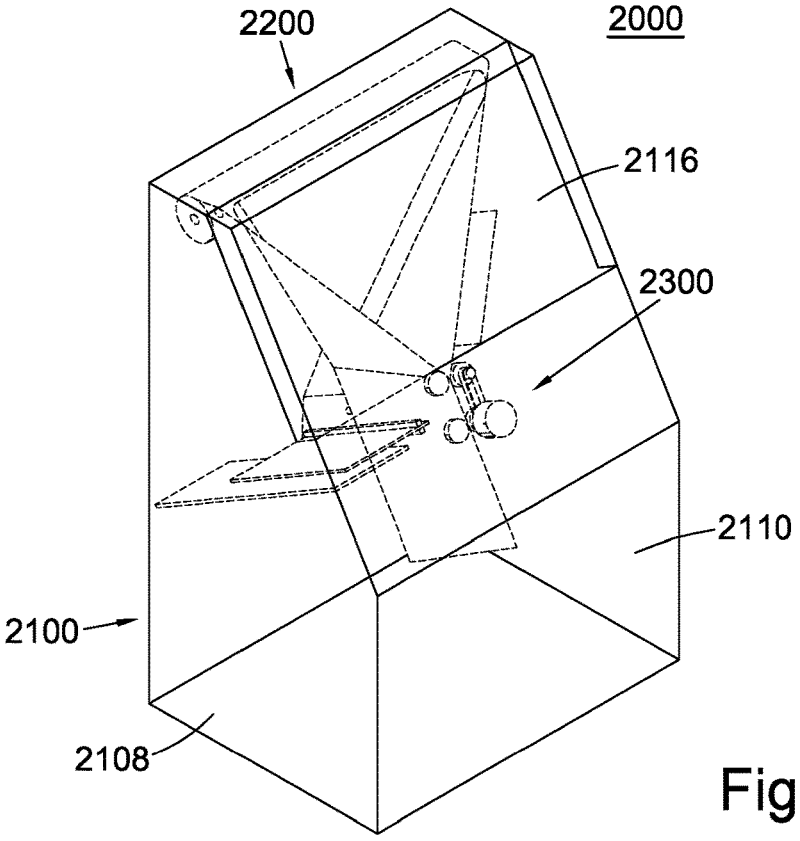
FIG. 50 is a front perspective view of an alternative waste sealing device.
Figure 51:
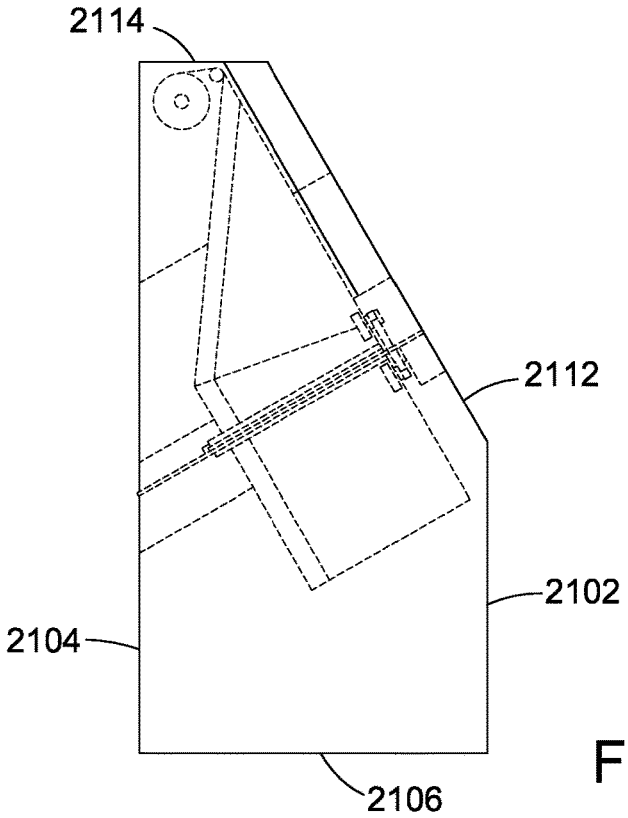
FIG. 51 is a side view of the waste sealing device of FIG. 50.

FIGS. 48 and 49 show the ratchet system 1060 with the hub portion 1008 removed for the purposes of clarity but in the following description it will be understood that the spring 1062 rotates with the hub portion 1008.

The free end 1068 of the spring 1062 comprises a ramped portion 1076 and a stepped portion 1078. In a neutral position of the hub portion 1008, the free end of the spring 1062 is located in a cut-out portion 1080 of the lid. As the hub portion 1008 is rotated in a clockwise direction (in the orientation shown in FIG. 47), the ramped portion 1076 of the spring 1062 abuts and slides over an edge of the cut-out portion 1080 of the lid, compressing the spring 1062 as shown in FIG. 49. Thus rotation of the hub portion 1008 in a clockwise direction is permitted. The resistance required to push the ramped portion 1076 of the spring 1062 over the edge of the cut-out portion 1080 will be sufficient that the rollers are unable to rotate under the weight of earlier sealed packages. However, the resistance will still be low enough that an adult, but not a small child, can rotate the control knob 1002 without difficulty.

As the hub portion 1008 nears the completion of a 360 degree rotation, the free end 1068 of the spring 1062, which is under compression, returns into the cut-out portion 1080 of the lid. When returning into the cut-out portion of the lid, the spring 1062 will make a clearly audible click sound that tells the user they have completed the sealing operation.

If the hub portion 1008 is rotated in an anticlockwise direction (in the orientation shown in FIG. 47), the stepped portion 1078 of the spring 1062 abuts an edge of the cut-out portion 1080 of the lid and further rotation of the hub portion 1008 is prevented. Thus rotation of the hub portion 1008 in an anticlockwise direction from the neutral position is resisted.

The ratchet system 1060 therefore allows free rotation of the hub portion 1008 in the clockwise direction. If, during rotation, a blockage occurs in the waste sealing mechanism, the hub portion 1008 may be rotated anticlockwise so that the blockage can be addressed. The ratchet system 1060 means that the user can reverse the waste sealing mechanism through the current cycle without risk of unsealing any older packages. However, once a complete 360 degree rotation of the hub portion 1008 has occurred and the waste sealing operation is complete, reversal of the waste sealing mechanism is resisted.

Locking Mechanism

Figure 33:
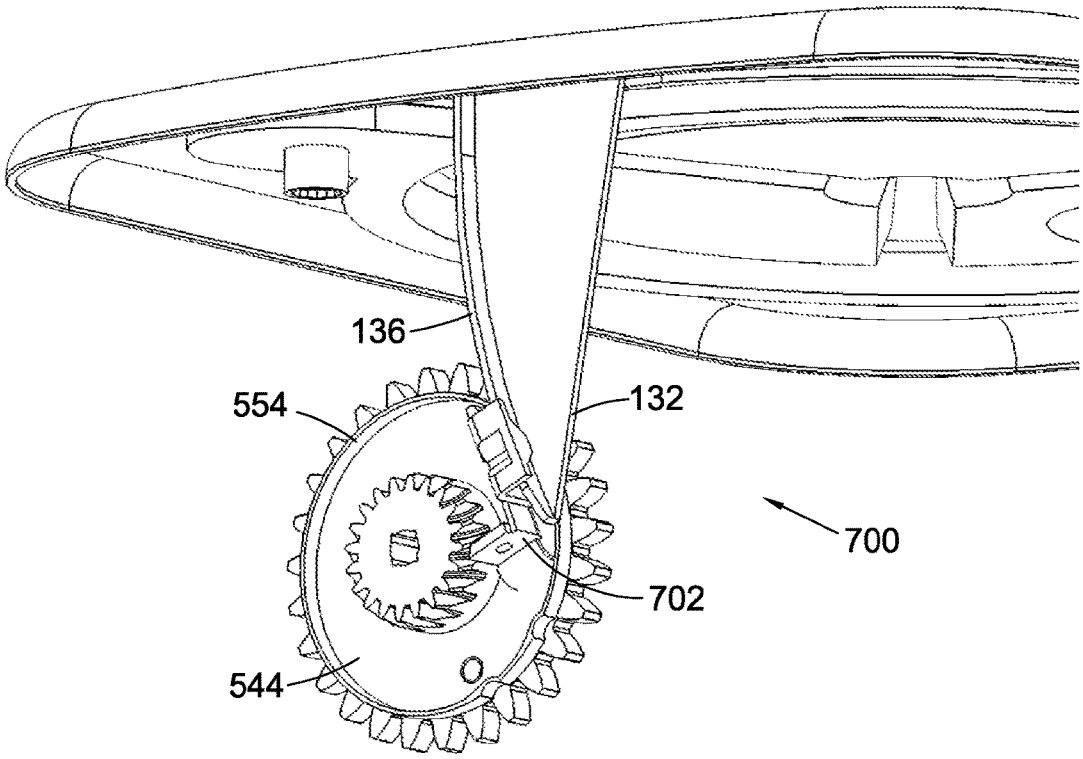
FIG. 33 is a first perspective view of a locking mechanism engaging with a locking plate of the lid.
Figure 34:
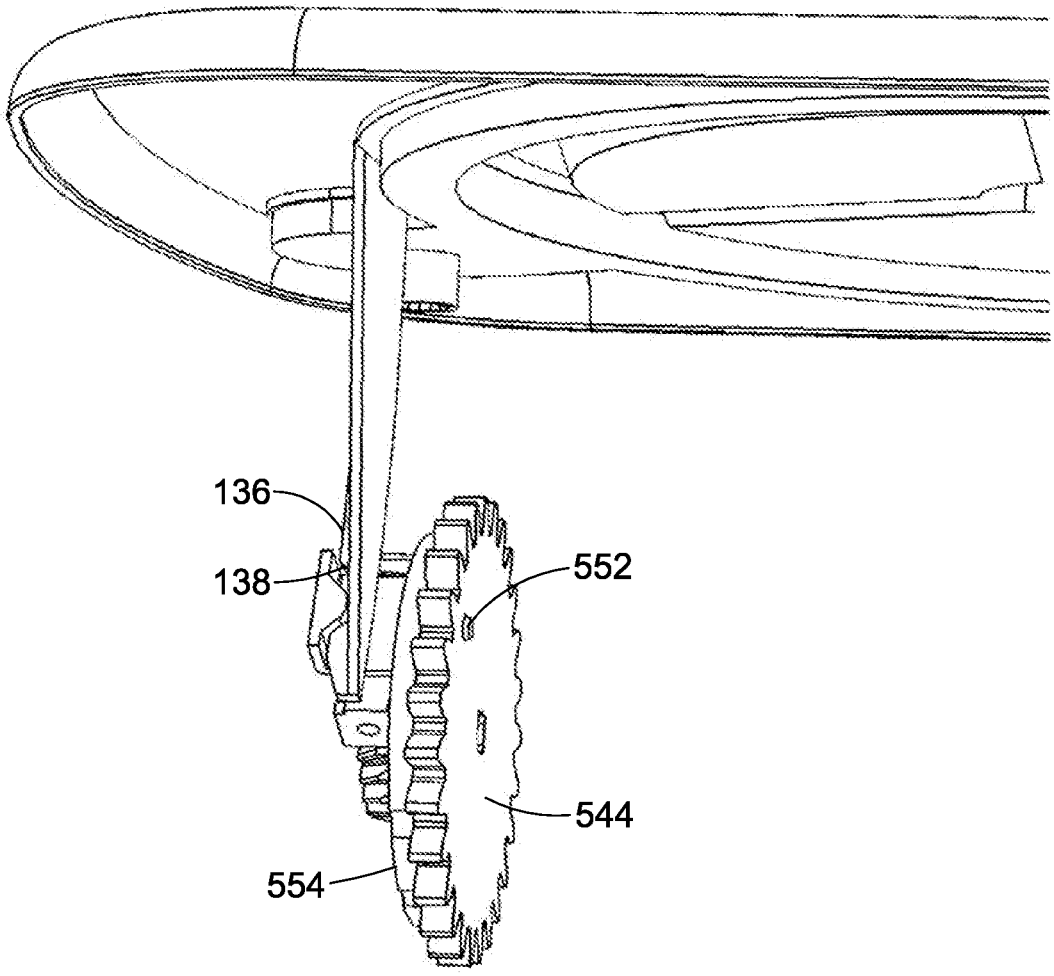
FIG. 34 is a second perspective view of the locking mechanism engaging with a locking plate of the lid.

The waste disposal device 1 further comprises a locking mechanism 700. With reference to FIGS. 33 and 34, the locking mechanism 700 comprises a lock 702 mounted on the frame 502 of the waste sealing mechanism 500, a hole 552 in the driving gear 544, a rim 554 projecting from the circumference of the root circle of the driving gear 544 and the locking plate 132 of the lid 100. The locking mechanism 700 prevents actuation of the waste sealing mechanism 500 when the lid 100 is open and limits rotation of the waste sealing mechanism 500 to a single sealing cycle when the lid 100 is closed, to avoid film 434 wastage.

Figure 35:
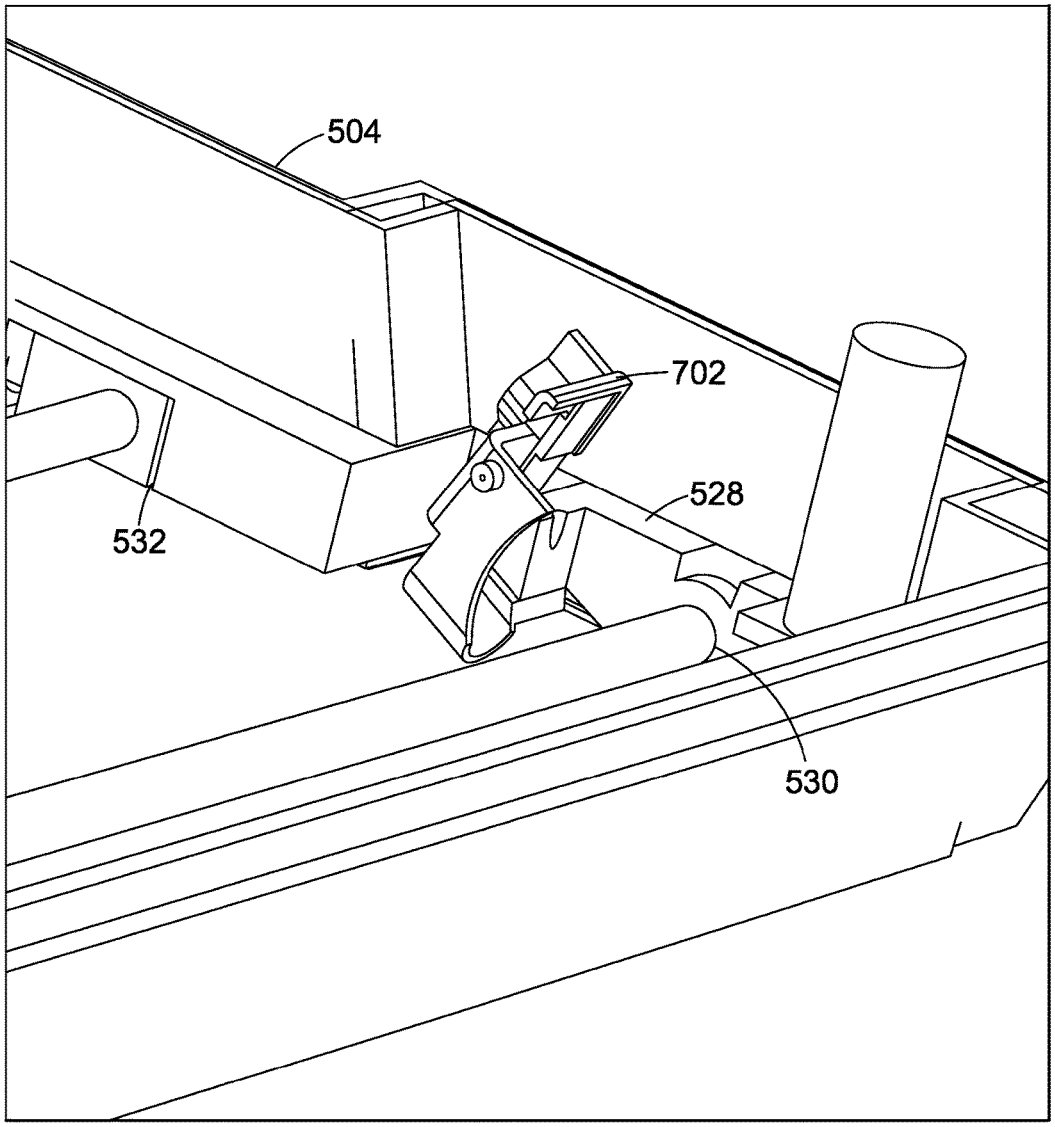
FIG. 35 is a perspective view of a lock of the waste disposal device mounted on a frame.

As shown in FIG. 35, the lock 702 is mounted to the mounting bar 528 of the first wall 504 of the frame 502 between the first 530 and second 532 cut-out portions and proximal to the first cut-out portion 530.

Figure 36:
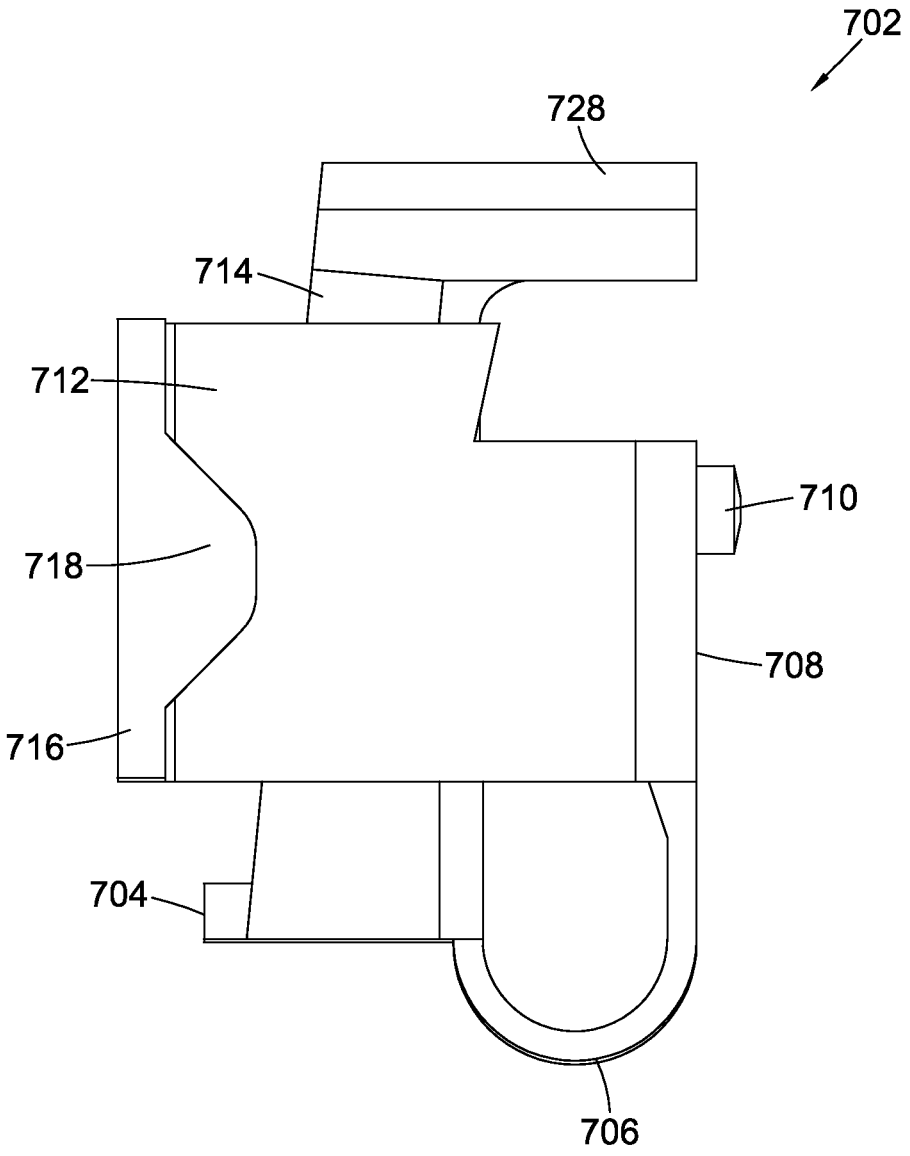
FIG. 36 is a right-side view of the lock.
Figure 37:
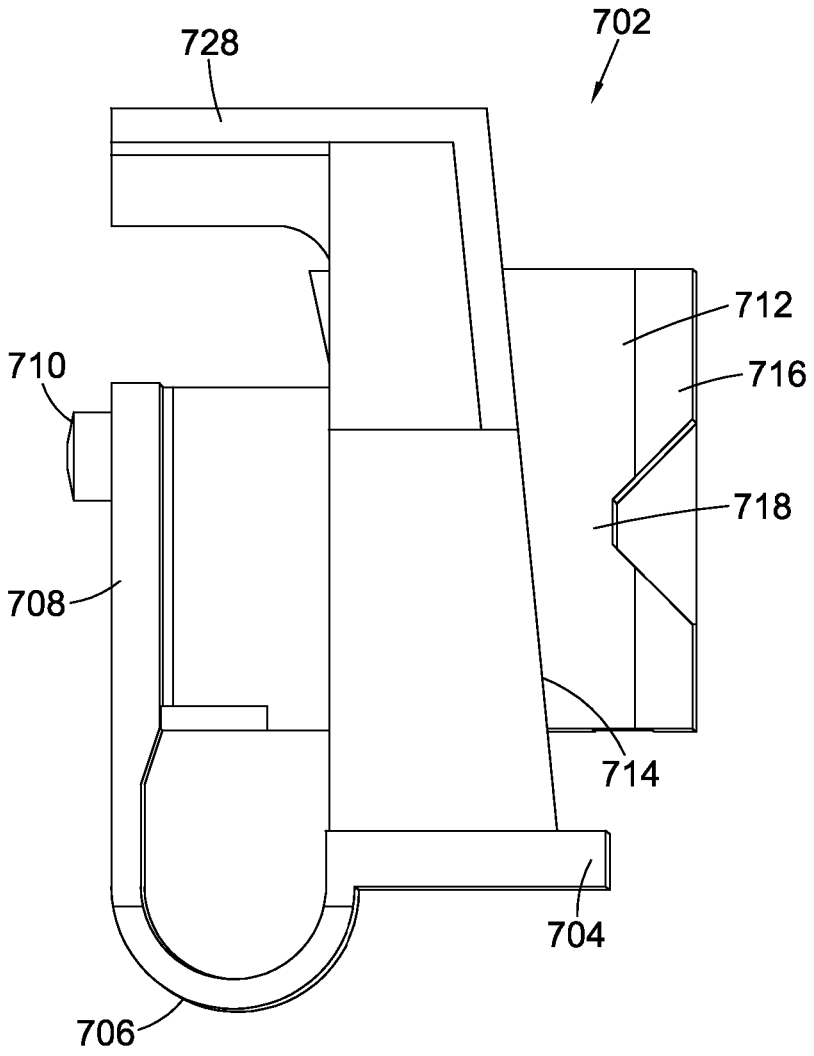
FIG. 37 is a left-side view of the lock.

With reference to FIGS. 36 and 37, the lock 702 comprises a mounting portion 704 and a locking portion 708. The mounting portion 704 and locking portion 708 are joined by a sprung portion 706. The sprung portion 706 allows the locking portion 708 to flex in a first direction parallel to the central axis of the driving axle 514. The locking portion 708 further comprises a projection 710 that cooperates with the hole 552 in the driving gear 544 and a release portion 712 that cooperates with the locking plate 132 of the lid 100.

The mounting portion 704 further comprises a driving portion 714 extending therefrom that cooperates with the rim 554 of the driving gear 544. The driving portion 714 can flex with respect to the mounting portion 704 in a second direction perpendicular to the first direction and parallel to a radial direction of the driving gear 544.

The release portion 712 comprises a substantially planar surface that extends from the locking portion 708 in the first direction, away from the driving gear 544 when the lock 702 is mounted in the frame 502. A lip 716 extends from an end of the release portion 712 distal from the locking portion 708. The lip 716 comprises a hump 718.

With reference to FIGS. 33 and 34, the locking plate 132 of the lid 100 comprises a planar surface having a curved edge. A projecting flange 136 extends outwardly from the curved edge. The projecting flange 136 comprises a cut-out portion 138 towards an end of the locking plate 132 distal from the face 102 of the lid 100 that cooperates with the hump 718 of the lock 702.

Figure 38:
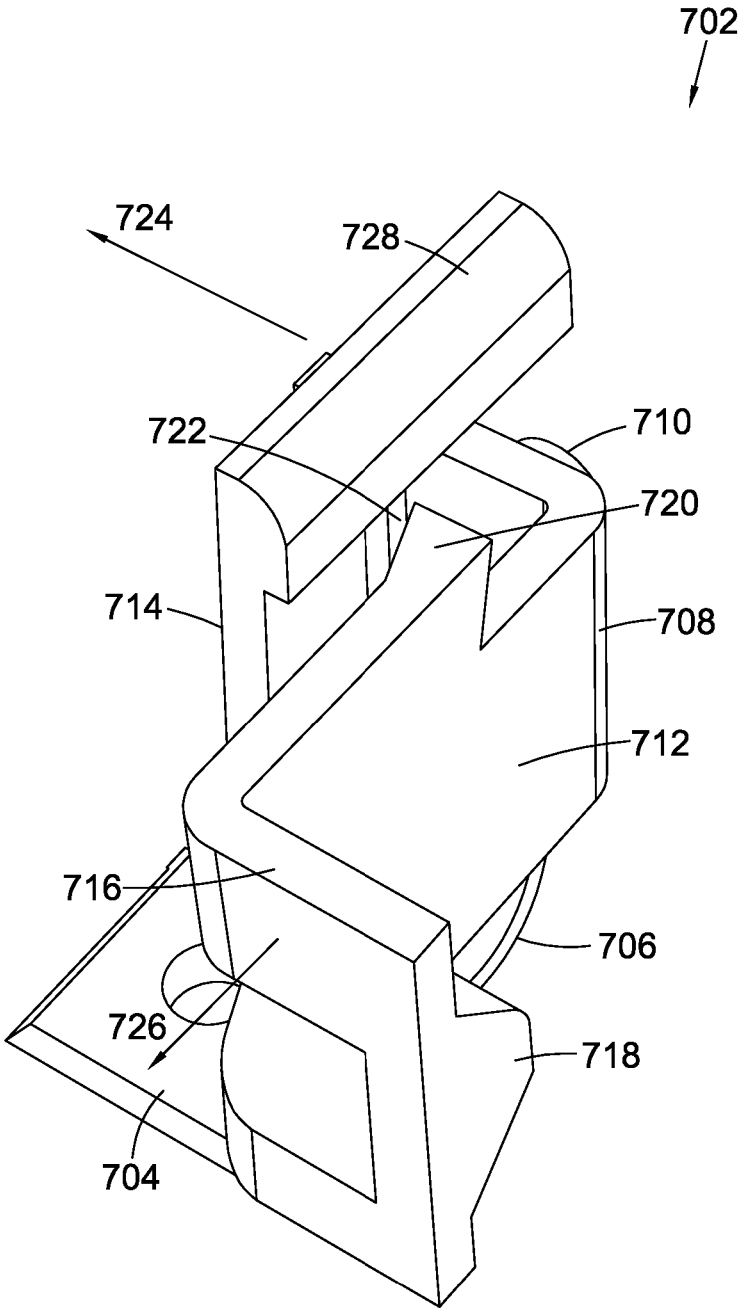
FIG. 38 is a perspective view of the lock.

As shown in FIG. 38, the release portion 712 further comprises a ramped portion 720. As the locking portion 708 flexes in the first direction 726, the ramped portion 720 of the release portion 712 abuts a corresponding ramped portion 722 on the driving portion 714, causing the driving portion 714 to flex in the second direction 724.

Figure 39:
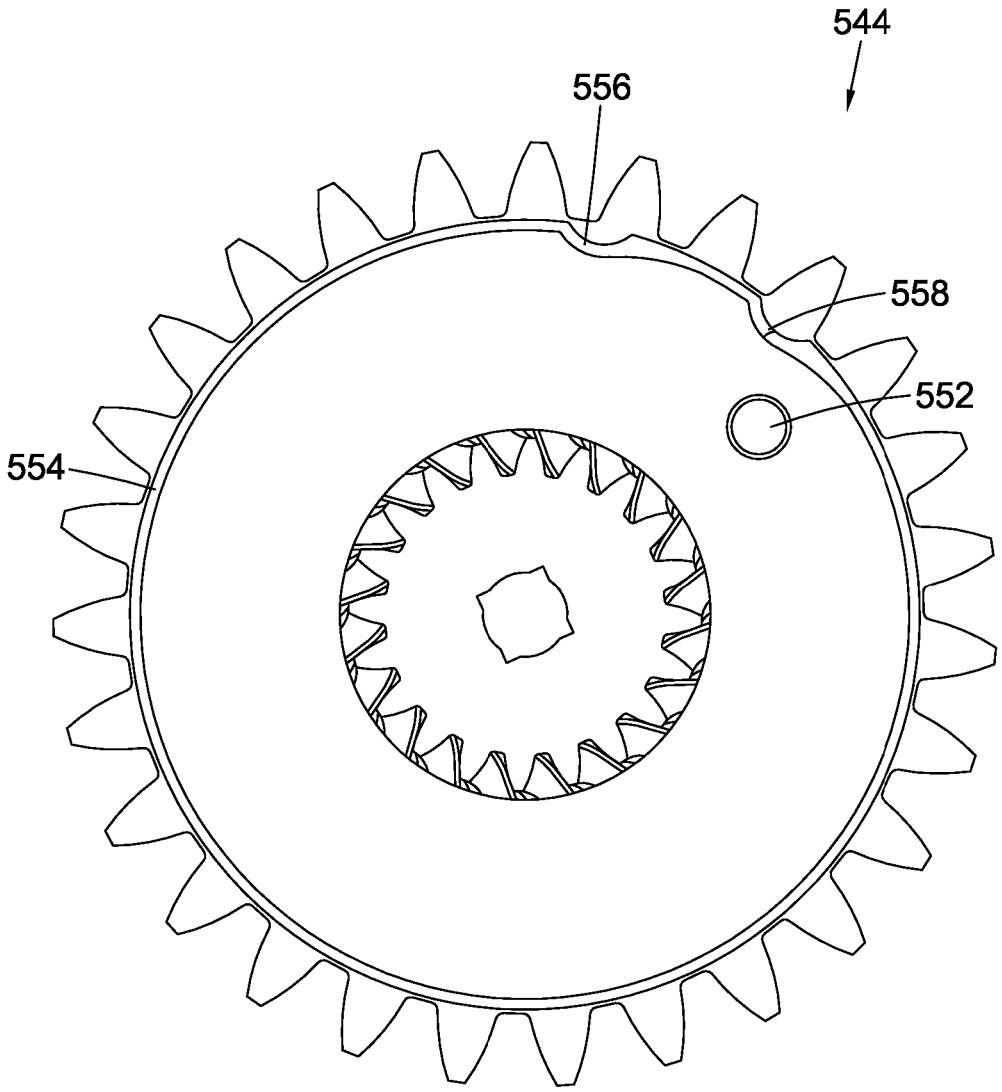
FIG. 39 is a side view of a driving gear.

With reference to FIG. 39, the rim 554 of the driving gear 544 comprises first 556 and second 558 indentations that cooperate with the driving portion 714 of the lock 702. The first 556 and second 558 indentations project radially inwardly from the rim 554 and each comprise a steeply ramped convex portion and a shallow ramped concave portion. The first 556 and second 558 indentations are radially spaced around the rim 554 by approximately 20° and are proximal to the hole 552 in the driving gear 544.

When the lid 100 of the waste disposal device 1 is closed, the hump 718 of the lock 702 rests in the cut-out portion 138 of the locking plate 132 as shown in FIG. 34. Once the waste sealing mechanism 500 has been rotated through 360° as described above with reference to FIGS. 29 to 32, the projection 710 is received into the hole 552 in the driving gear 544 by the biasing action of the sprung portion 706 as is also shown in FIG. 34, thereby preventing further rotation of the waste sealing mechanism 500.

When a user opens the lid 100 fully to insert an item of waste into the waste disposal device 1 as described above and subsequently closes the lid 100, the projecting flange 136 on the locking plate 132 of the lid 100 initially abuts the hump 718 of the lock 702, causing the locking portion 708 to flex in the first direction 726, thereby removing the projection 710 from the hole 552 in the driving gear 544 and releasing the driving gear 544. As the locking portion 708 flexes in the first direction 726, the driving portion 714 flexes in the second direction 724 as described above, causing an end 728 of the driving portion 714 distal to the mounting portion 704 to clear the steeply ramped convex portion of the first indentation 556 of the rim 554 of the driving gear 544.

As the lid 100 is moved further towards the closed position, the hump 718 of the lock 702 is received into the cut-out portion 138 of the locking plate 132 by the biasing action of the sprung portion 706 of the lock 702 and the locking portion 708 is released back towards a neutral position. As the locking portion 708 is released it flexes in a direction opposite to the first direction 726, allowing the driving portion 714 to flex back towards a neutral position in a direction opposite to the second direction 724. As the driving portion 714 flexes in the direction opposite to the second direction 724 the end 728 of the driving portion 714 abuts the shallow ramped concave portion of the first indentation 556 and applies a force in a radially outward direction. The force applied by the driving portion 714 causes the driving gear 544 to rotate as the end 728 of the driving portion 714 slides along the shall ramped concave portion of the first indentation 556.

Because the driving gear 544 has been rotated, the projection 710 does not return into the hole 552 in the driving gear 544 after the lid 100 has been closed until the waste sealing mechanism 500 has undergone the complete cycle described above with reference to FIGS. 29 to 32.

A second indentation 558 is provided in the rim 554 of the driving gear 544 adjacent to the first indentation 556. The second indentation 558 is similar in structure and operation to the first indentation 556, and allows a user to reverse the waste sealing cycle to the starting configuration shown in FIG. 29 and open the lid 100, for example to release a blockage.

Figure 40:
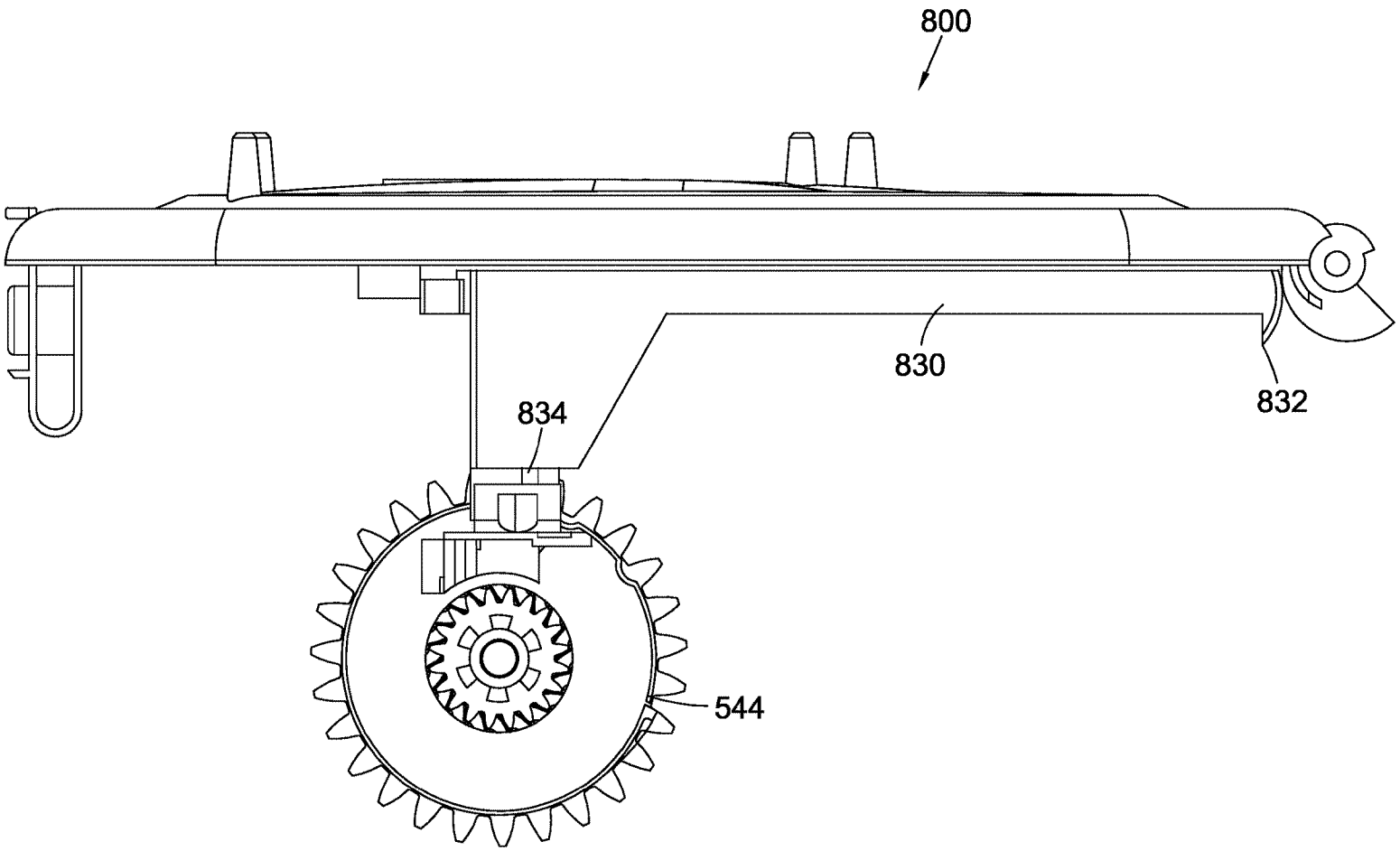
FIG. 40 is a front view of an alternative locking mechanism.
Figure 41:
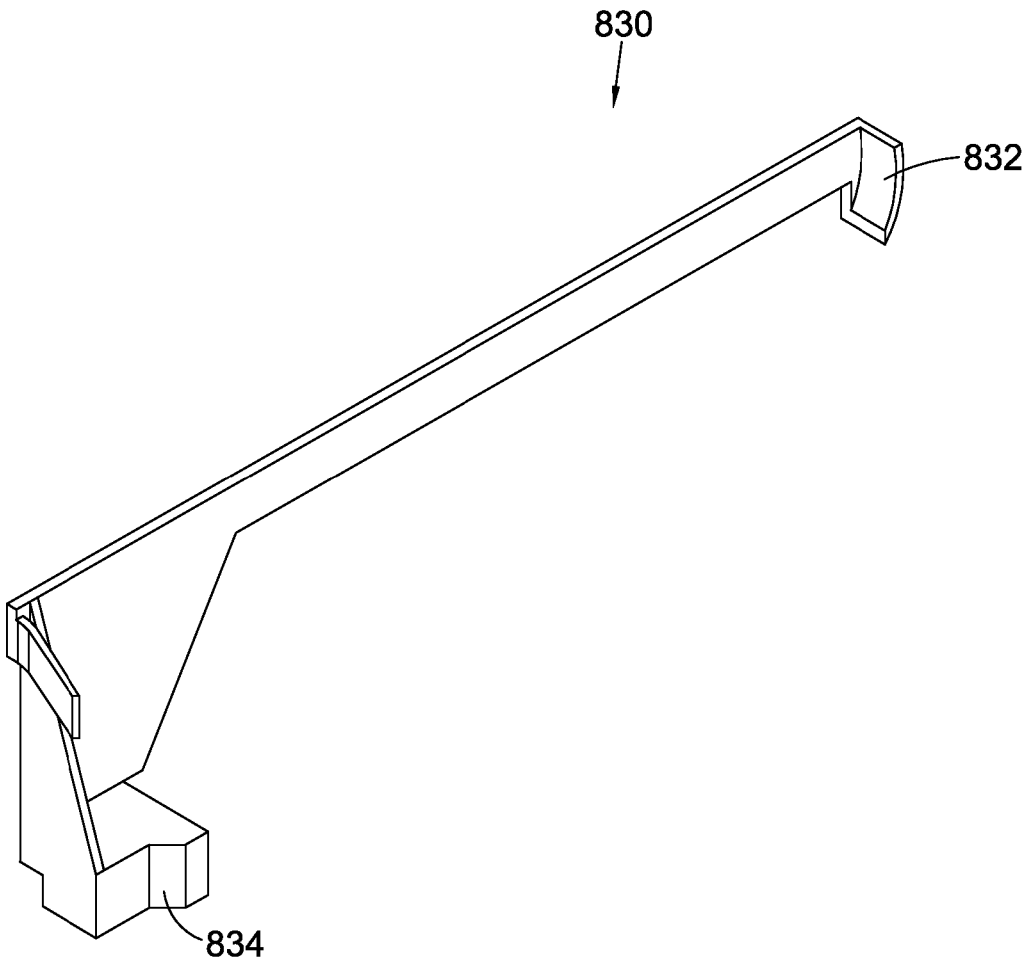
FIG. 41 is a perspective view of a brake rod of the alternative locking mechanism.

An alternative embodiment of a locking mechanism 800 is shown in FIGS. 40 and 41. The locking mechanism 800 of this embodiment is similar to the locking mechanism 700 described above with reference to FIGS. 33 to 39. However, instead of the locking plate 132 of the lid 100, a brake rod 830 is provided. The brake rod 830 is slideably mounted in the top section 200. A first end of the brake rod 830 comprises a curved surface 832, which cooperates with a cam 150 provided on the underside of the lid 100 near the hinged edge 104. As the lid 100 is opened, the cam 150 abuts the curved surface 832 of the brake rod 830, causing the brake rod 830 to slide in the top section 200.

A second end of the brake rod 830 comprises a ramped portion 834. The ramped portion 834 cooperates with the hump 718 of the lock 702. As the lid 100 is opened, the brake rode 830 slides in the top section 200 and the ramped portion 834 abuts the hump 718 of the lock 702, causing the locking portion 708 of the lock 702 to deflect away from the driving gear 544 and removing the projection 710 from the hole 552 in the driving gear 544.

As the locking portion 708 is deflected away from the driving gear by the ramped portion 834 of the brake rod 830, the driving portion 714 flexes in the second direction 724 shown in FIG. 38 and causes the driving gear 544 to rotate such that the projection 710 does not return into the hole 552 in the driving gear 544 when the lid 100 is subsequently closed, as described above.

It will be appreciated that the arrangements described above can be implemented in any appropriate material and in relation to any dimension and material of device or cassette.

In place of the ring 106 and handle 108 provided in the lid 100, any appropriate mechanism may be used to drive the waste sealing mechanism 500. For example, a handle may be provided on the wall 302 of the bottom section 300, which is mechanically connected, directly or otherwise, to the driving axle 514 or the driven axle 516. Alternatively, the axles 514, 516 may be driven by an electric motor.

Instead of replacing the spur gear 126, the slip device 152 may be provided at any appropriate location within the waste disposal device 1. For example, the slip device may be provided in the driving gear 544.

The top section 200 and the bottom section 300 may be integrally formed around the waste sealing mechanism 500. The frame 502 of the waste sealing mechanism 500 may be integrally formed with the top section 200.

The sections 402, 404 of the cassette 400 may not be substantially identical. For example, the cassette 400 may be telescopic, wherein a portion of the second section 404 is received within a portion of the first section 402. Any appropriate mechanism enabling the cassette to be movable between a first, compact configuration and a second, extended configuration may be employed.

In place of the rolls of film 412, any suitable dispenser for dispensing film from the cassette may be used. For example, each section 402, 404 of the cassette 400 may hold a box of folded film. The dispensers may be supported within the cassette 400 by any appropriate means.

Whilst a specific example of the waste sealing mechanism 500 has been described in detail above, any appropriate mechanism can be used to rotate the rollers 600, 602 to seal an item of waste within the film 434.

The first 600 and second 602 rollers may be biased towards one another by means other than the springs 526, 536. For example, the driving 514 and driven 516 axles may be spaced apart such that the coating 610 of the first 600 and second 602 rollers is under compression.

Whist a specific example of a locking mechanism 700 has been described above, it will be appreciated that any appropriate locking mechanism could be used.

Alternative Waste Sealing Device

An alternative waste sealing device 2000 is shown in FIGS. 50-53. The waste sealing device 2000 folds a single layer of film to seal items of waste. The waste sealing device 2000 comprises a container 2100, a film dispenser 2200 and a waste sealing mechanism 2300. In the figures, the walls of the container 2100 are shown as being transparent to demonstrate the waste sealing system 2000, however it will be understood that the container 2100 may be opaque.

The container 2100 comprises a front wall 2102, a rear wall 2104, a bottom wall 2106, side walls 2108, 2110, a waste-receiving wall 2112 and a top wall 2114. The waste-receiving wall 2112 extends from the top wall 2114 to the front wall 2102 and is angled such that, in use, the waste-receiving wall 2112 is directed towards a user. The waste-receiving wall 2112 comprises an aperture 2116 through which waste is received into the waste sealing device 2000. The front wall 2102 may comprise a drawer into which waste is deposited by the waste sealing device 2000 and from which a user can retrieve sealed waste packages.

Figure 52:
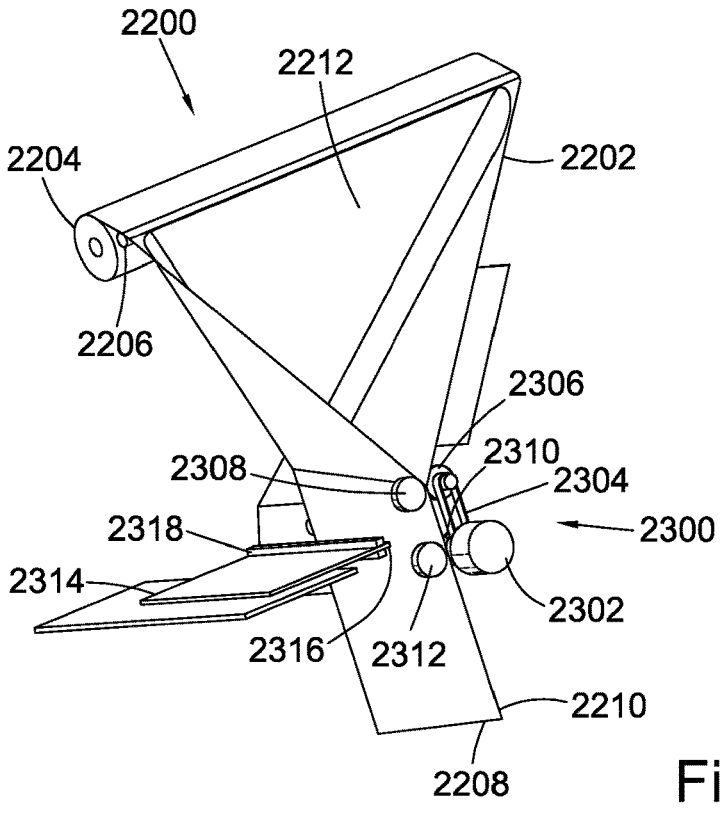
FIG. 52 is a front perspective view of a waste sealing mechanism of the waste sealing device of FIGS. 51-52.
Figure 53:
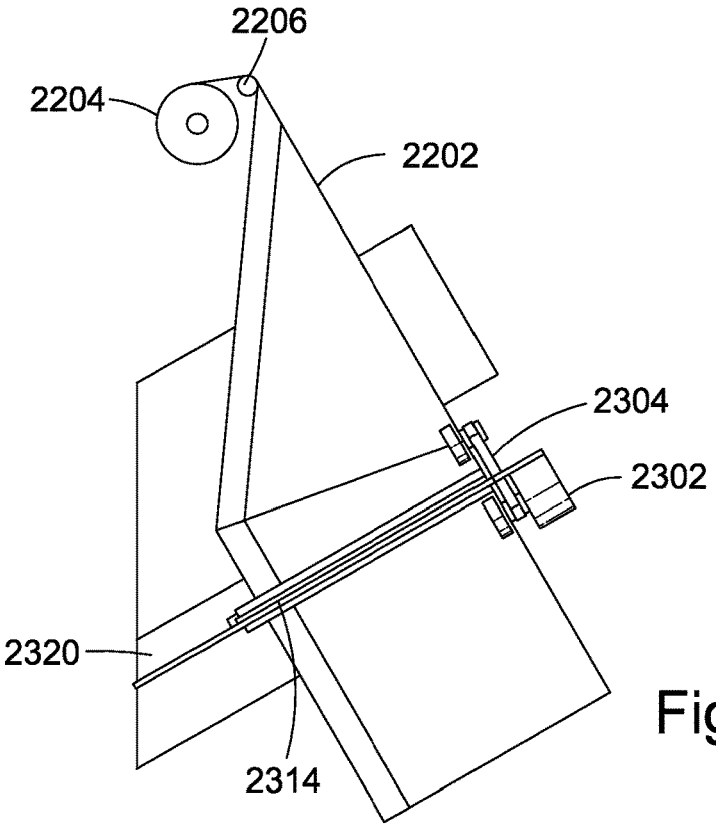
FIG. 53 is a side view of the waste sealing mechanism of FIG. 52.

The film dispenser 2200 and waste sealing mechanism 2300 will now be described in detail with reference to FIGS. 52 to 53.

The dispenser 2200 dispenses film 2202. The dispenser 2200 may comprise a cassette, which is removeably installed into the waste sealing device 2000 to allow replenishment of film 2202. The dispenser may house a roll of film 2204 which is mounted in the dispenser such that the roll of film 2204 can rotate about its longitudinal axis to dispense film 2202. At least one side of the film 2202 comprises an adhesive, or the film may be formed of a material suitable for heat-sealing.

As film 2202 is dispensed from the dispenser 2200, the film 2202 runs over an idle roller 2206. The idle roller 2206 may be mounted in a cassette, or it may be mounted in the container 2100. The idle roller 2206 maintains an angle between the film supply from the dispenser 2200 and the waste sealing mechanism 2300 as the supply of film 2202 is depleted.

The waste sealing mechanism 2300 comprises a motor 2302, a drive belt 2304, a driving roller 2306, a driven roller 2308 a secondary driving roller 2310 and a secondary driven roller 2312.

In operation, two corners 2208, 2210 of an end of the film 2202 are folded together and fed into the waste sealing mechanism 2300. The film 2202 thus comprises a fold from each of the ends of the roll of film 2204 towards the waste sealing mechanism forming a pyramidal shape with a triangular opening 2212.

When activated, the motor 2302 drives the drive belt 2304, which in turn rotates the driving roller 2306. The motor 2302 may comprise an electric motor, or it may comprise a manually-driven mechanism. The driving roller 2306 engages the film 2202 against the driven roller 2308 and draws film through the waste sealing mechanism 2300 from the dispenser 2200, maintaining the folded pyramidal configuration of the film 2202. The driving roller 2306 may comprise studs to grip the film 2202. Because the film 2202 comprises an adhesive, a first edge of the film 2202 is sealed to a second edge of the film 2202 as the driving roller 2306 engages the film 2202 against the driven roller 2308. The driving 2306 and driven 2308 rollers may be spring-loaded or otherwise biased towards one another to provide an effective seal.

The motor 2302 also drives a secondary driving roller 2310. The secondary driving roller 2310 engages the film against a secondary driven roller 2312 in a manner similar to the driving 2306 and driven 2308 rollers described above. The secondary driving 2310 and driven 2312 rollers maintain tension in the film for a subsequent sealing step which will be described below.

The waste sealing mechanism 2300 further comprises a cutter 2314. The cutter 2314 is slideably mounted within the container 2100 and is arranged to engage the film 2202 at a position between the driving 2306 and driven 2308 rollers and the secondary driving 2310 and driven 2312 rollers, where the film 2202 is maintained under tension as described above.

The cutter 2314 comprises a cutting edge 2316 and a sealing bar 2318. The sealing bar 2318 extends across upper and lower surfaces of the cutter 2314 and parallel to the cutting edge 2316. The cutting edge 2316 protrudes past the sealing bar 2318 towards the film 2202.

Figure 54:
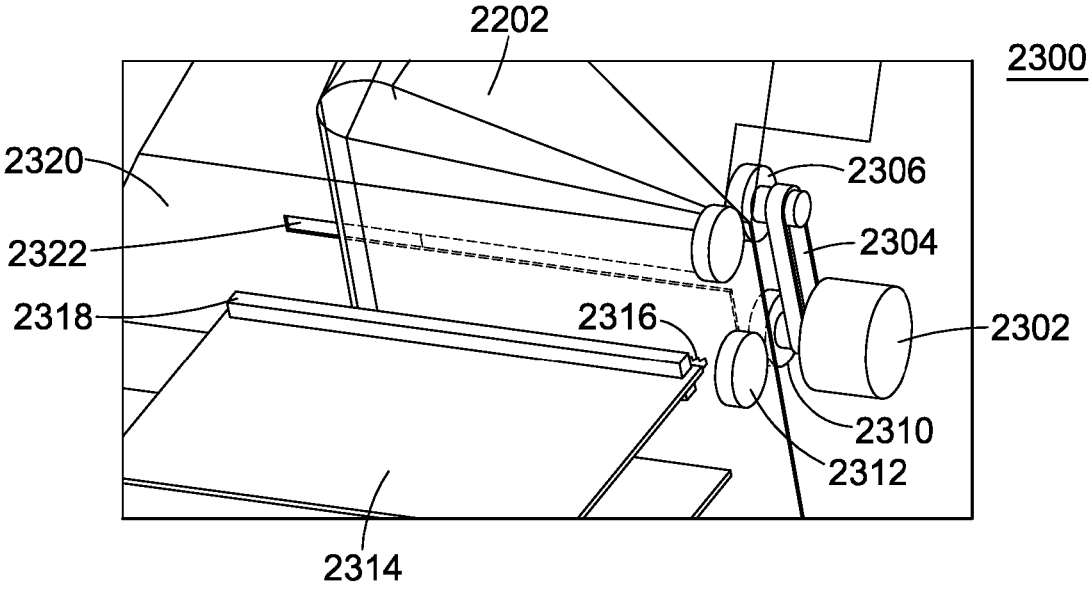
FIG. 54 is a second perspective view of the waste sealing mechanism of FIG. 52.

As best seen in FIG. 54, the waste sealing mechanism 2300 also comprises a backing plate 2320. The backing plate 2320 is located on the opposite side of the container 2100 to the cutter 2314 and is substantially perpendicular to the cutter 2314. The backing plate 2320 comprises an elongated aperture 2322 corresponding to the length of the cutting edge 2316.

After an item of waste has passed through the waste sealing mechanism, the cutter 2314 may be slid towards the film 2202. The cutter 2314 deflects the film 2202 towards the backing plate 2320. The sealing bar 2318, which has a height extending from the plane of the cutter 2314 greater than the height of the aperture 2322 in the backing plate, presses the film 2202 against the backing plate whilst the cutting edge 2316 extends through the aperture 2322. The cutting edge thus cuts the folded film 2202, and the sealing bar seals the folded film 2202 along an edge either side of the cut.

Thus, in use, a user places an item of waste through the aperture 2116 in the waste-receiving wall 2112 of the container 2100. The item of waste is received through the triangular opening 2212 of the folded film 2202. The motor 2302 is then activated, which draws the film 2202 from the dispenser 2200, creating a seal between the folded edges of the film 2202. The item of waste is drawn through the waste sealing mechanism with the film 2202. Once the item of waste has been drawn past the secondary driving 2310 and driven 2312 rollers, the motor 2302 is deactivated and the cutter 2314 is activated. The cutter 2314 slides in the container 2100 to seal and cut the film 2202 above the item of waste. The item of waste is now contained within a sealed package of film and drops into the container 2100. The film 2202 is now sealed at its lower end ready to receive another item of waste.

Spatially relative terms, such as "top", "bottom", "over", "downward", "lower", "above", "upper", "clockwise", "anti-clockwise" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The invention claimed is:

1. A waste disposal device for sealing waste within a pouch, comprising:

a first roller extending axially to define substantially cylindrical opposite end portions and adapted for rotation about a first roller axis;

a first joining section disposed between the opposite end portions of the first roller and defining a first elongate cutout circumferentially disposed along a surface of the first roller, wherein the opposite end portions of the first roller include first sealing surfaces disposed adjacent to the first elongate cutout;

a second roller disposed adjacent to the first roller and extending axially to define substantially cylindrical opposite end portions and adapted for rotation about a second roller axis; and a second joining section disposed between the opposite end portions of the second roller and defining a second elongate cutout circumferentially disposed along a surface of the second roller, wherein the opposite end portions of the second roller include second sealing surfaces disposed adjacent to the second elongate cutout;

wherein the first elongate cutout and second elongate cutout are proximally arranged to define a passageway for receiving the waste when in a first rotational configuration of the first and second rollers;

wherein the first joining section and the second joining section are proximally arranged to define a platform for holding the waste when in a second rotational configuration;

wherein the first joining section includes a first outer radial surface and the second joining section includes a second outer radial surface, the first and second outer radial surfaces being for forming a horizontal seal of the pouch; and wherein the first sealing surfaces and the second sealing surfaces are adapted for forming a vertical seal of the pouch.

2. The waste disposal device of claim 1, further comprising:

a first film portion associated with the first roller; and a second film portion associated with second roller;

wherein each of the opposite end portions are arranged to receive and seal the first film portion and the second film portion therebetween as the first and second rollers rotate.

3. The waste disposal device of claim 2, wherein at least one of the opposite end portions of at least one of the first and second rollers comprises a depression for capturing liquid between the first film portion and the second film portion.

4. The waste disposal device of claim 2, wherein the first and second joining portions seal the first and second film portions once per 360° rotation of the first and second rollers.

5. The waste disposal device of claim 2, wherein at least one of the opposite end portions of the first roller and at least one of the opposite end portions of the second roller are in contact during rotation to form a seal along an end of each of the first and second film portions.

6. The waste disposal device of claim 5, wherein each of the opposite end portions of the first roller and the second roller are in contact during rotation to form a seal along a second end of each of the first and second film portions.

7. The waste disposal device of claim 5, wherein the first joining portion and the second joining portion are in contact during rotation to form an elongate seal between first and second ends of each of the first and second film portions.

8. The waste disposal device of claim 2, wherein at least one of the first and second film portions comprises an adhesive on a face thereof.

9. The waste disposal device of claim 1, further comprising a gear assembly mechanically coupled to the first roller and second roller for rotationally maintaining the first elongate cutout and second elongate cutout in an arrangement to define a passageway for receiving the waste.

10. The waste disposal device of claim 1, wherein the first joining portion and the second joining portions substantially form a circular sector in cross section.

11. The waste disposal device of claim 10, wherein the circular sector substantially formed by the first and second joining portions has a central angle of less than 90°.

12. The waste disposal device of claim 10, wherein the circular sector substantially formed by the first and second joining portions has a central angle of greater than 15°.

13. The waste disposal device of claim 1, wherein at least a portion of at least one of the first and second rollers is covered with a flexible material.

14. The waste disposal device of claim 1, wherein the waste disposal device is adapted to receive a removable cassette for dispensing film.

15. The waste disposal device of claim 1, wherein the second roller is biased towards the first roller to provide a sealing force.

16. The waste disposal device of claim 1, wherein rotation of the second roller is driven by rotation of the first roller.

17. The waste disposal device of claim 1, further comprising a guide for guiding waste between the first and second rollers.

18. A waste disposal device for sealing waste material having a lid cooperatively engaged with a top portion, the top portion housing a replaceable cassette assembly for dispensing film, and a waste sealing mechanism, and the top portion mounted to a bottom portion for receiving the sealed waste material, comprising:

a lid slot disposed at the lid for receiving waste material;

a first film carrier and second film carrier rotatably mounted at the replaceable cassette assembly for dispensing film through the waste disposal device, wherein the replaceable cassette assembly is insertably housed in the top portion;

the waste sealing mechanism housed in the top portion to receive waste material from the lid slot, comprising a first roller extending axially along a first roller axis for receiving a first film portion dispensed from the first film carrier and a second roller extending axially along a second roller axis generally parallel to the first roller axis and for receiving a second film portion dispensed from the second film carrier, wherein each roller is arranged to seal the first film portion and the second film portion therebetween as the first and second rollers rotate;

a pair of substantially cylindrical opposite end portions of the first roller extending along the first roller axis;

a pair of substantially cylindrical opposite end portions of the second roller extending along the second roller axis;

a first joining section disposed between the pair of substantially cylindrical opposite end portions of the first roller and defining a first elongate cutout circumferentially disposed along a surface of the first roller, wherein the opposite end portions of the first roller include first sealing surfaces disposed adjacent to the first elongate cutout;

a second joining section disposed between the pair of substantially cylindrical opposite end portions of the second roller and defining a second elongate cutout circumferentially disposed along a surface of the second roller, wherein the opposite end portions of the second roller include second sealing surfaces disposed adjacent to the second elongate cutout;

a gear assembly mechanically coupled to the first roller and second roller for rotationally configuring the first elongate cutout and second elongate cutout when in a first proximal arrangement to define a passageway for receiving waste material; and the bottom portion forming a base of the waste disposal device and having an upper portion defining a passage for receiving the waste material;

wherein the first joining section and the second joining section are rotationally configured when in a second proximal arrangement to define a platform for holding the waste;

wherein the first joining section includes a first outer radial surface and the second joining section includes a second outer radial surface, the first and second outer radial surfaces being for forming a horizontal seal of the pouch;

wherein the first sealing surfaces and the second sealing surfaces are adapted for forming a vertical seal of the pouch.

19. The waste disposal device of claim 18 wherein each of the substantially cylindrical opposite end portions include substantially flat surfaces, and the substantially cylindrical opposite end portions of the first roller receive flush along the flat surface the first film portion from the first film carrier and the substantially cylindrical opposite end portions of the second roller receive flush along the flat surface the second film portion from second film carrier.

* * * * *